US010494800B2

(12) United States Patent
Ahuja et al.

(10) Patent No.: US 10,494,800 B2
(45) Date of Patent: Dec. 3, 2019

(54) POP-UP DRAIN ASSEMBLY, CONNECTOR DEVICE AND DRAIN STOPPER

(71) Applicant: PF Waterworks LP, Houston, TX (US)

(72) Inventors: Sanjay Ahuja, Katy, TX (US); Harold Kent Beck, Copper Canyon, TX (US)

(73) Assignee: PF Waterworks LP, Houston, TX (US)

( * ) Notice: Subject to any disclaimer, the term of this patent is extended or adjusted under 35 U.S.C. 154(b) by 22 days.

(21) Appl. No.: 15/844,131

(22) Filed: Dec. 15, 2017

(65) Prior Publication Data

US 2018/0171610 A1 Jun. 21, 2018

Related U.S. Application Data

(60) Provisional application No. 62/474,058, filed on Mar. 20, 2017, provisional application No. 62/461,419, filed on Feb. 21, 2017, provisional application No. 62/436,024, filed on Dec. 19, 2016.

(51) Int. Cl.
*E03C 1/23* (2006.01)

(52) U.S. Cl.
CPC .... *E03C 1/2302* (2013.01); *E03C 2001/2311* (2013.01)

(58) Field of Classification Search
CPC ..... E03C 1/2304; E03C 2001/2311
USPC ..... 4/689, 690, 692
See application file for complete search history.

(56) References Cited

U.S. PATENT DOCUMENTS 773,408 A 10/1904 Moore
1,485,669 A * 3/1924 Davis ..... E03C 1/23 4/690
1,647,188 A 11/1927 Mueller et al.
1,723,038 A 8/1929 Hoelscher
1,980,250 A 11/1934 Baxter
2,179,121 A 11/1939 Frank et al.
2,292,604 A * 8/1942 Graf ..... E03C 1/23 251/243
2,486,246 A 10/1949 Beeke
2,807,806 A 10/1957 Watkins
3,002,196 A 10/1961 Mackey, Jr.
4,192,026 A 3/1980 Williams
4,577,349 A 3/1986 Clegg
4,596,057 A 6/1986 Ohta et al.
4,903,943 A 2/1990 Hochstrasser
5,787,521 A 8/1998 O'Connell et al.
(Continued)

FOREIGN PATENT DOCUMENTS

DE 2842490 A 9/1978

*Primary Examiner* — Huyen D Le
(74) *Attorney, Agent, or Firm* — Stephen S. Hodgson

(57) ABSTRACT

A pop-up drain assembly for a sink has a drain stopper, a generally vertical control rod and a generally horizontal pivot rod. A connector device links the control rod to the pivot rod. The connector device has compressive-friction connectors that receive and hold the control rod and the pivot rod. The connector device preferably has a pair of opposing C-channels that define a hole therebetween, where the control rod is received through the hole and within an open C-shaped space in the C-channels, and preferably a two-prong fork, where the pivot rod is held in a compressive-friction fit between the prongs on the connector device. The drain stopper preferably has a dual-prong fork, and the pivot rod is received between the prongs on the drain stopper in a compressive-friction fit.

49 Claims, 19 Drawing Sheets

(56) References Cited

U.S. PATENT DOCUMENTS

| | | | | |
|---|---|---|---|---|
| 5,822,812 | A | 10/1998 | Worthington et al. | |
| 6,470,514 | B2 | 10/2002 | Onoue | |
| 6,484,330 | B2 | 11/2002 | Gray et al. | |
| 6,973,685 | B2 | 12/2005 | Duncan | |
| 8,407,829 | B2 * | 4/2013 | Vogel | A47K 1/14 4/689 |
| 8,739,328 | B2 | 6/2014 | Duncan | |
| 10,221,549 | B1 * | 3/2019 | Fregoe | E03C 1/2302 |
| 2006/0179564 | A1 | 8/2006 | Jacobs | |
| 2010/0050337 | A1 | 3/2010 | Li et al. | |
| 2011/0185494 | A1 * | 8/2011 | Beck | E03C 1/23 4/689 |
| 2017/0183851 | A1 * | 6/2017 | Lin | E03C 1/2302 |

* cited by examiner

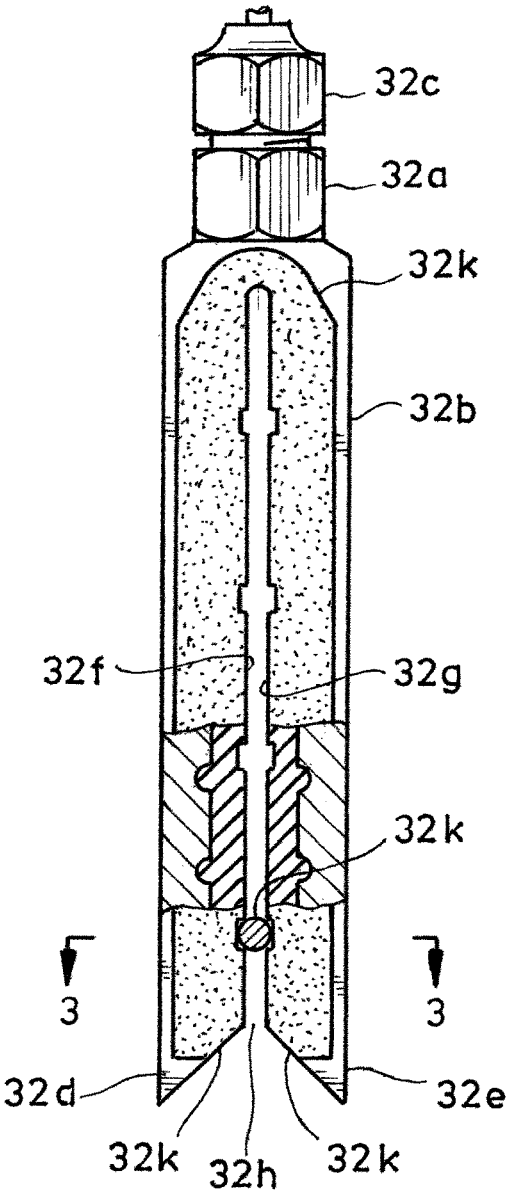
FIG. 2
FIG. 3
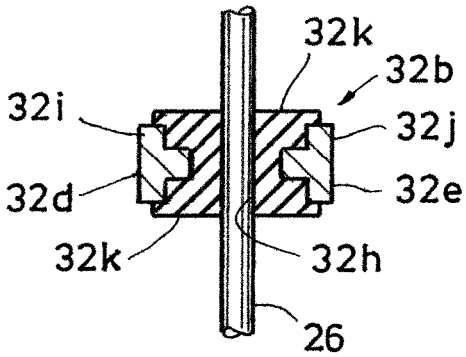
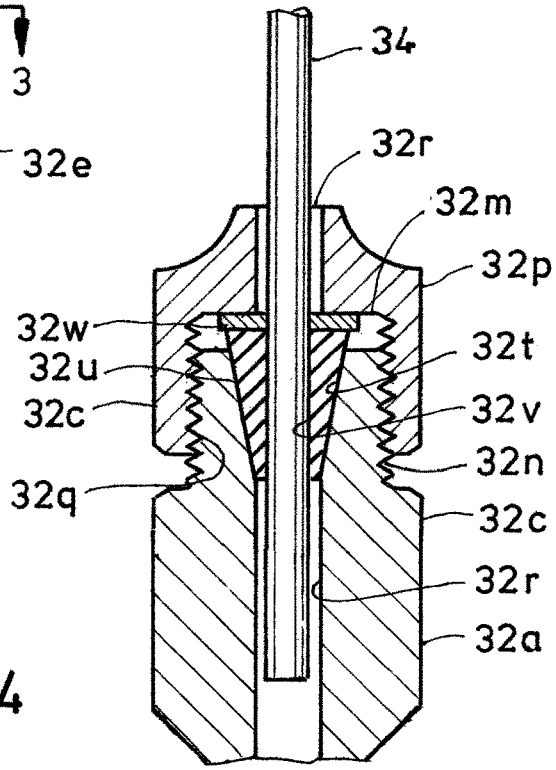
FIG. 4

34
50g
50m
13C
13D
50p
50n
50j
50b
50h
50i
50c
50k
50d
50f
50
50e
50a
26

FIG. 14A
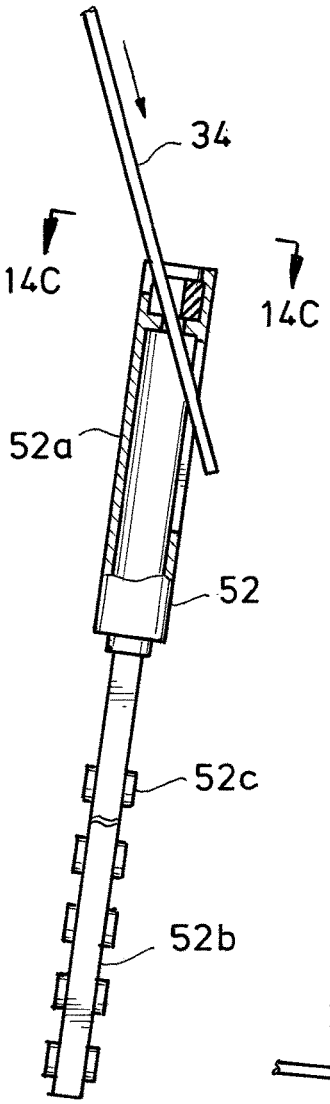
FIG. 14B
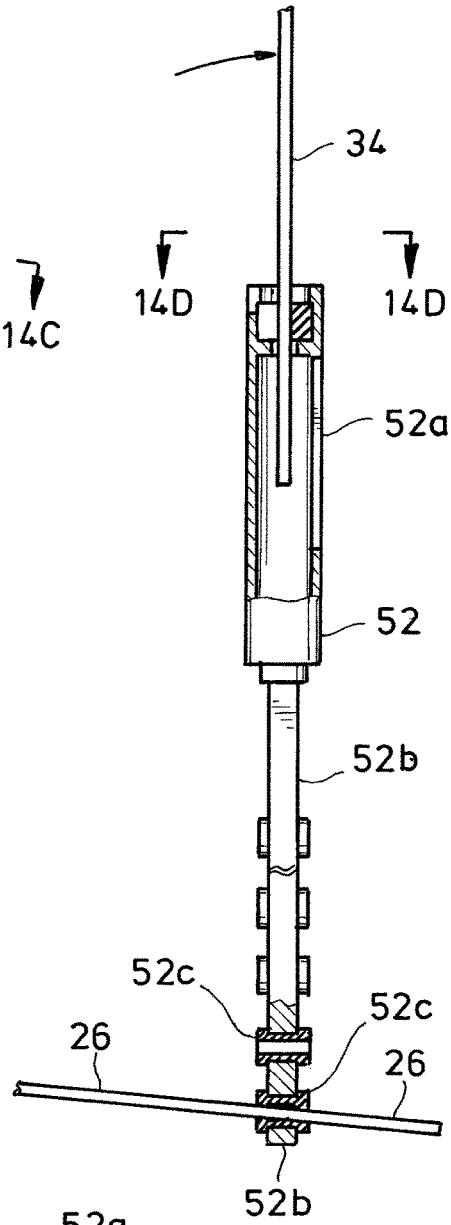
FIG. 14
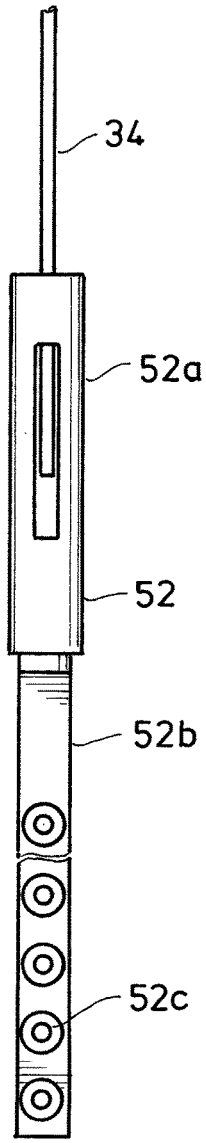
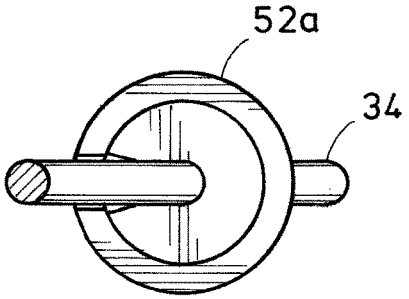
FIG. 14C
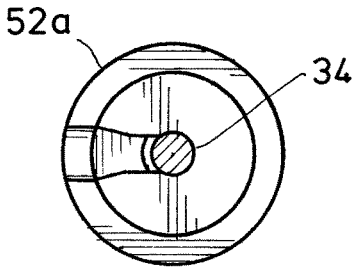
FIG. 14D FIG.15
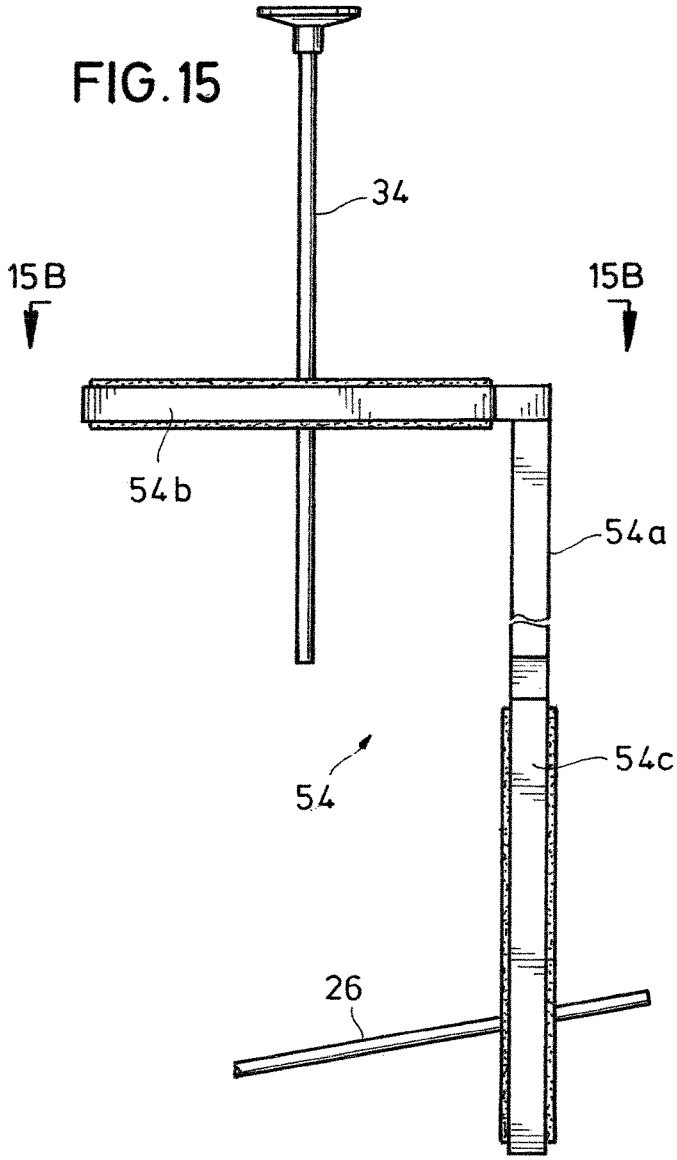
FIG.15A
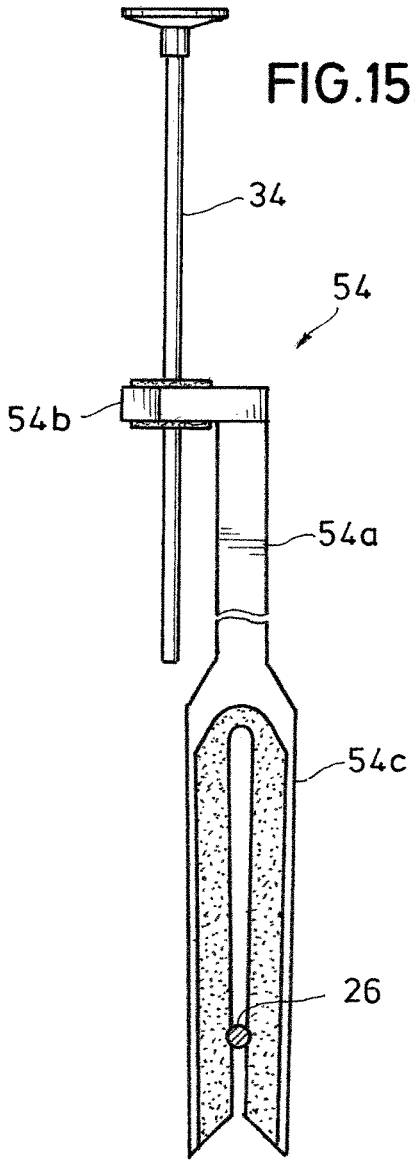
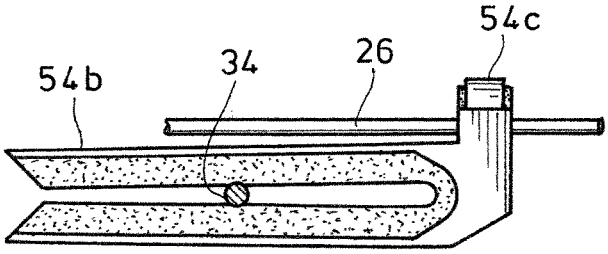
FIG.15B FIG. 16
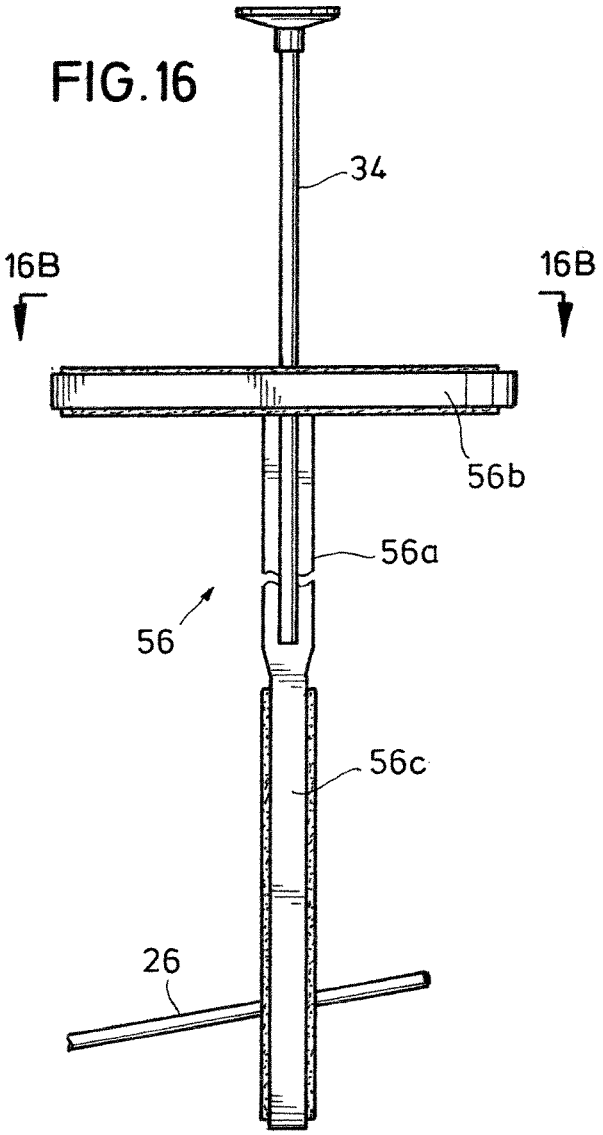
FIG. 16A
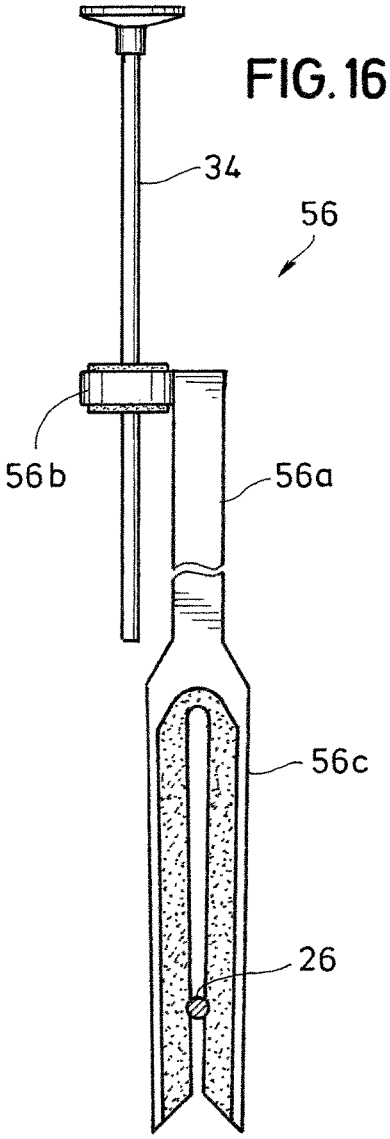
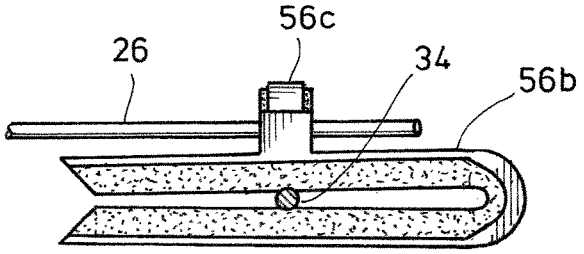
FIG. 16B 34
60a
18B
60c
18B
60
60e'
60e
60d
60d'
60b
18A
18A
60c'
26
58a
58e
58d
58b
26
58e
58a
58
58b
58d
26
60b'
60c'
26
60b
60c
34
60a
60a
60a'

FIG.19A
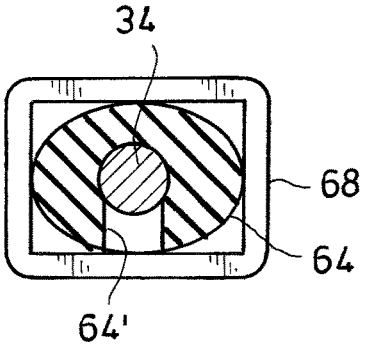
FIG.19B
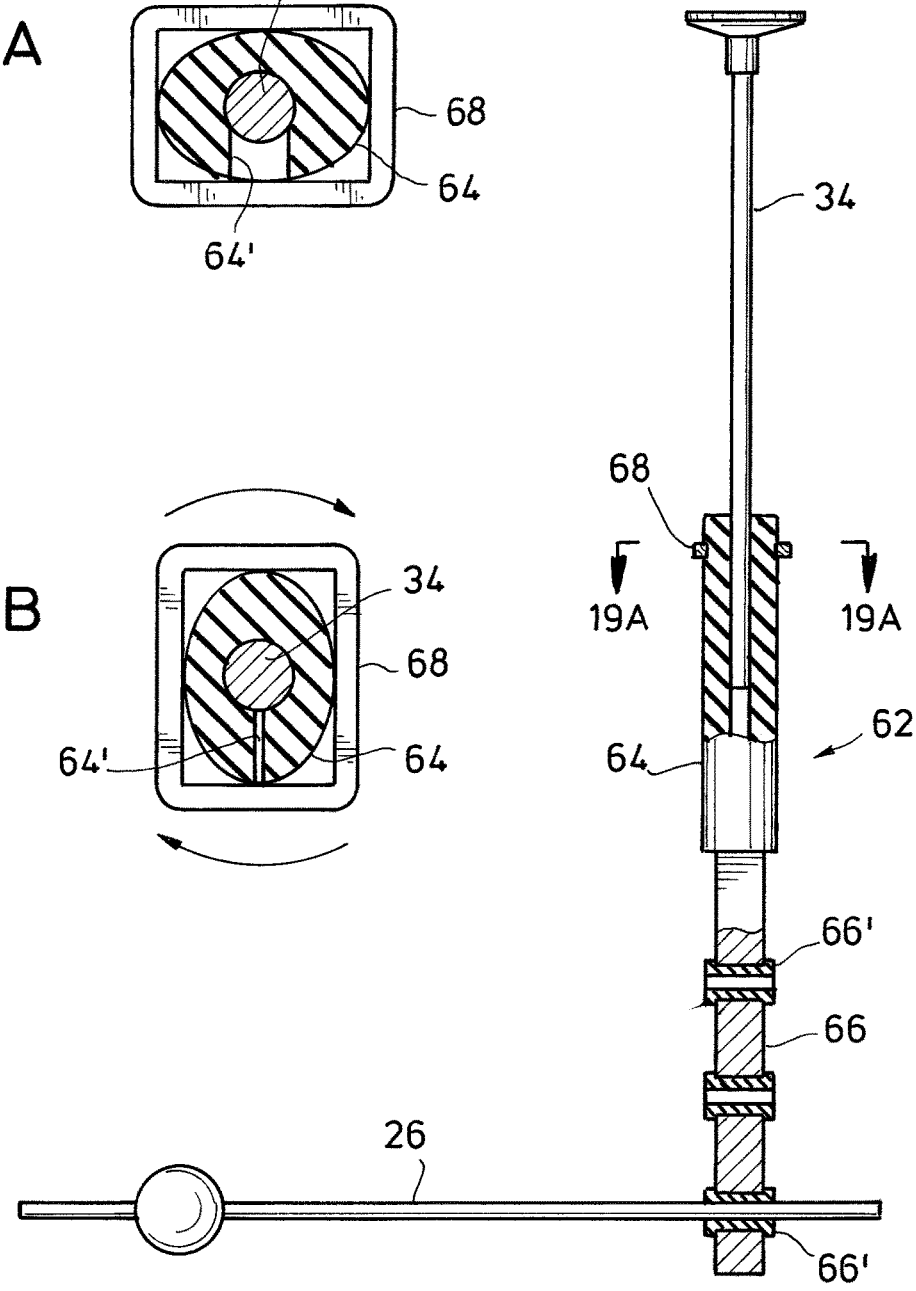
FIG.19

FIG. 24
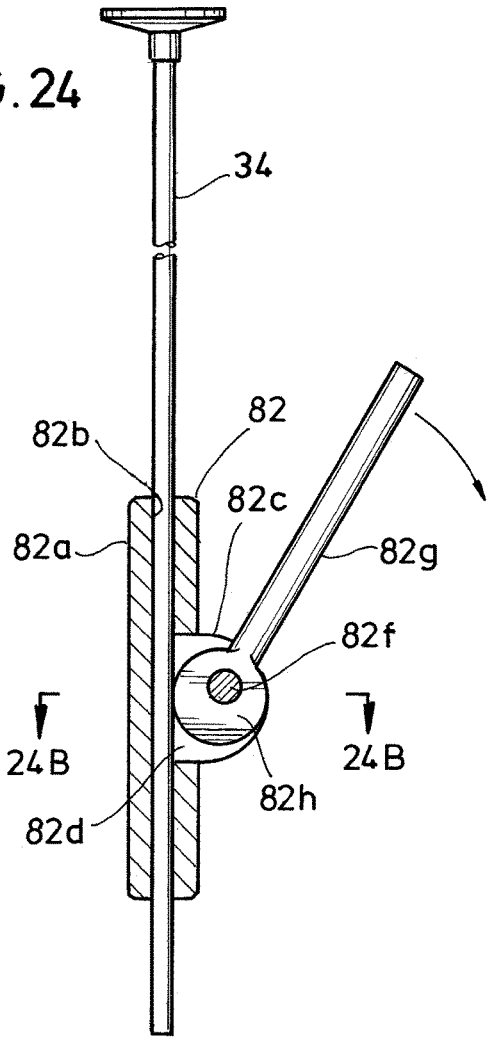
FIG. 24A
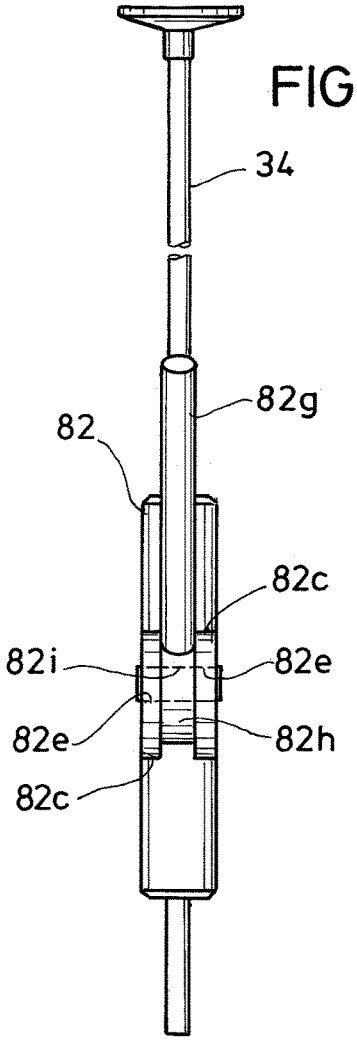
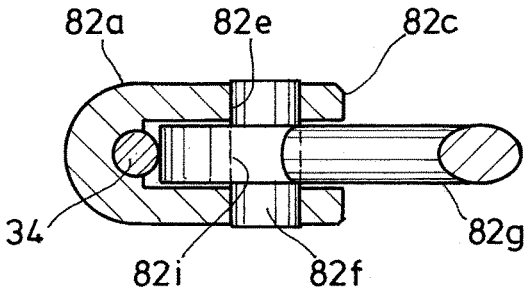
FIG. 24B

FIG. 26
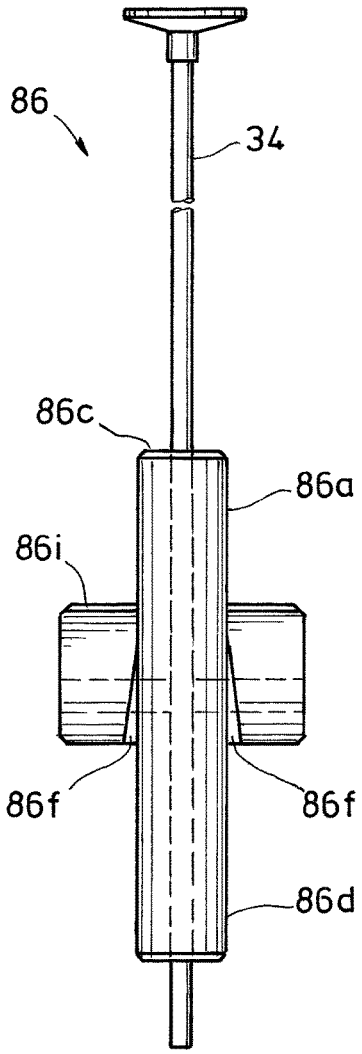
FIG. 26A
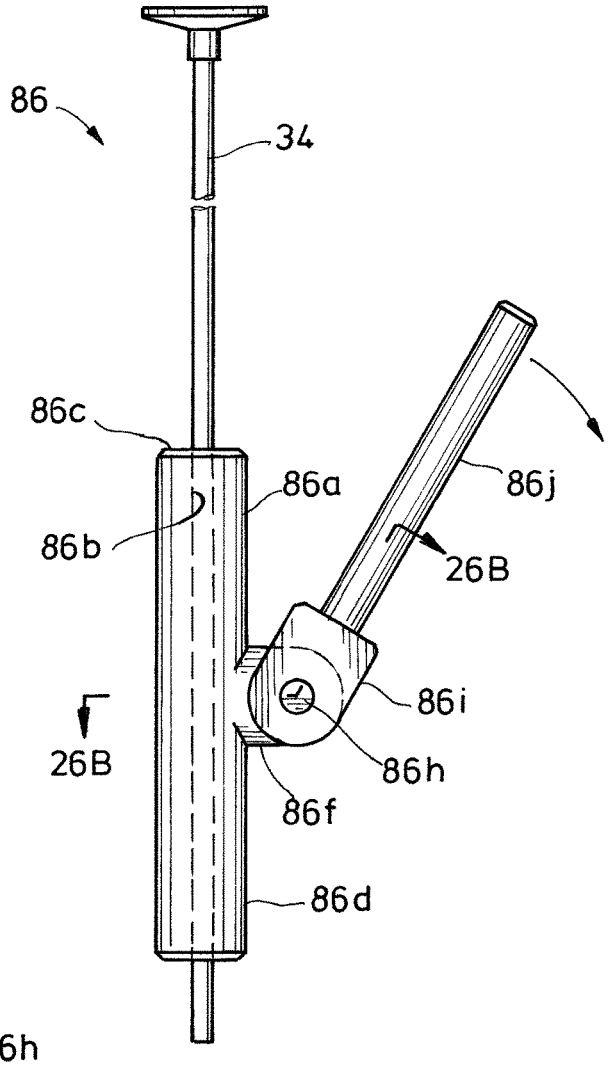
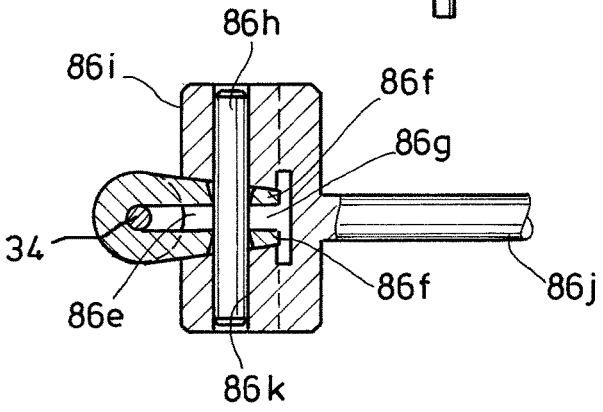
FIG. 26B

FIG. 27B
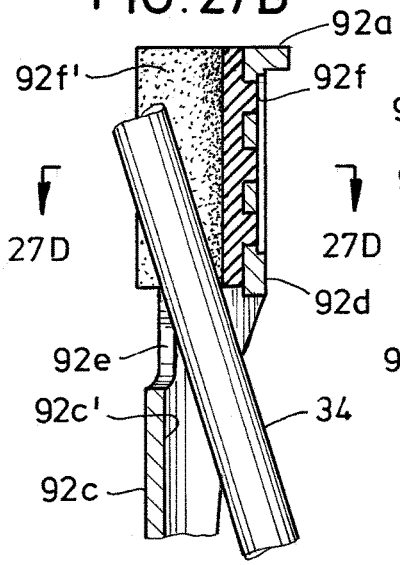
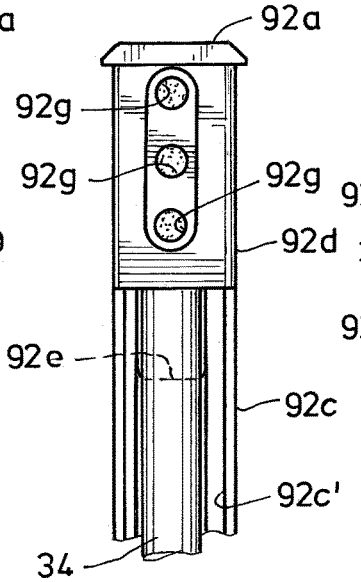
FIG. 27C
FIG. 27D
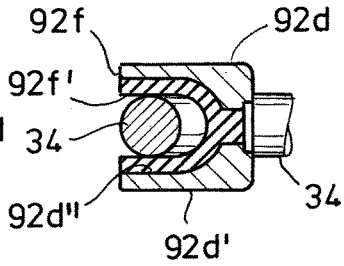
FIG. 27E
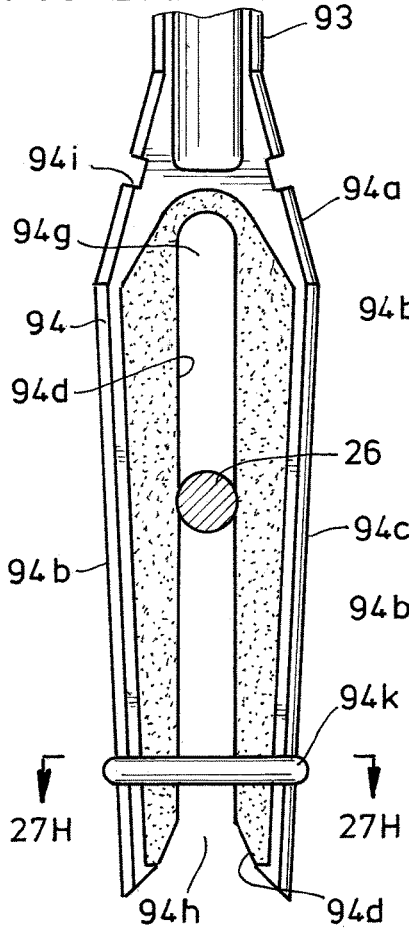
FIG. 27G
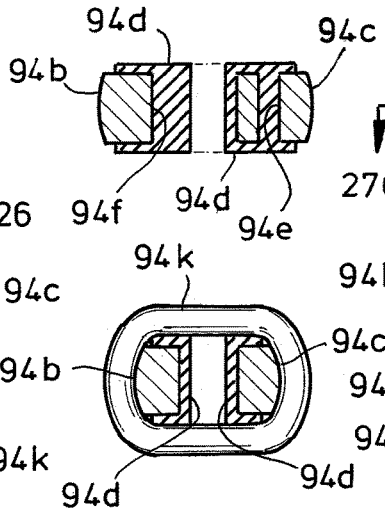
FIG. 27H
FIG. 27F
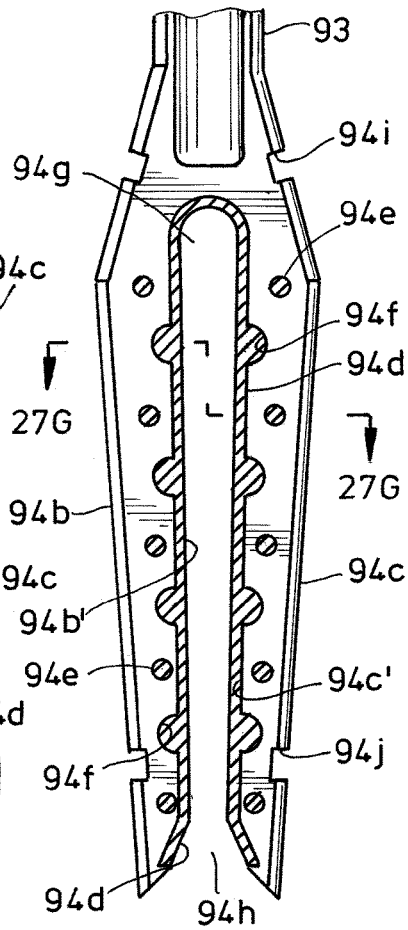

POP-UP DRAIN ASSEMBLY, CONNECTOR DEVICE AND DRAIN STOPPER

CROSS REFERENCE TO RELATED APPLICATIONS

This application claims priority to and the benefit of U.S. Provisional Patent Application Ser. Nos. 62/474,058 filed on Mar. 20, 2017, 62/461,419 filed on Feb. 21, 2017, and 62/436,024 filed on Dec. 19, 2016, each of which is incorporated by reference. This application is related to U.S. patent application Ser. No. 15/584,027, filed on May 2, 2017, which was published as U.S. Patent Application Pub. No. 20170260724 A1, and Ser. No. 15/650,650, filed on Jul. 14, 2017, which was published as U.S. Patent Application Pub. No. 20170321401 A1, each of which is incorporated by reference.

BACKGROUND OF THE INVENTION

1. Field of the Invention

This present invention pertains to a pop-up drain assembly used to retain fluid in and release fluid from a sink or basin and more particularly to the connection of a lift rod or a control rod to one end of a pivot rod or actuating lever and the connection of a drain stopper to the other end of the pivot rod.

2. Description of the Related Art

In a lavatory or bathroom sink or basin equipped with a supply of running water for washing oneself, a pop-up drain assembly allows one to retain water in the sink or basin and then release the water to flow by gravity downwardly through a drain pipe. The sink or basin has an opening at a lowermost point, and a typical pop-up drain assembly comprises a drain conduit sealingly fastened to the sink or basin within the opening. A drain stopper is received in the drain conduit for sealing the opening and retaining water in the sink or basin. A pivot rod protrudes into the drain conduit and engages a bottom portion of the drain stopper. A lift rod or control rod is connected to the pivot rod. One can pull the lift rod up to pull the drain stopper down for sealing the opening in the bottom of the sink or basin for retaining water, and one can push the lift rod down to raise the drain stopper, which unseals the drain stopper and allows water to drain from the sink or basin.

Installing a pop-up drain assembly has been difficult and time consuming. After installing the drain pipe in the sink opening, one dropped the drain stopper in the drain opening and had to align a pivot rod holder ring with a pivot rod port in the drain pipe and insert the pivot rod into the port and into the holder ring. The lift rod or control rod was dropped down from above the sink through a hole. Then, while on one's back under the sink, one needed to connect the vertical control rod to the horizontal pivot rod. A clevis rod, which has a U-shaped bend and holes in the bend, was typically connected to the control rod such that the control rod passed through the holes, and a screw in the middle of the U-shaped bend was tightened against the control rod. The clevis rod includes an extension that extends downwardly, and the extension has several openings spaced apart vertically. One leg of a U-shaped spring clip was placed on the pivot rod; the pivot rod was inserted through one of the openings; and the other leg of the U-shaped spring clip was placed on the pivot rod such that the extension was between the two legs of the U-shaped spring clip.

Connecting the vertical control rod to the horizontal pivot rod while lying on one's back under a sink has been difficult and time consuming. It has sometimes been necessary to disassemble a portion of the connection to remove the drain stopper for unclogging the drain pipe, which has often clogged due to an accumulation of hair and debris in the drain pipe and around the drain stopper and the pivot rod. The present inventors' U.S. Patent Application Pub. No. 20110185494 A1 describes options for reducing the tendency of a pop-up drain assembly to become clogged, but a need remains for a way to connect a vertical control rod or lift rod to a horizontal pivot rod or ball rod that is easier and simpler than the typical installation described above.

SUMMARY OF THE INVENTION

A pop-up drain assembly for a sink or basin that has a drain opening includes: piping for providing a fluid flow pathway from the sink or basin through the drain opening and through the piping; a stopper for retaining fluid in the sink or basin, wherein the stopper is received in the piping while in operation and is moveable between an open position and a closed position; and a pivot rod engaged with the stopper for moving the stopper between the open position and the closed position, wherein the pivot rod has a stopper end and an outer end; a control rod for moving the pivot rod; and a connector device for connecting the control rod and the pivot together.

The connector device includes: a body; a control-rod connector attached to or formed integral with the body; and a pivot-rod connector attached to or formed integral with the body, wherein each of the control-rod connector and the pivot-rod connector comprises a compressive and/or friction engagement means for engaging the control rod and pivot rod, respectively, and wherein the compressive and/or friction engagement means is selected from the group consisting of:

a fork having two prongs adjacent to one another, wherein the fork is sized and designed to hold the control rod or the pivot rod between the prongs, a compression fitting having a ferrule element, a first tubular body having a bore, a C-shaped resilient disk received in the bore, and a washer-shaped wall in the bore transverse to the longitudinal axis of the first tubular body, wherein the C-shaped resilient disk is sized and designed to hold the control rod or the pivot rod, a bar having one or more holes, the holes being sized and designed to hold the control rod or the pivot rod, a first tube made of a stiff and resilient material having a longitudinal slot along its length and an inside diameter, the first tube being sized and designed to matingly receive the control rod or the pivot rod inside the first tube, and a clamp around the first tube, a second tube having an open end and an opposing closed end and an adhesive received in the second tube, the second tube and the adhesive being selected to releaseably hold the control rod or the pivot rod inside the second tube, a third tube having an open end, an inner circumference, one or more grooves in the inner circumference and at least one snap ring received in one of the grooves, the third tube and snap ring being sized and designed to hold the control rod or the pivot rod inside the third tube, a fourth tube having one or more longitudinal slots, external threads on the fourth tube and a nut having internal threads screwed onto the fourth tube, wherein the fourth tube, the slots and the nut are sized and designed to hold the control rod or the pivot rod inside the fourth tube, a fifth tube having a tubular wall, an opening in the wall and a lever-type eccentric-cam clamp attached to the fifth tube at the opening, the fifth tube and eccentric-cam clamp being sized and designed to hold the control rod or the pivot rod in the fifth tube, a sixth tube having a longitudinal slot, bulges protruding from the sixth tube, the bulges having an angled surface, a block having a lever, the block having angled surfaces pivotably fixed to the bulges, wherein the sixth tube, the bulges and the block are sized and designed such that rotation of the lever reduces the inside diameter of the sixth tube for holding the control rod or the pivot rod in the sixth tube, a shaft having distal and proximal end portions, wherein the distal end portion has a longitudinal trough, wherein the proximal end portion has a longitudinal groove, wherein the longitudinal trough and the longitudinal groove have concave surfaces that face in opposite directions, wherein an opening is defined by and between distal and proximal end portions, and wherein the shaft is sized and designed to receive the control rod or the pivot rod through the opening, in the longitudinal trough and in the longitudinal groove, and a fastener in which a resilient material is pressed against the control rod or the pivot rod for engaging the fastener with the control rod or the pivot rod. The compressive and/or friction engagement means is preferably selected from the group consisting of: the fork, the bar and the shaft.

A connector device for connecting a generally vertical control rod to a generally horizontal pivot rod in a pop-up drain assembly preferably includes: a shaft having first and second opposing ends, a length, a first side along its length and a groove along the first side, wherein the groove has a longitudinal axis; a C-channel element having first and second opposing ends, a length, a second side along its length and a trough along the second side, wherein the trough has a longitudinal axis, wherein the second end of the C-channel element abuts and is attached to or formed integral with the first end of the shaft, wherein the longitudinal axis of the trough is approximately coaxial with the longitudinal axis of the groove, wherein the second side of the C-channel element faces in a direction opposite the direction that the first side of the shaft faces, wherein a hole that is large enough for the control rod to pass through is defined between the C-channel element and the shaft, and wherein shaft and the C-channel element are sized and designed so that a length of the control rod can pass through the hole and lie at least partially inside the groove and at least partially inside the trough in a compressive-friction engagement; and a pivot rod connector attached to the second end of the shaft that is sized and designed to hold the pivot rod. The pivot rod connector is preferably a two-prong fork, where the pivot rod is held between the prongs of the fork, or a bar that has holes, where the bar is preferably an elongate, flat plate that has several holes sized to receive the pivot rod.

A drain stopper preferably includes: a body having a length, an upper end and an opposing lower end, wherein the body defines a circular cylindrical space that has a longitudinal axis and an outer surface; a cap having a seal or a gasket, wherein the cap is received on the upper end of the body; and a two-prong fork attached directly or indirectly to the body, wherein the two-prong fork has an outer surface, wherein the outer surface of the two-prong fork has a length that extends longitudinally along the outer surface of the circular cylindrical space, and wherein the two-prong fork has a longitudinal axis that is offset radially from the longitudinal axis of the circular cylindrical space.

BRIEF DESCRIPTION OF THE DRAWINGS

A better understanding of the invention can be obtained when the detailed description of exemplary embodiments set forth below is considered in conjunction with the attached drawings in which:

FIG. 2 is a side elevation of the connector device shown in FIG. 1 in a partial cross-section.

FIG. 3 is a cross-section of the connector device shown in FIG. 1, as seen along the line 3-3 in FIG. 2.

FIG. 4 is a side elevation in cross-section of a compression fitting used in the connector device shown in FIG. 2.

FIG. 14 is a side elevation of a connector device for connecting a control rod with a pivot rod, according to the present invention.

FIG. 14A is a side elevation in partial cross-section of the connector device of FIG. 14, which shows the control rod in the process of being engaged with the connector device, according to the present invention.

FIG. 14B is a side elevation in partial cross-section of the connector device of FIG. 14, which shows the control rod fully engaged with the connector device and a pivot rod engaged with the connector device, according to the present invention.

FIG. 14C is a cross-section of the connector device shown in FIG. 14A as seen along the line 14C-14C in FIG. 14A.

FIG. 14D is a cross-section of the connector device shown in FIG. 14B as seen along the line 14D-14D in FIG. 14B.

FIG. 15 is a side elevation of a connector device for connecting a control rod with a pivot rod, according to the present invention.

FIG. 15A is a side elevation of the connector device of FIG. 15 rotated 90 degrees clockwise as viewed from above.

FIG. 15B is a cross-section of the connector device of FIG. 15 as seen along the line 15B-15B in FIG. 15.

FIG. 16 is a side elevation of a connector device for connecting a control rod with a pivot rod, according to the present invention.

FIG. 16A is a side elevation of the connector device of FIG. 16 rotated 90 degrees clockwise as viewed from above.

FIG. 16B is a cross-section of the connector device of FIG. 16 as seen along the line 16B-16B in FIG. 16.

FIG. 19 is a side elevation in partial cross-section of a connector device for connecting a control rod to a pivot rod, according to the present invention.

FIG. 19A is a cross-section of the connector device of FIG. 19 as seen along the line 19A-19A in FIG. 19.

FIG. 19B is a cross-section of the connector device of FIG. 19 as seen along the line 19A-19A in FIG. 19 after a ring is twisted 90 degrees.

FIG. 24 is a side elevation in partial cross-section of a connector device that can be connected to a control rod, according to the present invention.

FIG. 24A is a side elevation of the connector device of FIG. 24 rotated 90 degrees clockwise as viewed from above.

FIG. 24B is a cross-section of the connector device of FIG. 24 as seen along the line 24B-24B in FIG. 24.

FIG. 26 is a side elevation of a connector device that can be connected to a control rod, according to the present invention.

FIG. 26A is a side elevation of the connector device of FIG. 26 rotated 90 degrees clockwise as viewed from above.

FIG. 26B is a cross-section of the connector device of FIG. 26A as seen along the line 26B-26B in FIG. 26A.

FIG. 27B shows a portion of the connector device of FIG. 27, as indicated by a box labeled 27B in FIG. 27.

FIG. 27C is a side elevation of the portion of the connector device shown in FIG. 27B, after being rotated 90 degrees clockwise as viewed from above.

FIG. 27D is a cross-section of the portion of the connector device shown in FIG. 27B as seen along the line 27D-27D in FIG. 27B.

FIG. 27E is a side elevation in partial cross-section of a portion of the connector device of FIG. 27A, as seen along the line 27E-27E in FIG. 27A.

FIG. 27F is a side elevation in partial cross-section of a portion of the connector device of FIG. 27, as seen along the line 27F-27F in FIG. 27.

FIG. 27G is a cross-section of the connector device of FIG. 27 as seen along the line 27G-27G in FIG. 27F.

FIG. 27H is a cross-section of the connector device of FIG. 27 as seen along the line 27H-27H in FIG. 27E.

DETAILED DESCRIPTION OF EXEMPLARY EMBODIMENTS

Figure 1:
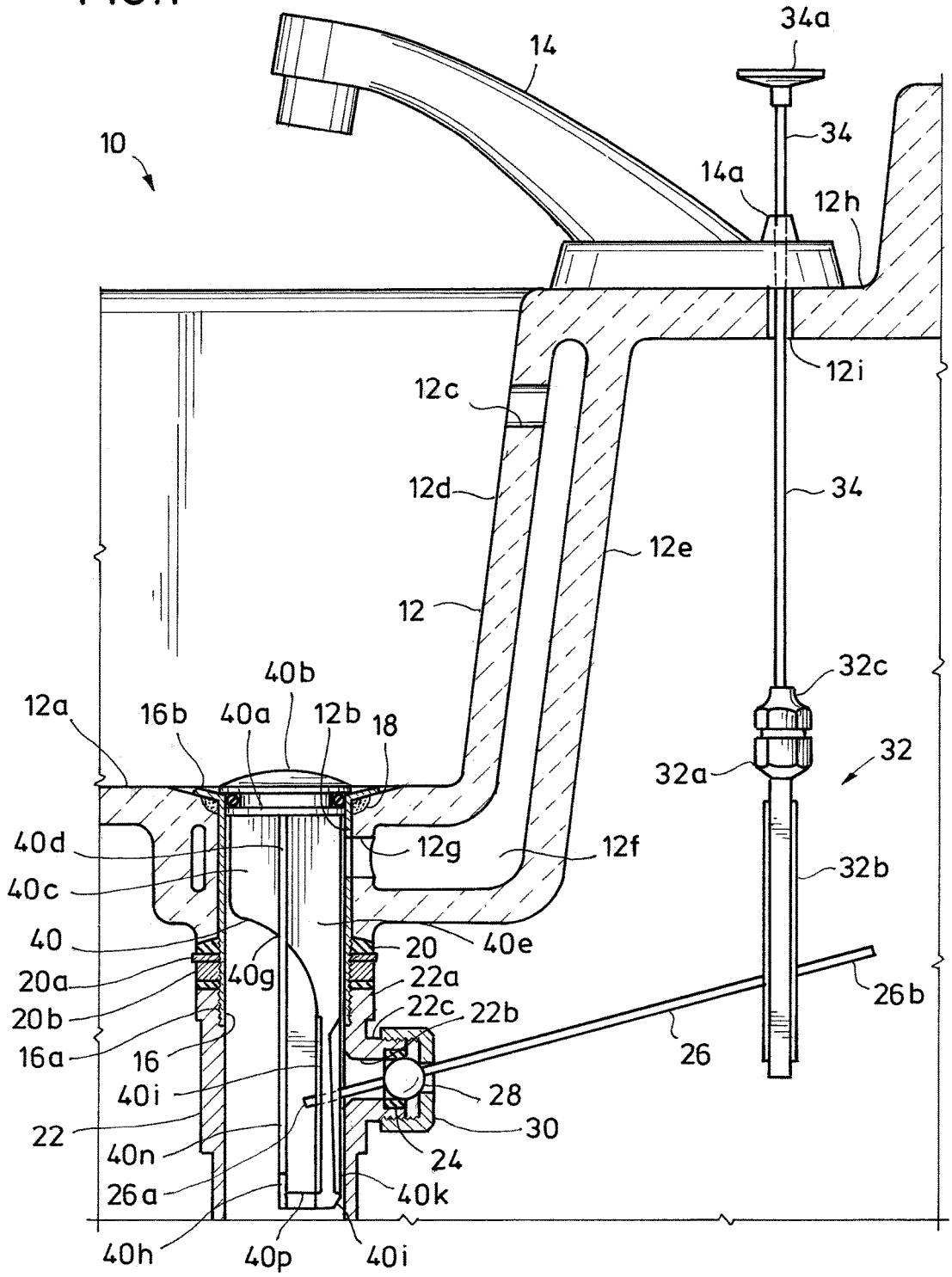
FIG. 1 is a cross-section of a side elevation of a sink or basin and a pop-up drain assembly, which shows a drain stopper, a generally horizontal pivot rod engaged with the drain stopper, a connector device engaged with the pivot rod and a generally vertical control rod engaged with the connector device, according to the present invention.

The present invention provides a pop-up drain assembly for a sink or basin for receiving and retaining a fluid, which is typically water, and a drain opening is provided in a lowermost portion of the sink or basin for draining the fluid. The pop-up drain assembly includes piping that can be placed through the drain opening and fastened to the sink or basin. The piping is typically connected to a drain pipe, and the piping provides a fluid flow pathway from the sink or basin through the drain opening and through the piping to the drain pipe for conveying fluid from the sink or basin to the drain pipe and away for disposal and/or treatment. After the drain assembly is installed on a sink, a drain stopper is received in the piping and is moveable between an open position and a closed position. In the closed position, the stopper provides a seal with the piping for retaining fluid in the sink or basin, and in the open position, fluid can enter the piping and drain away through the drain pipe. A pivot rod is engaged with the stopper for moving the stopper between the open position and the closed position. The pivot rod is received in a pivot ball and pivots about a generally horizontal position. One end of the pivot rod is engaged with the stopper, and the other end of the pivot rod is connected to a lift rod or a control rod for raising the stopper to the open position and lowering the stopper to the closed position. The present invention is concerned with the design, installation and operation of a pop-up drain assembly.

The pop-up drain assembly disclosed in the present inventors' U.S. Patent Application Pub. No. 20110185494 A1 describes the pivot rod and control rod as follows. A pivot rod has a stopper end for engaging with a drain stopper and an outer end linked to a control rod. A user lifts the control rod up to close the drain stopper and pushes the control rod down to close the stopper. A pivot ball is sealingly received on pivot rod closer to stopper end than outer end. The pivot rod is received in a stub off of a drain pipe such that stopper end is inside the stub, and the stopper ball rests against a pivot rod seal. A pivot rod cap is threaded onto the stub sufficiently tightly to seal the pivot ball against the pivot rod seal, but loose enough to allow the pivot ball and the pivot rod to pivot. A lower end of a vertical extension rod has a plurality of holes. The outer end of the pivot rod is connected to the extension rod by passing the pivot rod through one of the holes in the extension rod. A U-shaped clip maintains the connection. An upper end of the extension rod is bent so as to have two parallel portions that are perpendicular to the longitudinal axis of the extension rod, and each of the two parallel portions has a hole through which a control rod is received. The control rod passes through aligned openings from above a faucet to below the faucet and below a faucet deck or a countertop. The control rod has a knob at an upper end, and the control rod is fastened to the extension rod by a set screw that passes through the extension rod between the two parallel portions. The extension rod is sometimes referred to as a clevis, and the screw is referred to as a clevis screw.

To assemble the prior art connection between the control rod and the pivot rod, the control rod is passed down through the openings until the knob rests on the faucet. The stopper end of the pivot rod and the pivot ball are placed inside the stub, and the pivot rod cap is threaded onto the stub. The U-shaped clip has two parallel legs and a hole in each leg. One leg of the clip is placed on the outer end of the pivot rod; the extension rod is placed on the pivot rod at a desired hole in the extension rod; and the other leg of the U-shaped clip is placed on the pivot rod. The legs of the U-shaped clip are pressed closer together, and the clip and extension rod are slid along the pivot rod to a desired position. The control rod is passed through the holes in the two parallel portions of the upper end of the extension rod. The position of the pivot rod is adjusted to place the drain stopper in its open position while the control knob is in its down position, and the set screw in the extension rod is tightened against the control rod, thereby providing a rigid connection between the control rod and the pivot rod. An installer typically makes all of these connections while in a prone position under a sink, which is typically inside the cramped space of a cabinet. A simpler and easier connection of the control rod to the pivot rod is described below. A drain stopper that connects simply and easily to the pivot rod is also described below.

Turning now to the drawings and with reference to FIG. 1, a pop-up drain assembly 10 is shown according to the present invention. Drain assembly 10 is received in a sink or basin 12, such as is typically used in a lavatory. Sink 12 has a lower surface 12*a* that drains into a drain opening 12*b*. Sink 12 has an overflow port 12*c* in a side wall 12*d*, which is an optional feature. An outer wall 12*e* and side wall 12*d* define an overflow channel 12*f*, and side wall 12*d* has an overflow drain port 12*g* for draining overflow fluid into a port in drain assembly 10. A faucet 14 is mounted on a top deck 12*h* of sink 12 for supplying water or other fluid to sink 12.

A number of different manufacturers make and sell pop-up drain assemblies, which can be retrofitted to provide a pop-up drain assembly according to the present invention. In the embodiment depicted in FIG. 1, pop-up drain assembly 10 comprises a drain flange 16 that fits down through drain opening 12*b* in sink 12. Preferably, drain flange 16 has a threaded tubular portion 16*a* extending essentially throughout its full length and a flange 16*b* extends radially outwardly on a top end. A gasket or plumber's putty 18 provides a seal between the lower surface 12*a* of the sink 12 and the flange 16*b* of drain flange 16. A flexible gasket 20 and a washer 20*a* are placed around a bottom portion of drain flange 16 and then pressed tightly against a bottom surface of sink 12 with a threaded nut 20*b*. A drain body 22 is threaded onto a lower end of drain flange 16. Drain body 22 has a wrench flange 22*a* for receiving a wrench for tightening and loosening drain body 22 with respect to drain flange 16. Drain body 22 has a pivot rod port 22*b*, and a threaded tubular stub 22*c* projects radially outwardly from drain body 22. A pivot rod seal 24 is received in stub 22*c*.

A pivot rod 26 has a stopper end 26*a* and an outer end 26*b*. A pivot ball 28 is sealingly received on pivot rod 26 closer to stopper end 26*a* than outer end 26*b*. Pivot rod 26 is received in stub 22*c* such that stopper end 26*a* is inside the drain body 22, and the stopper ball 28 rests against pivot rod seal 24. A pivot rod cap 30 is threaded onto stub 22*c* sufficiently tightly to seal pivot ball 28 against pivot rod seal 24, but loose enough to allow pivot ball 28 and pivot rod 26 to pivot.

With reference to FIGS. 1-4, a connector device 32 links the outer end 26*b* of the pivot rod 26 to a control rod 34. Connector device 32 has a central body 32*a*, a two-prong fork 32*b* and a compression fitting 32*c*. The two prong fork engages the pivot rod 26 in a friction fit. One prong is on one side of the pivot rod and the other prong on the other side of the pivot rod, and the pivot rod is squeezed between the two prongs, which applies a spring force on the pivot rod thereby holding the pivot rod in a friction fit. Control rod 34 passes through a faucet port 14*a* and a sink control rod port 12*h*. Control rod 34 has a knob 34*a* at an upper end, and control rod 34 is fastened to connector device 32 by the compression fitting 32*c*.

FIG. 1 shows the two-prong fork 32*b* in a side elevation. FIG. 2 shows the two-prong fork 32*b* in a front elevation. The two-prong fork 32*b* has a pair of opposing prongs 32*d* and 32*e* that extend downwardly and parallel to one another from the central body 32*a*. Opposing prongs 32*d* and 32*e* have inside faces 32*f* and 32*g*, and a gap 32*h* is defined between the inside faces 32*f* and 32*g*. The pivot rod 26 is received in the gap 32*h*. FIG. 3 is a cross-section of the two-prong fork 32*b* as seen along the line 3-3 in FIG. 2.

The connector device 32 is preferably made of polymeric materials. Opposing prongs 32*d* and 32*e* preferably comprise two different polymeric materials. As best seen in FIG. 3, each of the prongs 32*d* and 32*e* have outer T-shaped portions 32*i* and 32*j*, respectively, where the leg of the T-shape is positioned inwardly toward the gap 32*h* and the cap of the T-shape provides an outer surface. The T-shaped portions 32*i* and 32*j* are preferably made of a relatively stiff, but resilient, polymeric material. Each of the prongs 32*d* and 32*e* have an inner liner or insert 32*k*, which is less stiff and more resilient than the T-shaped outer portions 32*i* and 32*j*. For example, the T-shaped outer portions 32*i* and 32*j* may be made of an acrylonitrile butadiene styrene (ABS) material, while the inner liner or insert 32*k* may be made of a thermoplastic elastomer such as styrene butadiene rubber. Another example is that both the outer T-shaped portions 32*i* and 32*j* and the inner liner or insert 32*k* may be made of a styrene-butadiene-styrene (SBS) copolymer, where the outer T-shaped portions 32*i* and 32*j* are made with an SBS copolymer that has a relatively high styrene content and low butadiene content and the inner liner or insert 32*k* has relatively less styrene content and relatively more butadiene content. The inner liner or insert 32*k* is more rubbery and more resilient than the outer T-shaped portions 32*i* and 32*j*. These portions of the prongs 32*d* and 32*e* work cooperatively to hold the pivot rod 26 in a friction fit. The outer T-shaped portions 32*i* and 32*j* provide stiffness and resiliency for applying a spring force for holding the pivot rod 26. The inner liner or insert 32*k* compresses and surrounds the pivot rod to some extent and provides a somewhat high-friction, preferably rubbery, surface for engaging and holding the pivot rod 26. FIG. 2 shows a partial cross-section of the prongs 32*d* and 32*e* and the inner liner or insert 32*k*, which shows indentations and protrusions between the inner liner or insert 32 and the prongs 32*d* and 32*e* for improving a bond between the inner liner or insert 32*k* and the prongs 32*d* and 32*e*.

Repeating to some extent what has been said above, the connector device 32 provides a simple set of elements for connecting the generally vertical control rod 34, which a person would pull up or push down, to the generally horizontal pivot rod 26. Prior art pop-up drain assemblies often used a connecting element that relied on a set-screw connection to the vertical control rod and a pass-through hole in the connecting element for receiving the pivot rod. A clip was used for maintaining the connecting element in a desired position with respect to the pivot rod. The present invention provides in one aspect and in one embodiment the connector device 32, which includes: (1) the two-prong fork that an installer can simply push down transversely onto the generally horizontal pivot rod; and (2) the compression fitting 32*c* that receives the generally vertical control rod 34 in a bore having a longitudinal axis aligned with the longitudinal axis of the control rod 34.

FIG. 4 shows a cross-section of a side elevation of the compression fitting 32*c*. Compression fitting 32*c* extends upwardly from the central body portion 32*a*, while the two-prong fork 32*b* extends downwardly. Compression fitting 32*c* has a male cylinder 32*m*, which has external threads 32*n*, and a female cylinder 32*p*, which has internal threads 32*q*. Compression fitting 32*c* has a central, longitudinal bore 32*r* along the longitudinal axis of the connector device 32. The bore 32 is enlarged into a conical-shaped bore 32*t* inside the male cylinder 32*m* and has a greater diameter at its opening into the upper face of the male cylinder 32*m* than in a lower portion toward the central body 32*a*. A conical washer 32*u* having a central longitudinal bore 32*v* is matingly received in the conical-shaped bore 32*t*. The conical washer 32*u* has a lower surface and an upper surface, and diameter of the upper surface is greater than that of the lower surface, thereby providing an arrowhead shape that points downwardly. A flat washer 32*w* sits on the upper surface of the conical washer 32*u*. An installer may in one procedure: insert the conical washer 32*u* into the conical-shaped bore 32*t*; place the washer 32*w* on the conical rubber washer 32*u*; thread the female cylinder 32*p* onto the male cylinder 32*m* into a loose fit; slide the control rod 34 into the bore 32*r* to a depth below the conical washer 32*u*. It may be necessary to cut the control rod 34 to provide a particular length for proper operation of the pop-up drain assembly. In another procedure, the installer may first place the female cylinder 32*p*, the flat washer 32*w* and the conical washer 32*u* on the control rod 34 and then insert the control rod 34 and the conical washer 32*w* into the conical bore 32*t* of the male cylinder 32*m*. In either case, the two-prong fork 32*b* is pressed transversely down onto the pivot rod 26, thereby engaging the pivot rod in a friction fit between the prongs 32*d* and 32*e*.

Connector device 32 preferably includes both the two-prong fork connector 32*b* and the compression fitting connector 32*c*. However, the inventors believe that each is a separate advancement over the prior art. Many of the prior art pop-up drain assemblies used a connector that had a vertical flat plate with a plurality of holes oriented generally horizontally. The outer end of the pivot rod was passed through one of these holes and secured with a generally U-shaped clip. The upper end of the prior art connector was bent into a horizontal U-shape with two parallel legs that were oriented transverse to the longitudinal axis of the connector. A hole was provided in each of the parallel legs. The vertical control rod was passed through each hole, and a set screw was tightened to press the control rod into the sides of the holes for securing the vertical control rod to the prior art connector. Embodiments of the present invention include a connector element that has a two-prong fork that can be pressed transversely over a pivot rod and hold the pivot rod in a friction fit, while the control rod is secured to the connector element using a prior art connection such as the horizontal U-shape with two parallel legs oriented transverse to the longitudinal axis of the connector. Another embodiment of the present invention is a linking element that has a compression fitting of some type for receiving and holding the generally vertical control rod and a prior art connection for holding the pivot rod, such as the vertical flat plate with the plurality of holes oriented generally horizontally, where the outer end of the pivot rod was passed through one of these holes and secured with the generally U-shaped clip.

Other embodiments of the present invention contemplate types of compression fittings other than the compression fitting 32*c*. Various tools and devices have extendable handles or parts that can be extended and subsequently returned to a shorter length, often in a telescoping manner, where concentric tubular parts of different diameter slide one into or out of another for providing variable lengths. The length of these handles or parts has been held in a fixed position temporarily by a variety of compression fittings. For example, an extendable handle on a tool used to wash high windows has an outer tube and an inner tube that slides in and out of the outer tube. A threaded device is fitted to the outer tube that has a plurality of fingers that touch the inner tube. A lock nut is threaded onto the threaded device. The lock nut has a cavity defined by a side wall that engages the plurality of fingers. The lock nut can be threaded tightly onto the threaded device for holding the inner tube in a fixed position with respect to the outer tube, or the lock not can be loosened to allow the inner tube to slide in or out of the outer tube. Another example of a compression fitting is receiving the control rod in a cylinder having a rubber inner lining and a cam lobe that an installer can rotate to press the cam lobe against the rubber inner lining, which in turn presses the rubber inner lining against the control rod for hold the control rod in a fixed position with respect to the connector device 32.

Returning to FIG. 1, a stopper 40 is received in drain flange 16 and drain body 22. Stopper 40 has an upper end 40*a*, and a cap 40*b* is located on the upper end 40*a* while the drain assembly 10 is installed and operational. Four flanges or fins 40*c*, 40*d*, 40*e* and 40*f*, referred to collectively as flanges or fins 40*c*, extend longitudinally and project radially. Fins 40*c* lie in two perpendicular and intersecting planes. Stopper 40 has an elongate, longitudinal shaft 40*g* along its longitudinal axis, and the flanges or fins 40*c*, 40*d*, 40*e* and 40*f* extend longitudinally along the shaft 40*g* and project radially outwardly from the longitudinal axis of the stopper 40. The flanges or fins 40*c*-40*f* center the stopper 40 within the drain flange 16 such that the stopper 40 fits somewhat snugly within the drain flange 16 while also being easily movable up and down. A suitable number of fins can be used, including 2, 3, 4, 5, 6, 7, 8, 9, or 10 fins. The cap may be a separate piece that is received on the shaft, or the cap may be formed integral with the shaft. In one embodiment, the cap 40*b* and shaft 40*g* are formed of an integral piece of plastic, and the cap is coated with a metal such as chrome, nickel or brass. The stopper may also be made of a combination of metal and plastic. In another embodiment, the upper end 40*a* has an upwardly and outwardly extending stud with male threads, and the cap 40*b* has female threads for threaded engagement with the stopper body.

Stopper 40 has a two-prong or a dual-prong fork 40*h* on its lower end. Dual-prong fork 40*h* comprises two generally parallel, downwardly-extending prongs 40*i* and 40*j* of which only prong 40*i* is visible in FIG. 1. The body of stopper 40, which includes the fins 40 and the prongs 40*i* and 40*j*, is preferably made of a polymeric material that is somewhat rigid, but flexible and resilient. Prongs 40*i* and 40*j* have inside faces, and a liner 40*k* is fixed to the inside faces, possibly by an adhesive bond. The liner 40*k* on each of the prongs 40*i* and 40*j* has an inside surface, and these inside surfaces define a gap 40*m*, which cannot be seen in FIG. 1. The liner 40*k* is preferably made of a polymeric material that is less rigid, more flexible and more resilient than the material used to make the body of the stopper 40. The stopper end 26*a* of the pivot rod 26 is received in the gap 40*m* and held there by a friction fit, which is a combination of a spring force applied by the prongs 40*i* and 40*j* of the dual prong fork 40*h* and by friction between the liner 40*k* and the stopper end 26*a* of the pivot rod 26. The pivot rod 26 tends to sink into the liner 40*k* to some extent, which provides more surface area that is in contact between the liner 40*k* and the stopper end 26*a* of the pivot rod 26, thereby providing more friction than a more rigid material would provide.

A stop plate 40*n* extends downwardly from the shaft 40*g* and upper body of the stopper 40, which is illustrated in this embodiment as being along the longitudinal axis of the stopper 40. Stop plate 40*n* restricts how far the stopper end 26*a* of the pivot rod 26 can protrude inside of the drain body 22. A support plate 40*p* extends downwardly from the shaft 40*g* and upper body of the stopper 40 and connects to and extends between an edge of the stop plate 40*n* and an edge of prong 40*j*. Support plate 40*p* provides structural support for stop plate 40*n*. Stop plate 40*n* and support plate 40*p* tend to divert water and debris, such as hair, that flows downwardly inside drain flange 16 and drain body 22 away from the stopper end 26*a* of the pivot rod 26, thereby reducing the tendency of hair and other debris to accumulate on the stopper end 26*a* of the pivot rod 26, which tends to clog drain body 22.

Figures 5, 6, 7, 8:
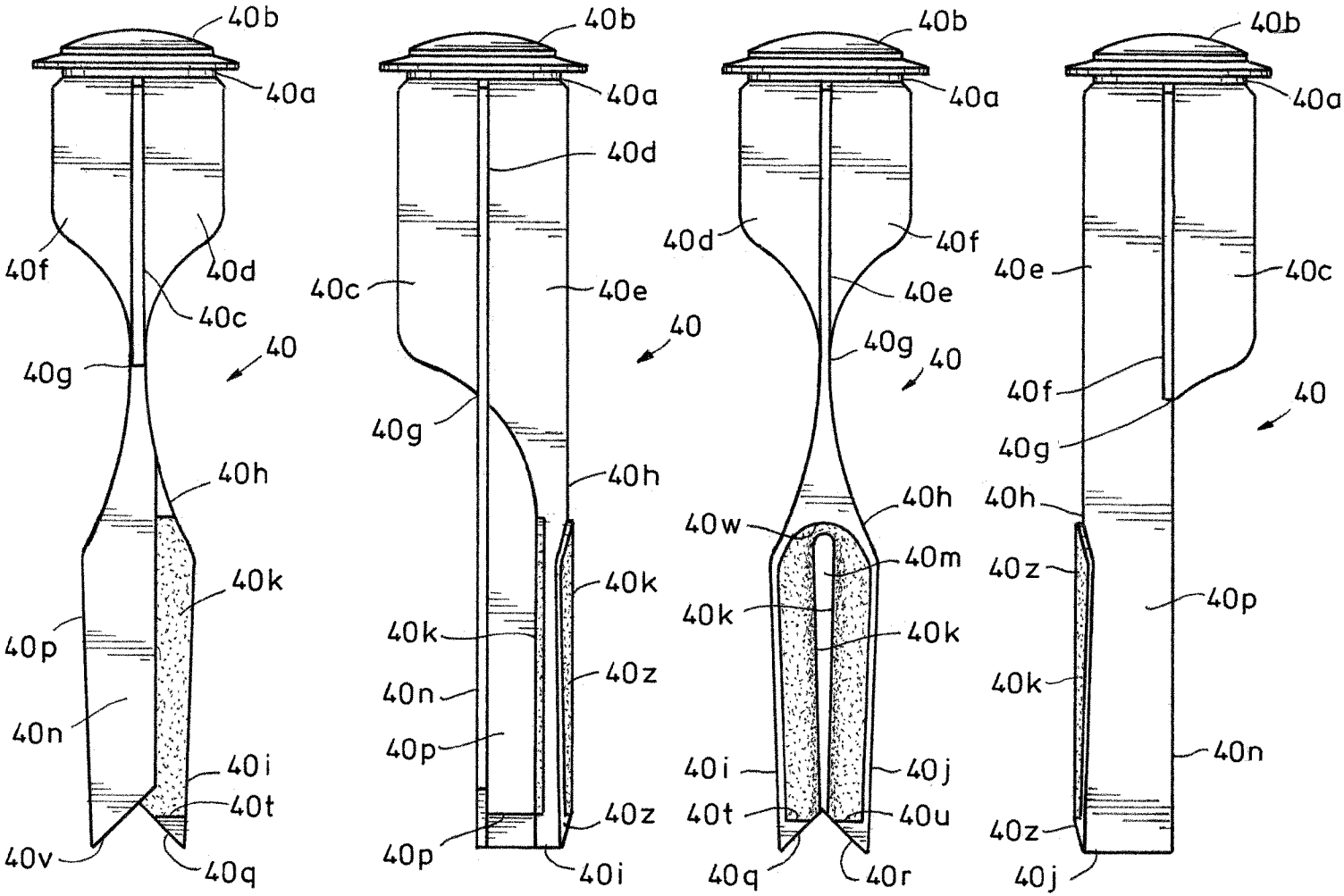
FIG. 5 is a side elevation of the drain stopper shown in FIG. 1 and in the same orientation as shown in FIG. 1, according to the present invention.
FIG. 6 is a side elevation of the drain stopper of FIG. 5 rotated 90 degrees clockwise as viewed from above.
FIG. 7 is a side elevation of the drain stopper of FIG. 6 rotated 90 degrees clockwise as viewed from above.
FIG. 8 is a side elevation of the drain stopper of FIG. 7 rotated 90 degrees clockwise as viewed from above.

FIGS. 5-12 provide various side elevation views and cross-sections of the drain stopper 40 while removed from the pop-up drain assembly 10. FIG. 5 shows drain stopper 40 in the same orientation as shown in FIG. 1. FIG. 6 shows drain stopper 40 as it would present to the pivot rod 26, which is a 90 degree rotation clockwise from FIG. 5 to FIG. 6 as viewed from above. Prongs 40*i* and 40*j* have lower ends 40*q* and 40*r*, respectively, which are angled inwardly, thereby making it easier to press the dual-prong fork 40*h* onto the stopper end 26*a* of the pivot rod 26 so that the stopper end 26*a* is received in the gap 40*m*. The prongs 40*i* and 40*j* have insets 40*t* and 40*u*, respectively, which provide a support base for receiving the liner 40*k*. The liner 40*k* in this embodiment is a single piece of material that has an inverted U-shape as viewed in FIG. 6. FIG. 7 shows drain stopper 40 rotated 90 degrees clockwise from the view in FIG. 6, as seen from above, which is a 180 degree rotation from the orientation in FIG. 5. Support plate 40*p* is shown more visibly in FIG. 7. FIG. 8 shows drain stopper 40 rotated 90 degrees clockwise from the view in FIG. 7, as seen from above, which is a rotation of 90 degrees counterclockwise from the view in FIG. 5. Stop plate 40*n* is shown more visibly in FIG. 8. Stop plate 40*n* has an angled lower end 40*v*, which has the same slope as the lower end 40*r* of prong 40*j*. The inwardly sloping ends 40*q*, 40*r* and 40*v* tend to feed the stopper end 26*a* of the pivot rod 26 into the gap 40*m* between the prongs 40*i* and 40*j* of the dual-prong fork 40*h* as an installer or user presses stopper 40 onto the stopper end 26*a* of the pivot rod 26. Drain stopper 40 is shown in FIGS. 5-8 prior to engagement with the pivot rod 26. FIG. 6 shows that the prongs 40*i* and 40*j* are closer together at the lower ends 40*q* and 40*r*, respectively, than at an upper end 40*w*, indicating that the prongs 40*i* and 40*j* are not quite parallel although nearly parallel.

Figure 9:
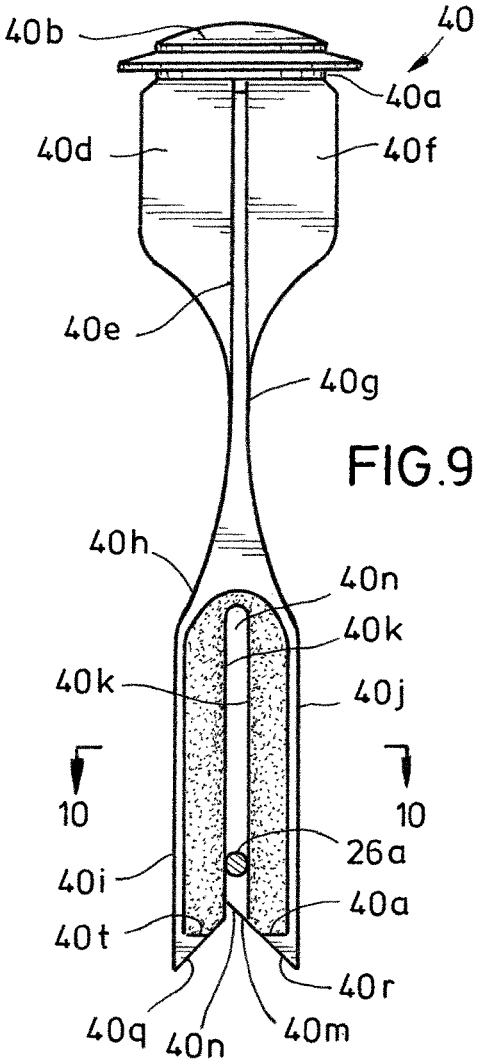
FIG. 9 is a side elevation of the drain stopper of FIG. 1 shown in the same orientation as in FIG. 6 with a pivot rod engaged with the drain stopper, according to the present invention.
Figure 10:
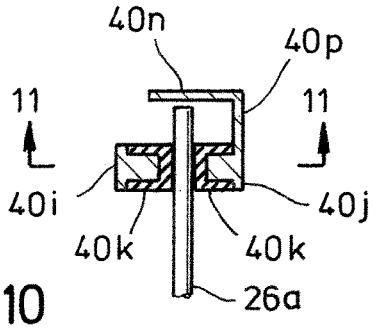
FIG. 10 is a cross-section of the drain stopper of FIG. 9 as seen along the line 10-10.
Figure 11:
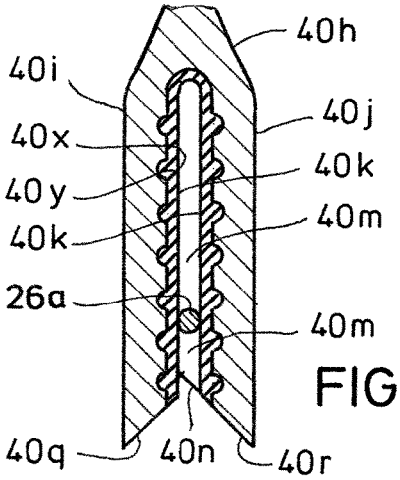
FIG. 11 is a partial cross-section of the drain stopper of FIG. 9 as seen along the line 11-11 in FIG. 10.

FIGS. 9-11 show drain stopper 40 engaged with the stopper end 26*a* of the pivot rod 26. FIG. 9 shows a side elevation of the drain stopper 40 in the same orientation as in FIG. 6, which is as seen looking from the outer end 26*b* of the pivot rod 26 toward the drain stopper 40, as shown in FIG. 1. The prongs 40*i* and 40*j* of the dual-prong fork 40*h* are essentially and substantially parallel while engaged with the stopper end 26*a* of the pivot rod 26 because the pivot rod 26 forces the prongs apart slightly. The prongs 40*i* and 40*j* provide some spring force against the pivot rod 26, and the liner 40*k* provides a somewhat high-friction surface, so that the combination of the spring force and the high-friction surface provides a friction fit, whereby the stopper end 26*a* of the pivot rod 26 is held in a fixed engagement with the dual-prong fork 40*h* of the drain stopper 40.

FIG. 10 is a cross-section of the dual-prong fork 40*h* of drain stopper 40 as seen along the line 10-10 in FIG. 9. The prongs 40*i* and 40*j* have a T-shape, where the leg portion of the T points inwardly toward the stopper end 26*a* of the pivot rod 26, and the cap portion of the T provides an outermost, external surface. The cross-section of the liner 40*k* has a U-shape that wraps around the leg portion of the T-shape of the prongs 40*i* and 40*j*. The support plate 40*p* can be made integral with the cap portion of the prong 40*j* and extend in the same plane as the cap portion toward the center of a drain pipe and away from the outer end 26*b* of the pivot rod 26. The stop plate 40*n* can be made integral with the support plate 40*p* along an edge of each to form an L-shape. The stop plate 40*n* provides a stop to limit how far the stopper end 26*a* of the pivot rod 26 can protrude into the flow path of water draining from the sink 12 in FIG. 1.

FIG. 11 is a cross-section of the dual-prong fork 40*h* of FIG. 9 as seen along the line 11-11 in FIG. 10. The prongs 40*i* and 40*j* have a plurality of indentations 40*x*, and liner 40*k* has a matching and mating plurality of protuberances 40*y*, which tend to improve the bond between the liner 40*k* and the prongs 40*i* and 40*j* for maintaining the position of the liner in the prongs while the dual-prong fork 40*h* is forced transversely over the stopper end 26*a* of the pivot rod 26.

Figure 12:
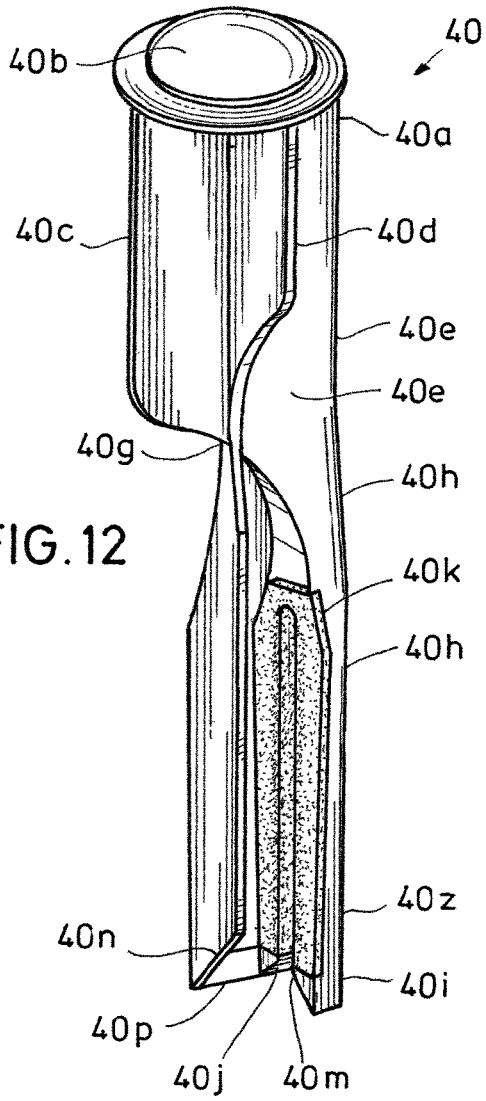
FIG. 12 is a perspective view of the drain stopper in FIG. 5.

FIG. 12 shows a perspective view of the drain stopper 40, which is in an orientation similar to that in FIG. 5. The flanges or fins 40*c*, 40*d* and 40*e* are visible and extend longitudinally along the central, longitudinal shaft 40*g* through which the longitudinal axis of the stopper 40 runs. The flanges or fins 40*c*-40*f* extend radially and define an outermost circumference of the drain stopper 40. This outermost circumference defines a circular cylindrical space that the drain stopper 40 occupies. The flange or fin 40*e* expands and projects downwardly and splits into the dual prong fork 40*h* and its two prongs 40*i* and 40*j*. The dual-prong fork 40*h* is offset radially from the longitudinal axis of the drain stopper 40. The dual prong fork 40*h* and its two prongs 40*i* and 40*j* have a radially outermost surface 40*z*, which lies approximately, but substantially, on the outermost circumference of the drain stopper. The outermost surface 40*z* of the dual-prong fork 40*h* lies preferably within a tolerance of about 2 millimeters of the outermost circumference drain stopper 40 as defined by the guide fins 40*c*-40*f*. The outermost surface 40*z* of the dual-prong fork 40*h* lies proximate to, indeed immediately adjacent to, the pivot rod port 22*b*, preferably within 2 or 3 mm. The outermost surface 40*z* comprises the radially outermost surfaces of the prongs 40*i* and 40*j* and/or the radially outermost surfaces of the liner 40*k*. There may be some irregularities in the outermost surface 40*z*, but it is a longitudinal surface that has a substantial length so that the dual-prong fork 40*h* can accommodate different vertical distances between the pivot rod port 22*b* and the lower surface 12*a* of the sink 12. Said another way, the fins 40*c*-40*f* have a radius from the longitudinal axis to an outer edge. The radial distance from the longitudinal axis to the outermost surface 40*z* of the dual-prong fork is substantially the same as the radius of the guide and centering fins 40*c*-40*f*. While most prior art drain stoppers have an engagement point with a pivot rod along or very close to the longitudinal axis of the drain stopper, the engagement point of drain stopper 40 with pivot rod 26 is adjacent to, immediately adjacent to or in close proximity with the inside wall of the drain body 22 at the pivot rod port 22*b*. However, a drain stopper with a centrally-located dual-prong fork connector for easy engagement with a pivot rod would be useful with a pop-up drain assembly, particularly one such as pop-up drain assembly 10 in FIG. 1 in conjunction with the connector device 32.

Other aspects of drain stopper 40 include that the stop plate 40*n* is aligned and in the same plane as the guide fins 40*d* and 40*f*, which places the stop plate 40*n* on a centerline of the drain stopper 40. The longitudinal axis of the drain stopper 40 runs longitudinally through this centerline. The support plate 40*p* is neither on a centerline nor necessarily on an outside surface of the drain stopper 40, as its location depends on the width of the dual-prong fork 40*h*. In this embodiment, the stop plate 40*n* is spaced substantially away from the dual-prong fork 40*h*, but it could be located immediately adjacent to the dual-prong fork 40*h*. Also, the stop plate 40*n* could be eliminated, and the drain stopper 40 would function satisfactorily. The support plate 40*p* is also an optional feature.

Other types of drain stoppers can be used, including a drain stopper in which the pivot rod protrudes into a hole or loop in the stopper for a non-removable connection after assembly, a magnetic connection between the pivot rod and the drain stopper and a two-prong fork on the stopper for engaging the pivot rod as described above with reference to FIGS. 5-12, except with the two-prong fork centered about the longitudinal axis of the drain stopper. The present inventors' related U.S. Patent Application Pub. No. 20170260724 A1 describes a number of different stoppers, and the description of the stoppers in that application is incorporated by reference into this document. In addition, the present inventors' priority document identified as U.S. Provisional Patent Application Ser. No. 62/474,058, which was filed on Mar. 20, 2017, describes a drain stopper with a two-prong fork centered about the longitudinal axis of the drain stopper, a strainer basket received on the drain stopper and larger-than-normal cap on the stopper for covering a drain flange. The drain stopper with a two-prong fork centered about the longitudinal axis, the strainer basket and the larger-than-normal cap are described in the present inventors' related U.S. Patent Application Pub. No. 20170260724 A1.

The strainer basket is for removing hair and other debris from a drain fluid stream. The strainer has a generally cylindrical shape, an open upper end, a plurality of longitudinal slots and a partially closed lower end or base. The strainer has a plurality of openings such as holes and slots through which water can pass and a plurality of obstructions on which hair and other debris tends to be caught and retained. The upper end of the strainer flares outwardly and has an outermost circumference proximate to an uppermost edge, which is sized to fit snugly in a drain pipe from a sink. The longitudinal slots extend nearly the entire length of the strainer. A fin of a drain stopper is received in a longitudinal slot, and there is a slot for each fin. A section of wall between two longitudinal slots has a V-shaped notch, which provides a wide opening along the upper edge, which narrows to a point at a lower end of the notch. The notches and the longitudinal slots allow the strainer basket to flare outwardly against an inside wall of a drain pipe and to be compressed inwardly to accommodate an inside diameter of a drain pipe that is smaller than the diameter of the strainer.

The drain stopper having a two-prong fork centered about the longitudinal axis of the stopper is described as follows. The two-prong fork is a pivot rod retainer, which can be pressed transversely over a pivot rod for fastening the stopper to a pivot rod with a friction fit. As an option, a strainer can be received on the stopper body. Water and debris, such as hair, from a sink flows inside the strainer and out through holes and slots in the strainer, except hair and other debris tends to be caught and retained inside the strainer. The base of the strainer has a transverse, rectangular slot, which fits tightly around a transition portion of the stopper body where it transitions into the two-prong fork. The transition portion also has a rectangular shape.

Regarding the larger-than-normal cap, a resilient flange below the uppermost portion of the cap and body of the stopper provides a sealing surface for retaining water in a sink. The oversized flange covers and hides a drain flange attached to a sink opening, thereby hiding an unsightly or ugly flange or a flange of a different color for changing a color scheme of a pop-up drain assembly. The stopper has a central body portion, which has longitudinal fins. The fins define a circumference, which has a diameter D1. The cap has a diameter D2. The cap is sized to cover a drain flange in a sink. D2 may be twice D1 or 2.5 times D1 or many other ratios that may be desirable.

The drain stopper having the two-prong fork centered about the longitudinal axis of the stopper can be further described as follows. The stopper comprises: a shaft having a length, a longitudinal axis through the length of the shaft, an upper end and an opposing lower end; a cap received on the upper end for providing a seal to retain fluid in the sink or basin; at least two radial flanges, wherein the radial flanges extend along the length of the shaft, wherein the radial flanges either intersect to define the shaft or are attached to the shaft or are formed integral with the shaft, and wherein the radial flanges project radially with respect to the longitudinal axis of the shaft for centering the drain stopper in a drain pipe; a pivot rod holder that depends downwardly from the lower end of the shaft or that depends downwardly from the radial flanges, wherein the pivot rod holder comprises a pair of opposing prongs, wherein each of the prongs has an inside edge, and wherein a gap is defined between the inside edges of the opposing prongs; and a flexible material bonded to or formed integral with at least one of the inside edges, where the pivot rod is received in the gap and held between the prongs in a friction fit.

Various different combinations and inclusions of drain piping, a drain stopper, a pivot rod, a control rod and a connector device linking the control rod to the pivot rod can be sold in a kit. This may be referred to as a retrofit kit. One aspect of the present invention is that an existing, prior art pop-up drain assembly can be retrofitted with a connector device made according to the present invention. There is no need to replace the pivot rod 26 or the control rod 34 shown in FIG. 1 because connector device 32 works with and connects to the existing pivot rod and control rod.

Connector device 32 described in reference to and shown in FIGS. 1-4 is just one of many possible configurations and embodiments of a connector device according to the present invention. The connector device was described generally as having a two-prong fork for connecting to and engaging with the pivot rod in a friction fit and a compression fitting for connecting to and engaging with the control rod in a compression fit. A resilient material is preferably used in both the two-prong fork 32*b* and the compression fitting 32*c*.

The phrase "resilient material" implies that the material can be deformed to some extent in any direction by a force and will return to its original shape after the force is removed. A spring is not necessarily resilient. The U-shaped clip used to hold the extension rod to the pivot rod in the prior art connector has characteristics of a spring in that it can be squeezed together into a narrow U-shape and will return to its wide U-shape after the force is removed. The word resilient implies an amorphous shape that can be compressed by forces in any and several directions, which will return to its original shape after the compressive forces are removed. Some resilient materials can be pulled, twisted and compressed to a great extent and will return to an original shape, and a rubber band would be an example. A rubber tire used on a car is resilient in that it can deform under and can withstand a compressive force and can be pulled and twisted to some extent, but it is not nearly as pliable as a rubber band. A spring on the other hand implies a material that has been made to more typically withstand repetitive forces back and forth along a single axis, such as a coil spring that stretches out under force and pulls back as the force is lessened. A spring is not typically subjected to compressive forces from many different directions and may not fully recover its original shape after compressive forces are removed. A resilient material, however, may be subjected to compressive forces from many different directions and will recover its original shape after the compressive forces are removed, provided the forces do not exceed a certain limit. The U-shaped clip is a spring, but it is not a resilient material. One generally thinks of a resilient material as being made of a rubbery polymeric material, but it may be possible for a metallic composition to exhibit resilient characteristics.

Figures 13, 13A, 13B, 13C, 13D:
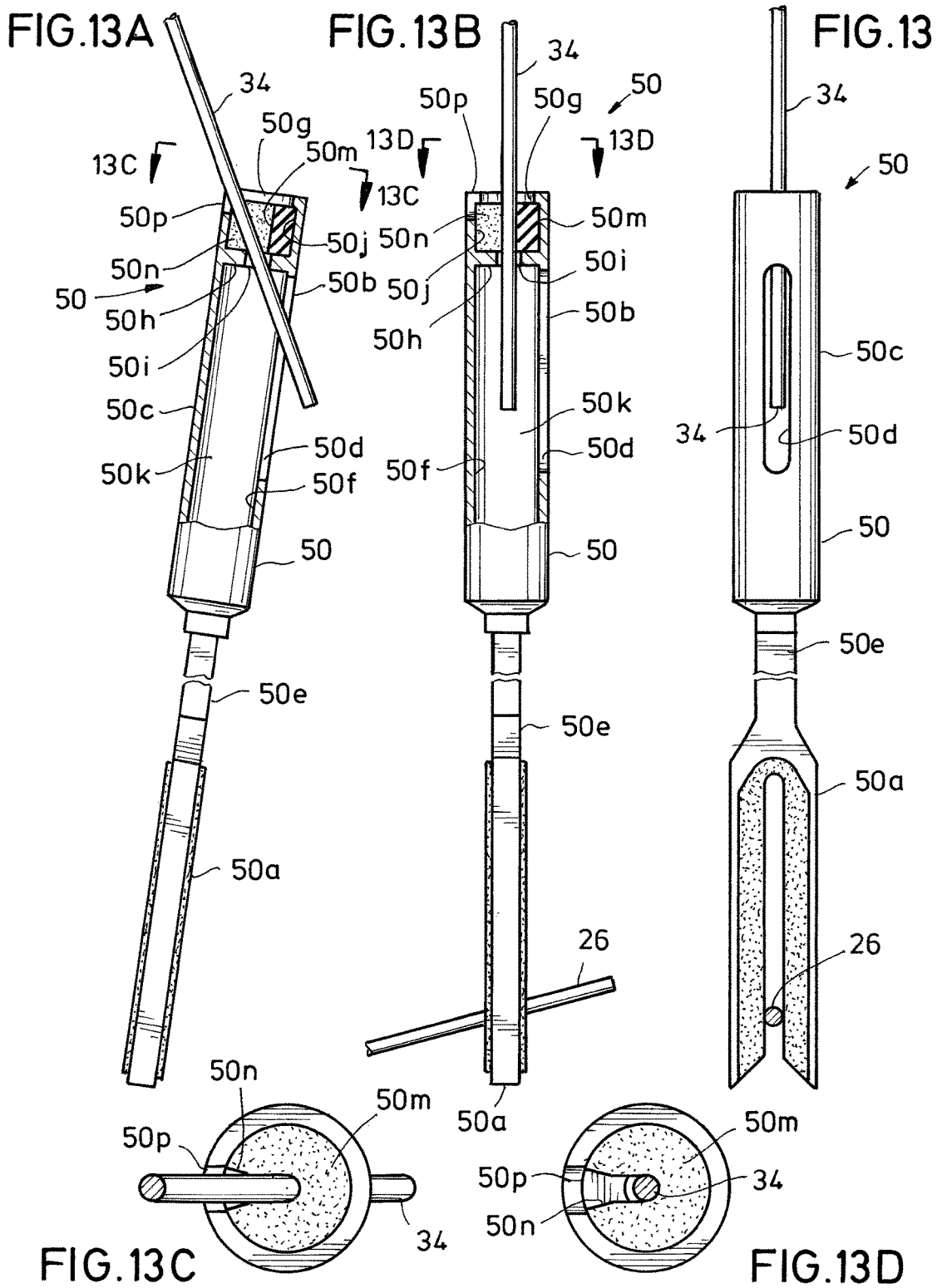
FIG. 13 is a side elevation of a connector device for connecting a control rod with a pivot rod, according to the present invention.
FIG. 13A is a side elevation in partial cross-section of the connector device of FIG. 13, which shows the control rod in the process of being engaged with the connector device, according to the present invention.
FIG. 13B is a side elevation in partial cross-section of the connector device of FIG. 13, which shows the control rod fully engaged with the connector device and a pivot rod engaged with the connector device, according to the present invention.
FIG. 13C is a cross-section of the connector device shown in FIG. 13A as seen along the line 13C-13C in FIG. 13A.
FIG. 13D is a cross-section of the connector device shown in FIG. 13B as seen along the line 13D-13D in FIG. 13B.

Turning now to examples of various embodiments for connector devices according to the present invention, FIG. 13 shows a connector device 50 for connecting control rod 34 in FIG. 1 to the pivot rod 26. Connector device 50 has a pivot-rod connector 50*a* for engaging the pivot rod 26. The pivot-rod connector 50*a* is illustrated as a two-prong fork similar to the two-prong fork 32*b* described with reference to FIG. 2, and it is similar to the two-prong forks described with reference to the drain stoppers in FIGS. 5-12, so it is not necessary to describe the two-prong fork used as the pivot-rod connector 50*a* in detail because the earlier descriptions apply to this two-prong fork. Connector device 50 has an upper portion 50*b*, which comprises a control-rod connector 50*c* that includes a longitudinal slot 50*d*. Connector device 50 has a central body portion 50*e* that connects the control-rod connector 50*c* to the pivot-rod connector 50*a*. The control-rod connector 50*c*, the central body portion 50*e* and the pivot-rod connector 50*a* share a common longitudinal axis. FIG. 13A shows connector device 50 in partial cross-section and rotated counterclockwise 90 degrees. Control-rod connector 50*c* has a hollow tubular body that defines in inside cylindrical surface 50*f* and has an open upper end 50*g*. A washer-shaped wall 50*h* is fixed to the inside cylindrical surface 50*f* transverse to the longitudinal axis, has a central opening 50*i*, defines with the inside cylindrical surface 50*f* an upper cavity 50*j* between the washer-shaped wall 50*h* and the open upper end 50*g*, and a lower cavity 50*k* between the washer-shaped wall 50*h* and the central body portion 50*e*. The elongated longitudinal slot 50*d* provides an opening in the tubular wall between the lower cavity 50*k* and outside the tubular body. A C-shaped resilient disk 50*m* is fixed inside the upper cavity 50*j*. The C-shaped resilient disk 50*m* is cylindrical with a longitudinal slot 50*n* from an outside surface through an outer portion and into a central opening that has a cylindrical wall sized to matingly engage the control rod 34. Disk 50*m* may be fixed into place in the tubular body by an adhesive, by a tight friction fit or by a ridge-and-groove engagement or a combination of these.

As shown in FIG. 13A, the control rod 34 is inserted through the open upper end 50*g*, through the slot 50*n* in the outer portion of the C-shaped resilient disk 50*m* into the lower cavity 50*k* and out through the longitudinal slot 50*d*. After the insertion shown in FIG. 13A, the longitudinal axis of the control rod 34 is at an angle with respect to the longitudinal axis of the connector device 50. The angle may be 30 to 60 degrees and is preferably about 45 degrees. The connector device 50 is rotated with respect to the control rod 34 until the control rod snaps into position in the central opening of the resilient disk 50*m*, which has the cylindrical wall sized to matingly engage the control rod 34. Shoulders can be provided in the disk 50*m* at the transition in the slot 50*n* between the outer portion and the central opening that provide an opening smaller than the diameter of the control rod 34 for providing a snap fit, although this is not necessary. The diameter of the central opening should be approximately the same or preferably slightly less than the diameter of the control rod for a snug friction fit. The resilient disk 50*m* should hold the control rod 34 in a tight enough friction fit to accommodate anticipated forces without sliding on the control rod. The fit between the resilient disk 50*m* and the control rod 34 should be designed as a fixed connection with respect to anticipated longitudinal forces, but which can be disassembled with a transverse force.

FIG. 13B shows the control rod 34 connected to the connector device 50 after the connector device 50 is rotated to press the control rod 34 into the central opening of the C-shaped resilient disk 50*m*. The pivot rod 26 is pressed into the slot defined between the two prongs of the two-prong fork in the pivot-rod connector 50*a*. FIG. 13C provides a top view of the connector device 50 as seen along the line 13C-13C in FIG. 13A, which is before the connector device 50 is moved into a common longitudinal alignment with the control rod 34. FIG. 13C shows that the tubular body has a notch 50*p* at the open upper end 50*g* for accommodating the control rod 34 as it is inserted at an angle into the connector device 50. FIG. 13D provides a top view of the connector device 50 as seen along the line 13D-13D in FIG. 13B, which is after the connector device 50 is moved into a common longitudinal alignment with the control rod 34, and the pivot rod 26 is not shown. The central body portion 50*e* of the connector device 50 is shown as having a smaller width than the control-rod connector 50*c* and the pivot-rod connector 50*a*. However, the widths or diameters can be different from what is illustrated. In one embodiment, the pivot-rod connector 50*a*, the control-rod connector 50*c* and the central body portion 50*e* all have the same width.

Connector device 50 holds both the control rod 34 and the pivot rod 26 in a compressive-friction fit using a resilient material. The C-shaped disk 50*m* is made of a resilient material that compresses as a relatively larger-diameter control rod 34 is pressed into engagement with the disk 50*m* as the control rod is pressed into the relatively smaller diameter central opening, which is sized to matingly engage the control rod 34 in a compressive-friction fit. The two-prong fork 32*b* in FIG. 2 has a resilient inner liner 32*k*. Pivot-rod connector 50*a* has two parallel prongs or tines that are either made of a resilient material or are springy and lined with a resilient material or both. The distance between the prongs or tines is less than the diameter of the pivot rod 26. If the prongs are pushed apart from one another, there is a spring force that tries to pull the prongs back to the normal distance. The pivot-rod connector 50*a* has a spring force and resilient material that holds the pivot rod in a compressive-friction fit.

In general, the present invention provides in one aspect a connector device for connecting a generally horizontal rod to a generally vertical rod using a compressive-friction fit with resilient material that is pressed against the rods by compressive forces and thereby holds and engages the rods due to friction between the rods and the resilient material(s). Various embodiments of connector devices are encompassed by this general description. One example is that connector device 50 can be modified such that the central body portion 50*e* is bent into an angle or is flexible or is hinged at a pivot point so that the control-rod connector is at a 60 to 120 degree angle with respect to the pivot-rod connector. This angled connector can be turned upside down and the control-rod connector 50*c* can be fastened to the pivot rod 26, and the pivot-rod connector 50*a* can be fastened to the control rod 34, thereby providing another embodiment of a connector device that relies on a compressive-friction fit between a resilient material and a rod. Rods in a pop-up drain assembly generally have a circular cross-section, but the embodiments of the present invention can be used with or made for noncircular cross-sections including rectangular cross-sections.

FIGS. 14 and 14A-14D are similar to FIGS. 13 and 13A-13D. A side elevation of a connector device 52 is shown in FIG. 14, according to the present invention. It includes a control-rod connector 52*a* that is the same as the control-rod connector 50*c* described above. However, a pivot-rod connector 52*b* comprises an elongate, rectangular bar that has a plurality of holes located along the longitudinal axis of the connector device. Each of the holes is lined with a grommet 52*c*, which is preferably a rubbery polymeric material. The inside diameter of each grommet is sized to matingly receive the pivot rod 26 in a friction fit. The connector device can be used with an existing, prior art pop-up drain assembly. The plurality of holes in the pivot-rod connector 52*b* provides accommodation for various distances between the pivot rod 26 and the control rod 34. The control-rod connector 52*a* can be first connected to the control rod as described above. After selecting an appropriate grommet hole 52*c* for distance, the pivot-rod connector 52*b* is pushed over the outside end of the pivot rod 26 and slid along the pivot rod to provide an appropriate alignment for operation of the control rod 34 up and down for closing and opening a pop-up drain stopper engaged with the inside end of the pivot rod 26. The order of assembly can be reversed if more convenient.

FIGS. 15, 15A, 15B, 16, 16A and 16B. The pivot-rod connector 50*a* described with reference to FIGS. 13, 13A and 13B can be used as both a pivot-rod connector and as a control-rod connector. One embodiment of a connector device 54 in FIG. 15 comprises a central body 54*a*, a control-rod connector 54*b* fixed to the body 54*a* and a pivot-rod connector 54*c* fixed to the body 54*a*, where each of the control-rod connector 54*b* and the pivot-rod connector 54*c* is a two-prong fork, where each of the control-rod connector and the pivot-rod connector has a longitudinal axis, where the longitudinal axis of the control-rod connector is at an angle, preferably a 60 to 120-degree angle and more preferably about a 90-dgree angle, with respect to the longitudinal axis of the pivot-rod connector. The engagement of the control and pivot rods in the two-prong forks is a compressive-friction engagement in that the forks have a spring force that squeezes the rod and, preferably, a rubbery material lining the inside faces of the forks and in contact with the rod for increasing friction. Another embodiment of a connector device 56 in FIG. 16 comprises a central body 56*a*, a control-rod connector 56*b* fixed to the body 56*a* and a pivot-rod connector 56*c* fixed to the body 56*a*, where each of the control-rod connector 56*b* and the pivot-rod connector 56*c* is a two-prong fork The longitudinal axis of each of the control-rod connector and the pivot-rod connector can lie in the same plane or in a different plane, depending on the configuration of the central body. If the control-rod connector and the pivot-rod connector are formed in an L-shape as shown in FIG. 15, then the longitudinal axis of each of the control-rod connector and the pivot-rod connector preferably lie in the same plane. If the control-rod connector and the pivot-rod connector are formed in a T-shape as shown in FIG. 16, then the longitudinal axis of each of the control-rod connector and the pivot-rod connector preferably lie in different planes.

Figures 17, 17A, 18, 18A, 18B:
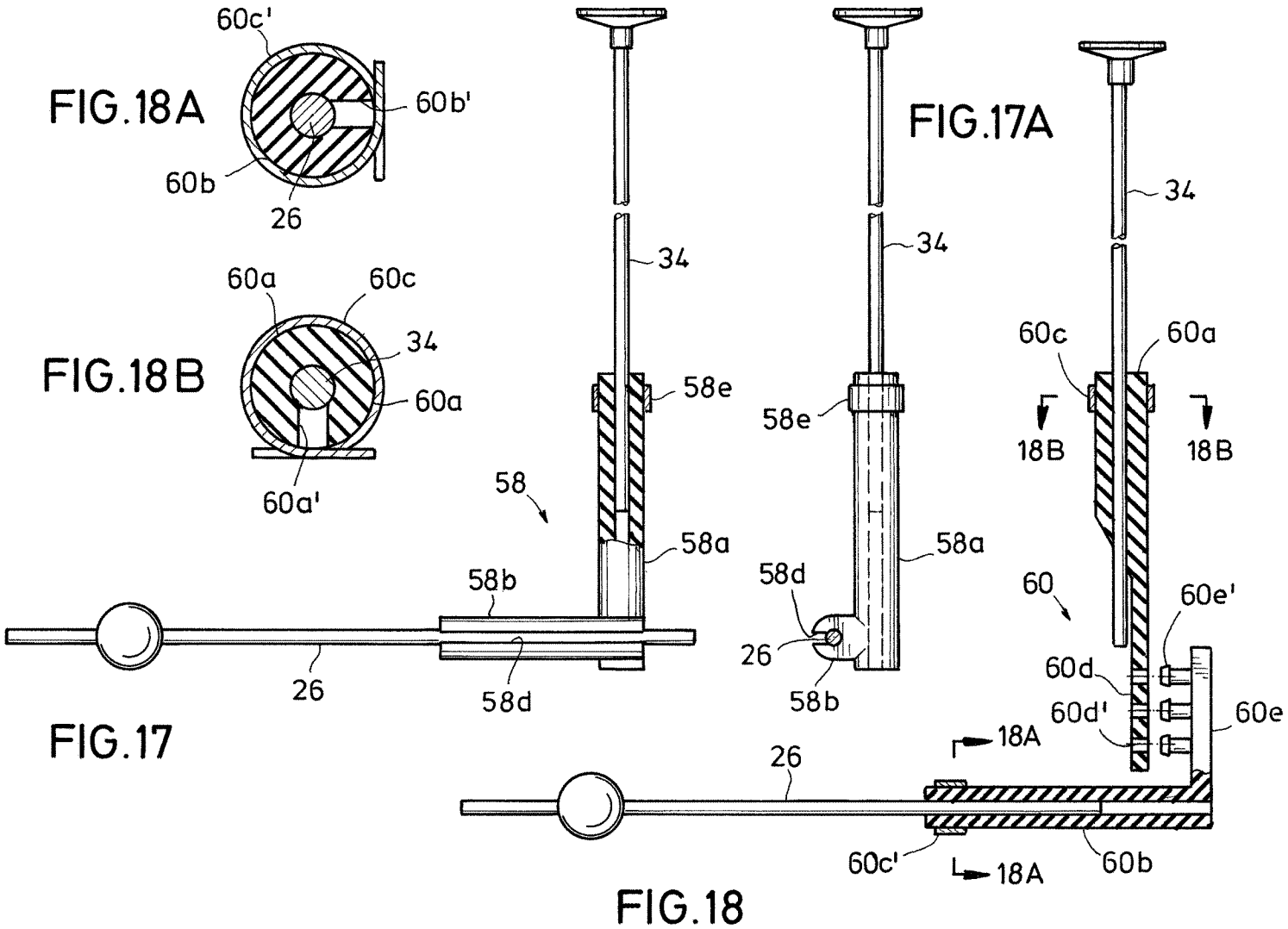
FIG. 17 is a side elevation in partial cross-section of a connector device for connecting a control rod with a pivot rod, according to the present invention.
FIG. 17A is a side elevation of the connector device of FIG. 17 rotated 90 degrees clockwise as viewed from above.
FIG. 18 is a side elevation in partial cross-section of a connector device for connecting a control rod with a pivot rod, according to the present invention.
FIG. 18A is a cross-section of the connector device of FIG. 18 as seen along the line 18A-18A in FIG. 18.
FIG. 18B is a cross-section of the connector device of FIG. 18 as seen along the line 18B-18B in FIG. 18.

FIGS. 17 and 17A. A connector device 58 can comprise two elongate tubes 58*a* and 58*b* of a stiff and resilient material, where the tubes are attached to each other or formed integral to form an L-shape having an angle between 60 and 120 degrees, preferably about 90 degrees, where each of the tubes has a longitudinal slit or slot 58*c* and 58*d*, respectively, along its length, preferably its full length, where the slits or slots 58*c* and 58*d* preferably face away from each other, where tube 58*a* is a control-rod connector and has an inside diameter sized to matingly receive the control rod 34 in a compressive, friction fit, where the other tube 58*b* is a pivot-rod connector and has an inside diameter sized to matingly receive pivot rod 26 in a compressive, friction fit, and where, preferably one or both of the tubes 58*a* and 58*b* is fitted with a clamp 58*e* about its outer diameter for squeezing its tube against its rod for increasing compression and friction and thereby holding its rod more firmly in a compressive-friction engagement. Alternatively, one or both of the slits or slots 58*c* and 58*d* can be omitted, and the control rod and/or the pivot rod can be inserted into the bore of the tube from an external end of the tube. A clamp can be used to squeeze the tube tighter against the rod, but the clamp is not required. Examples of clamps include a hose clamp and an O-ring. The stiff and resilient material is softer than the rubber in an automobile tire and may be similar to a material used in a hose in an automobile engine that connects a radiator to an engine block in a water-based cooling system.

FIG. 18. A connector device 60 can comprise two elongate tubes 60*a* and 60*b* of a stiff and resilient material, where the tubes are made as separate pieces that can be attached to each other to form an L-shape having an angle between 60 and 120 degrees, preferably about 90 degrees, where each of the tubes 60*a* and 60*b* has a longitudinal slit or slot 60*a*' and 60*b*', respectively, along its length, preferably its full length, where tube 60*a* is a control-rod connector and has an inside diameter sized to matingly receive control rod 34 in a friction fit, where the other tube 60*b* is a pivot-rod connector and has an inside diameter sized to matingly receive pivot rod 26 in a compressive, friction fit, and where, preferably one or both of the tubes 60*a* and 60*b* is fitted with a clamp 60*c* or 60*c*' about its outer diameter for squeezing its tube against its rod for increasing compression and friction and thereby holding its rod more firmly in a compressive-friction fit. One of the control rod connector or the pivot rod connector has an extension parallel to its longitudinal axis, and the other has an extension transverse to its longitudinal axis, which preferably forms an L-shape having an angle between 60 and 120 degrees. FIG. 18 shows tube 60*a* having an extension 60*d* that is parallel to its longitudinal axis. Tube 60*b* has an extension 60*e* that is transverse to the longitudinal axis of tube 60*b*. The extensions 60*d* and 60*e* preferably have a length that is about the same or between 50 and 150 percent of the length of its tube portion and preferably have a cross-section that is approximately rectangular. One extension has one or more holes through its body transverse to its longitudinal axis, and the other extension has one or more shafts projecting perpendicular from its body. FIG. 18 shows extension 60*d* as having holes 60*d*' and extension 60*e* with shafts 60*e*'. The shafts 60*e*' preferably have a head like a nail's head. The holes, shafts and heads are sized for the shafts to be received in the holes in a snap fit. A snap-fit connection is described in U.S. patent application Ser. No. 15/807,742 filed by the present inventors on Nov. 9, 2017, which is titled "Drain Cleaning Apparatus." The pivot rod connector can be connected to the control rod connector by pressing the heads and shafts 60*e*' into and through corresponding holes 60*d*', thereby providing the L-shaped connector device 60, which may or may not have a 90-degree angle.

FIGS. 19, 19A and 19B. In the embodiment of FIG. 19, a connector device 62 comprises a control-rod connector 64 that is an elongate tube made of a stiff and resilient material with a longitudinal slit or slot 64' for receiving control rod 34, which is pressed through the slit or slot 64' and coaxially and matingly received in a friction fit inside an open cylindrical space within the tube 64, where tube 64 has an upper end from which the control rod 34 protrudes after assembly and an opposing lower end. A pivot-rod connector 66 extends from the lower end along the longitudinal axis of the control-rod connector tube 64. The pivot-rod connector 66 comprises an elongate, rectangular bar that has a plurality of holes located along the longitudinal axis of the connector device. Each of the holes is lined with a grommet 66', which is preferably a rubbery polymeric material. The inside diameter of each grommet 66' is sized to matingly receive the pivot rod 26 in a friction fit. The connector device 62 can be used with an existing, prior art pop-up drain assembly. The plurality of holes in the pivot-rod connector 66 provides accommodation for various distances between the pivot rod 26 and the control rod 34. The pivot-rod connector 66 is connected to the pivot rod 26 by pushing the pivot rod through one of the grommets 66' selected for appropriate accommodation of the control rod 34. The control rod 34 may be held adequately by friction fit with the control-rod connector 64 or a clamp can be placed around the tube and tightened to increase friction between the tube and the control rod. The control-rod connector can comprise tube 64 as having an oval-shaped cross-section and a ring 68 having a rectangular shape and a size to slip onto the oval-shaped tube 64 snugly, where the ring 68 can be twisted about 90 degrees about the longitudinal axis of the control-rod connector tube 64 and the control rod 34, thereby closing a gap at the slit or slot and tightening the tube about the control rod. FIG. 19A is a cross-section of the control-rod connector 64 as seen along the line A-A in FIG. 19, which shows ring 68 surrounding tube 64 in a relaxed state with the slot 64' open. FIG. 19B shows the ring 68 rotated 90 degrees, thereby closing the slot 64' and tightening the tube 64 in a compressive, friction fit around the control rod 34.

Figure 21:
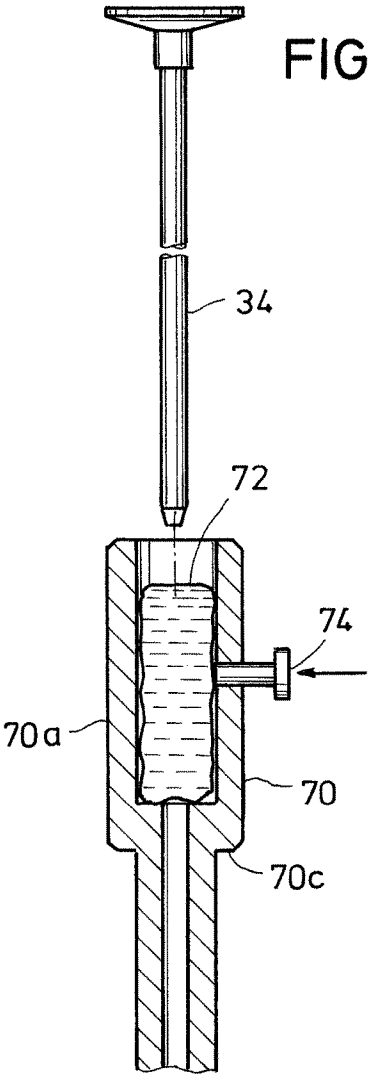
FIG. 21 is a side elevation in partial cross-section of the connector device of FIG. 20 with an added element, according to the present invention.
Figure 20A:
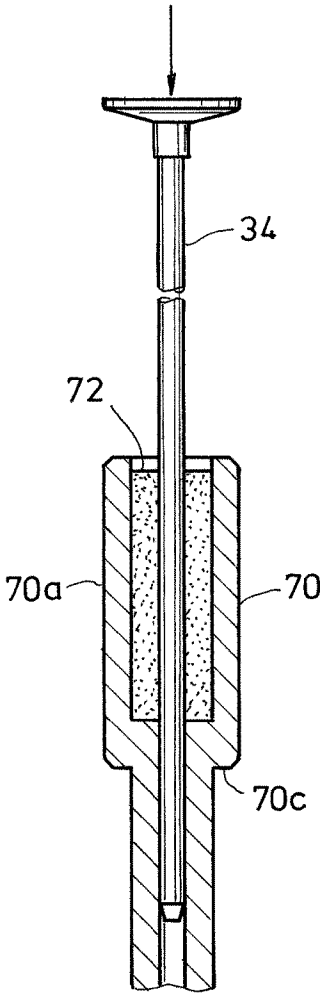
FIG. 20A is a side elevation in partial cross-section of the connector device of FIG. 20 after a connection is made with the control rod.
Figure 20:
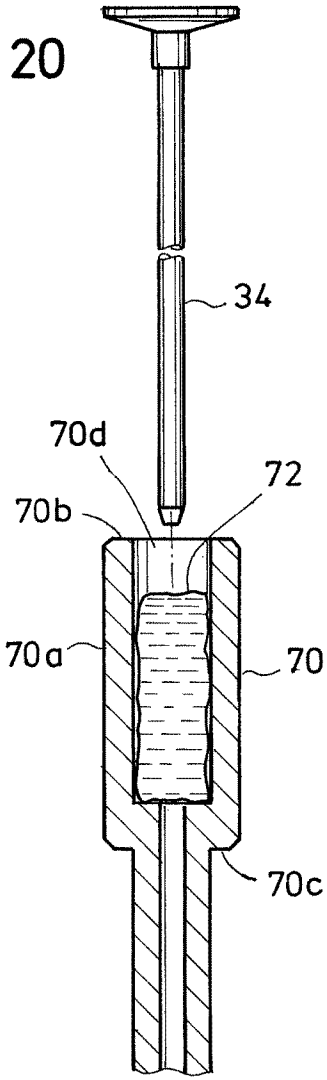
FIG. 20 is a side elevation in partial cross-section of a connector device that can be connected to a control rod, according to the present invention.
Figure 22B:
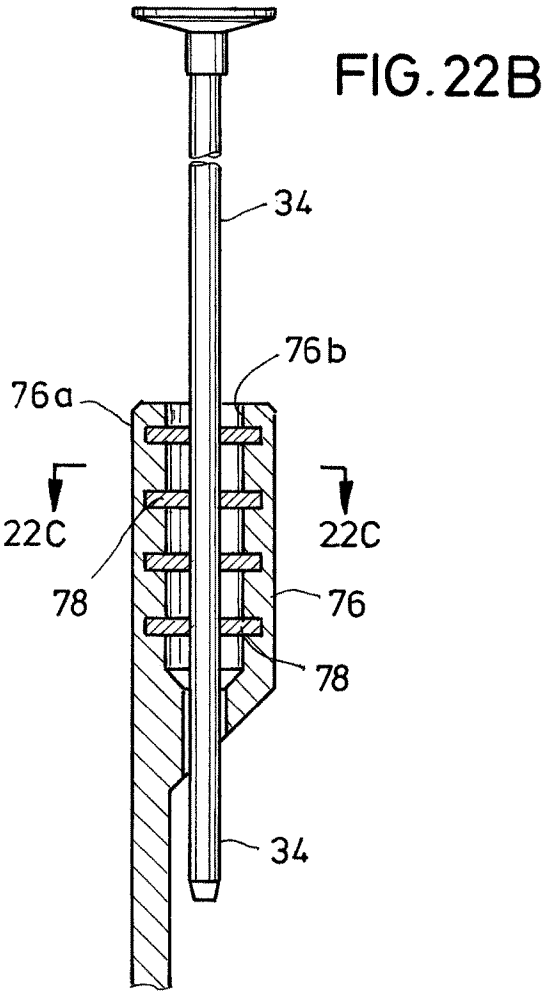
FIG. 22B is a side elevation in partial cross-section of the connector device of FIG. 22 after a connection is made with the control rod.
Figure 22A:
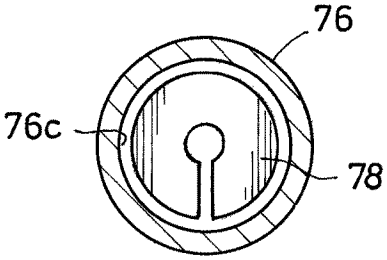
FIG. 22A is a cross-section of the connector device of FIG. 22 as seen along the line 22A-22A in FIG. 22.
Figure 22C:
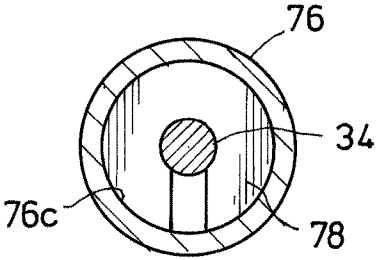
FIG. 22C is a cross-section of the connector device of FIG. 22B as seen along the line 22C-22C in FIG. 22B.
Figure 22:
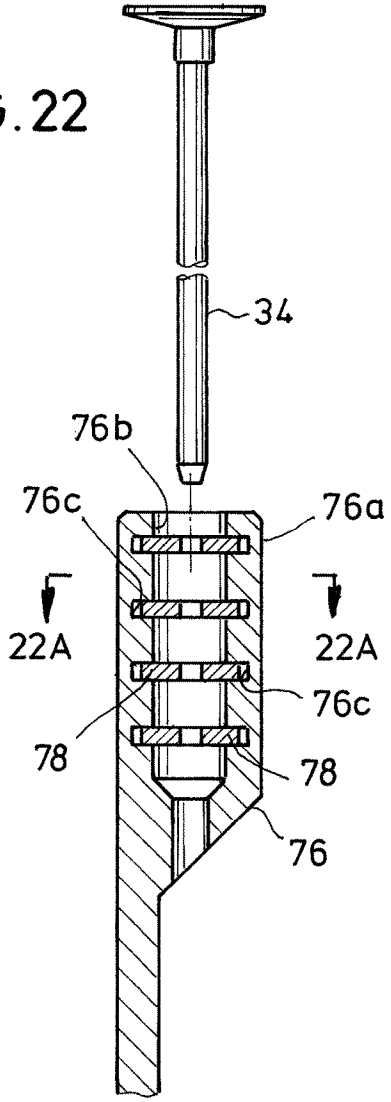
FIG. 22 is a side elevation in partial cross-section of a connector device that can be connected to a control rod, according to the present invention.

FIGS. 20, 20A and 21. In an embodiment shown in FIGS. 20 and 20A, a control-rod connector 70 comprises a tubular element 70*a* having an open upper end 70*b*, a closed lower end 70*c*, and a cavity 70*d* defined by an inside wall surface of the tubular element and the closed lower end. A bag of adhesive 72 is received inside the cavity 70*d*. The control rod 34 is pushed into the cavity 70*d*, as shown in FIG. 20A, thereby puncturing the bag 72 and releasing the adhesive inside the cavity 70*d*. The adhesive flows within the cavity 70*d* and around the control rod 34 and adheres to the inside wall of the tubular element 70*a*, the closed lower end and to the control rod, thereby releaseably fastening the control rod 34 to the control-rod connector 70 in at least a friction fit. The adhesive may be a solvent-based adhesive in which the solvent evaporates after the bag has been punctured. The solvent may be water or an organic solvent. The adhesive may become a soft, tacky and resilient material after it has dried or cured. An example of a possibly suitable adhesive is of the type used to adhere a plastic credit card to a sheet of paper for mailing the credit card to a customer. The adhesive may also be of a type that expands as it cures, which provides a compressive-friction engagement between the control rod 34 and the connector device 70. FIG. 21 illustrates that a pin 74 can be included that protrudes through the wall of the tubular element, where the pin can be used to puncture the bag that contains the adhesive. The pin may be a screw that is threaded through the wall of the tubular element 70*a* and can press against the control rod 34 for providing a compressive force on the control rod so that the adhesive and the screw provide a compressive-friction engagement between the control rod connector 70 and the control rod 34. It is not necessary for the bag of adhesive to be included with the control rod connector because an installer could have a separate source of adhesive, in which case the adhesive can be placed inside the cavity before or after the control rod is placed in the cavity. A connector device can be made by fixing a pivot-rod connector to the lower end of the control rod connector. Any one of the pivot-rod connectors described above can be used, and a two-prong fork is one option. If a two-prong fork is used for the pivot-rod connector, then this embodiment would have an appearance similar to the connector device 50 in FIG. 13, except without the slot 50*d* and without the washer-shaped wall 50*h*. If a pivot-rod connector pivot rod connector is used that has a plurality of grommet-lined holes, then this embodiment would have an appearance similar to the connector device in FIG. 14, except without the slot and without the washer-shaped wall in the control-rod connector.

FIGS. 22 and 22A-22C. A connector device can have a control-rod connector 76 that comprises a tube 76*a* that has a central bore 76*b* throughout its length, where an inside wall defines the bore, where the inside wall has one or more grooves 76*c* about its circumference, where at least one snap ring 78 is received in at least one groove 76*c*, where the snap ring is a flexible, split-ring fastener that has open ends, which are close together, and where preferably more than one snap ring 78 is used. The connector device can have a body offset from the longitudinal axis of the control-rod connector 76, and a pivot-rod connector such as a two-prong fork or a bar with a plurality of grommet-lined holes or any one of the pivot-rod or control-rod connectors described herein can be fixed to the body. The snap rings 78, the tube 76*a*, its bore 76*b* and its inside wall are sized to matingly receive a control rod in a compressive-friction fit.

FIGS. 23 and 23A-23C. A connector device can have a control-rod connector 80 that comprises a tube 80*a* that has a central longitudinal bore 80*b*, threads 80*c* about its outside surface, one or more longitudinal slots 80*d*, preferably four slots, an upper end 80*e* that comprises a closed ring, a lower end 80*f* that does not have slots and a nut 80*g* that has inside threads, which is threaded onto the tube 80*a*. The closed ring at the upper end is sized to receive control rod 34 without significant friction. The central bore 80*b* adjacent to the slots is sized to have an inside diameter that is slightly smaller than the diameter of the control rod 34. The control rod 34 is pushed into the bore 80*b*, which expands to accommodate the control rod 34. The nut 80*g*, which was previously threaded down to a lower portion of the tube 80*a*, is threaded up and over the control rod 34, thereby squeezing the tube 80*a* into tight contact with the control rod to provide a compressive-friction fit. The nut 80*g* is preferably split to expand as it is threaded over the section in which the control rod 34 is located. The control-rod connector 80 has a body 80*h* at a lower end, and a pivot-rod connector is preferably fixed to the body. Any one of the connectors described herein that connects to a control rod or to a pivot rod can be used as a pivot-rod connector. The control-rod connector 80 can instead or also be used as a pivot-rod connector.

FIGS. 24, 24A and 24B. A connector device can have a control-rod connector 82 that comprises a tube 82*a* that has a central longitudinal bore 82*b*, preferably throughout its length, which is defined by a tubular wall, a bulge 82*c* protruding outwardly from the wall, a port 82*d* through the wall and through the bulge, where the port 82*d* preferably has a rectangular cross-section, where the port 82*d* divides the bulge 82*c* such that the bulge has opposing sides, an opening 82*e* through each of the opposing sides in the bulge 82*c* for receiving a pivot pin 82*f*, a lever 82*g* having a circular disk 82*h* on one end, and a pivot-pin hole 82*i* in the disk 82*h* that is located away from the center of the disk, where the circular disk 82*h* is placed in the port 82*d* with the lever 82*g* extending transversely away from the tube 82*a*, where the pivot pin 82*f* is placed through the opening 82*e* in one side of the bulge, through the pivot-pin hole 82*i* in the disk 82*h*, through the opening 82*e* in the other side of the bulge 82*c* and fixed therein so that the disk 82*h* can be rotated by moving the lever 82*g*. The lever 82*g* with the circular disk 82*h* on one end provides a lever-type eccentric-cam clamp. The inside diameter of the central bore 82*b* is sized slightly larger than the diameter of control rod 34. The control rod 34 is passed into the central bore 82*b*, possibly passing completely through the bore, while the lever 82*g* is in an up position, which is toward the end that receives the control rod. The lever is moved downwardly, which causes the circular disk to contact the control rod and squeeze it against an inside surface of the tubular wall that defines the central bore, thereby clamping the control rod inside the control-rod connector in a compressive-friction engagement or fit. Another version of a lever-type eccentric-cam clamp uses a non-circular disk rather than locating the pivot-pin hole off-center in a circular disk. Either one of the lever-type eccentric-cam clamps can be used as a control-rod connector or as a pivot-rod connector with one of the pivot-rod connectors or control-rod connectors described herein attached to the lever-type eccentric-cam clamp. One connector device uses the lever-type eccentric-cam clamp as the control-rod connector and the two-prong fork or the rod with a plurality of grommet-lined holes as the pivot-rod connector, where an upper end of the pivot-rod connector is fixed to a lower end of the control-rod connector in a coaxial alignment.

Figures 25, 25A:
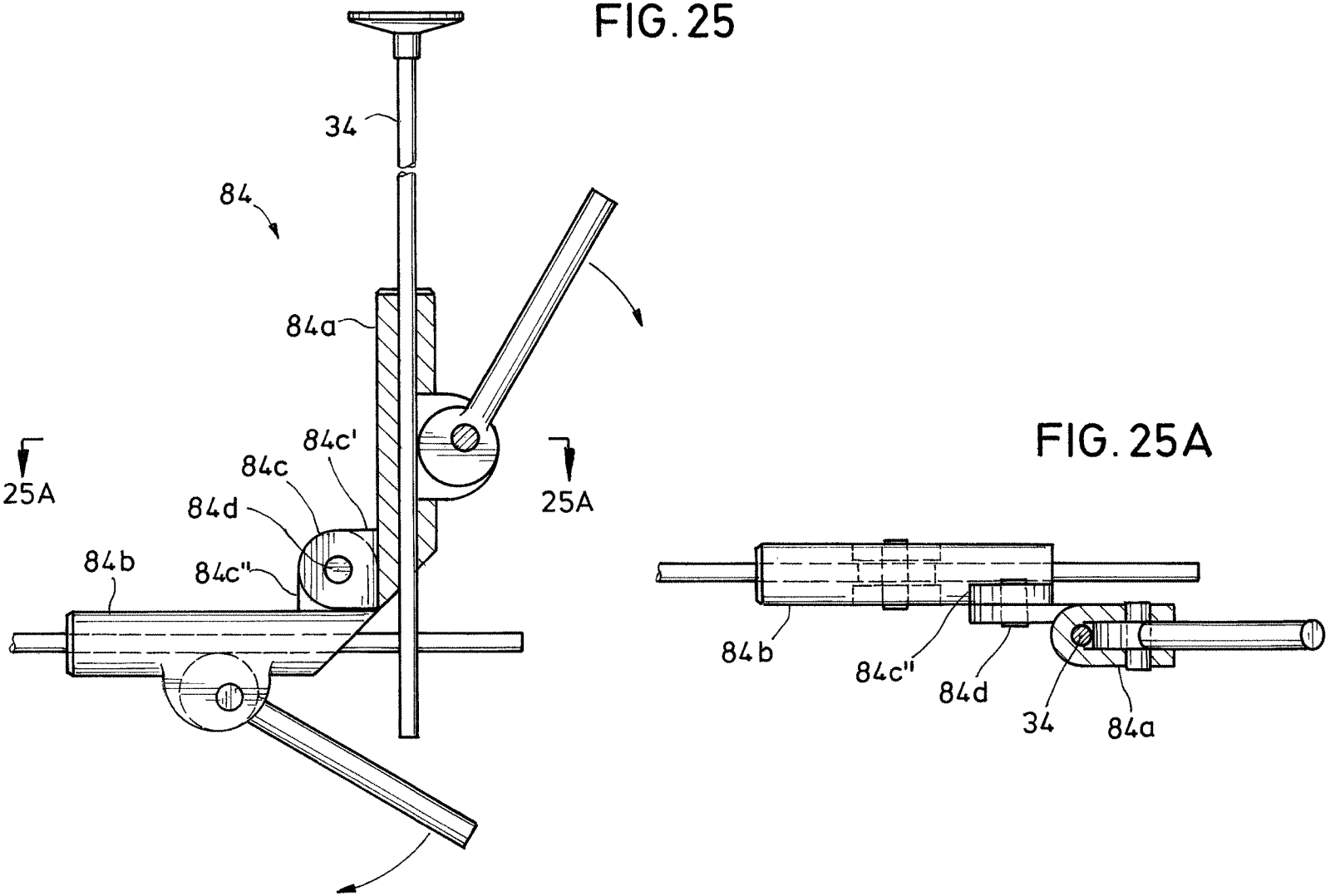
FIG. 25 is a side elevation in partial cross-section of a connector device for connecting a control rod to a pivot rod, according to the present invention.
FIG. 25A is a cross-section of the connector device of FIG. 25 as seen along the line 25A-25A in FIG. 25.

FIGS. 25 and 25A. A connector device 84 according to the present invention comprises a control-rod connector 84*a*, which holds control rod 34 with a lever-type eccentric-cam clamp (as described with reference to FIG. 24), a pivot-rod connector 84*b*, which holds pivot rod 26 with a lever-type eccentric-cam clamp, and a pivotable central body 84*c* connected to the control-rod connector 84*a* and to the pivot-rod connector 84*b*. Each of the control-rod connector 84*a* and the pivot-rod connector 84*b* comprises a tube that has a central longitudinal bore, preferably throughout its length, which allows the respective rods to pass completely through the connectors. The pivotable central body 84*c* has a first bar 84*c*' extending from the control-rod connector 84*a* to a free end and a second bar 84*c*" extending from the pivot-rod connector 84*b* to a free end. The free ends each have a pivot hole, and the free ends are joined side-by-side using a pivot pin 84*d* through the pivot holes. The respective rods do not interfere with each other because the free ends are joined side-by-side, which spaces the respective rods apart. The respective rods are passed into and through the control-rod connector 84*a* and the PRC. The levers of the lever-type eccentric-cam clamps are rotated to clamp the rods in the respective connectors in a compressive-friction fit. The lengths of the first and second bars are sized to accommodate different distances between the control rod and the pivot rod. If necessary to extend a control rod or a pivot rod, then the rod can be extended as described in the present inventors' U.S. Patent Application Pub. No. 20170260724 A1, particularly with reference to FIGS. 38-40.

FIGS. 26, 26A and 26B. A connector device 86 for connecting to a control rod 34 or to a pivot rod (not shown)

comprises a tube 86*a* having a central longitudinal bore 86*b* defined by a tubular wall, a receiving end 86*c* and an opposing end 86*d*, a longitudinal slot 86*e* in the tubular wall that may or may not extend the length of the tube, a pair of parallel bulges 86*f* extending from the tubular wall transverse to the longitudinal axis of the tube, where a space 86*g* is defined between inside faces of the pair of parallel bulges 86*f*, where the slot 86*e* opens into the space 86*g*, where the bulges 86*f* have outside faces that are angled to slope away from the receiving end 86*c* of the tube, although the slope could be in the opposing direction, where each of the parallel bulges 86*f* has a pivot-pin hole or a protruding pivot pin 86*h*, which is preferably the protruding pivot pin, a block 86*i* having an opening defined by side walls and a pivot-pin recess 86*i*' in each of the side walls, where the block 86*i* is engaged with the tube 86*a* by positioning the protruding pivot pins 86*h* inside the pivot pin recesses 86*i*' so that the block 86*i* partially surrounds the bulges 86*f* and pivots on the pivot pins 86*h*, and a lever 86*j* extending from the block 86*i* for rotating the block about the pivot pins, where the block 86*i* has opposing interior faces adjacent to the outside faces of the bulges, where the interior faces are angled such that the interior faces become closer together as the radial distance from the central longitudinal bore becomes greater, where the lever 86*j* can be rotated to close the space 86*g* and the longitudinal slot 86*e* and reduce the diameter of the central longitudinal bore. The diameter of the bore, the width of the slot, the amount of angle on the outside faces of the bulges and the amount of angle on the interior faces of the block are designed so that rotation of the lever clamps the connector to the rod securely in a compressive-friction fit. Connector 86 can be used on the control rod 34 or the pivot rod. Any of the other rod connectors described herein can be fixed to this connector to provide a connector device. Two of these connectors can be attached to each other to provide a connector device, preferably with a pivot pin as described above with reference to the connector device that has a pair of lever-type eccentric-cam clamps pivotably connected to each other.

FIGS. 27 and 27A-27H. A connector device 90 according to the present invention comprises a control-rod connector 92, which holds control rod 34, and a pivot-rod connector 94, which holds pivot rod 26. Connector device 90 bears some similarity to the connector device 50 in FIG. 13. A central body 93 connects the control-rod connector 92 to the pivot-rod connector 94. The control-rod connector 92 has an outer end 92*a*, which has an open C-shape or U-shape, and an opposing inner end 92*b*, which is formed integral with or attached to the central body 93. A unitary, integral shaft extends from the outer end 92*a* to the inner end 92*b* in the embodiment illustrated in FIGS. 27 and 27A-27H. However, the control-rod connector 92 can be thought of as comprising several elements: an inner U-channel or C-channel 92*c* adjacent to the inner end 92*b*, an outer U-channel or C-channel 92*d* adjacent to the outer end 92*a* and an opening or a hole 92*e* between the inner channel 92*c* and the outer channel 92*d*. A U-channel or a C-channel has a central web or plate and two flanges extending away from one side of the central web or plate, which provide outer edges or outer sides. A transverse cross-section of the inner and outer channels have a shape resembling a "U" or a "C." Another way to describe the elements 92*c* and 92*d* is as an elongate shaft having a groove or trough cut into or formed within a side of the shaft, which extends for substantially the length of the shaft or a good portion of the shaft. The inner element 92*c* will be referred to as the inner U-channel 92*c*, and the outer element 92*d* will be referred to as the outer C-channel 92*d* for a convenient terminology.

Figures 27, 27A:
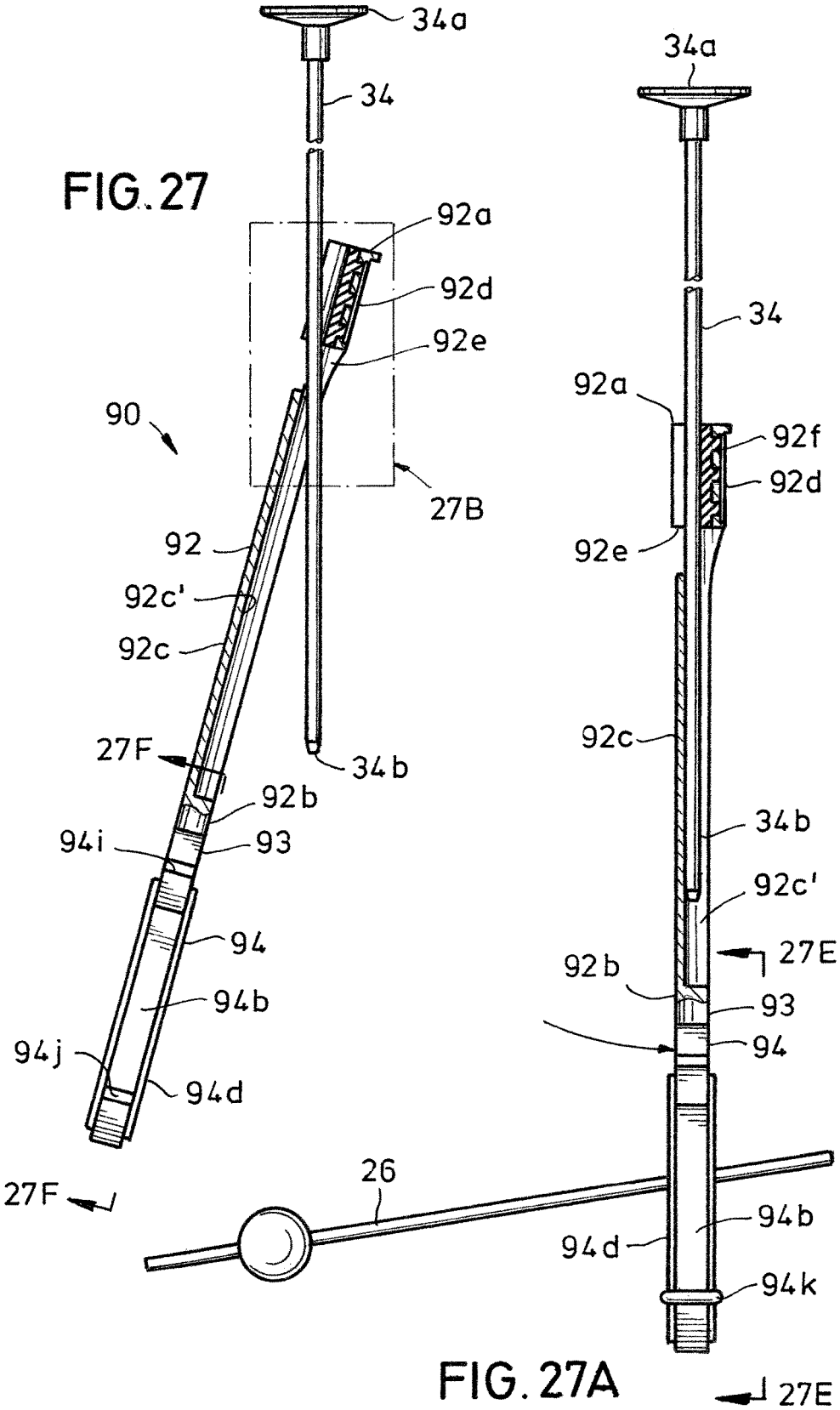
FIG. 27 is a side elevation in partial cross-section of a connector device for connecting a control rod to a pivot rod, which shows the connector device being connected to the control rod, according to the present invention.
FIG. 27A is a side elevation in partial cross-section of the connector device of FIG. 27, which shows the connector device fully connected to the control rod and to a pivot rod, according to the present invention.

The control-rod connector 92 can be seen in further detail in FIGS. 27A-27D. The outer C-channel 92*d* is lined with a material that is different from the remainder of the material used to make the control-rod connector 92. Most of the connector device 90 can be made of a polymeric material such as polypropylene or a high density polyethylene, although it can be made of other thermoplastics, polymeric materials or metals. The connector device 90 is preferably generally rigid, but yet somewhat resilient, which allows some bending, although total rigidity would be acceptable. As best seen in FIG. 27D, the outer C-channel 92*d* comprises an outermost C-channel element 92*d*', which has an inner surface 92*d*", and a liner 92*f* covers the inner surface 92*d*". Liner 92*f* has an inside surface 92*f*. The inner surface 92*f* defines a longitudinal groove in the liner 92*f* and in the outer C-channel 92*d*. Liner 92*f* is preferably an over-molded rubbery material, such as a styrene-butadiene rubber or such as a chloroprene rubber such as neoprene. Liner 92*f* is preferably more resilient than the material of which the remainder of the control-rod connector 92. The material of which the liner 92*f* is made is more ductile, pliable, flexible and resilient than the material of which the outermost C-channel element 92*d*' or the remainder of the control-rod connector 92 is made. FIG. 27D shows that in cross-section the outermost C-channel element 92*d*' and the liner 92*f* have a "C" or a "U" shape. FIG. 27C shows that the outermost C-channel element 92*d*' has three holes 92*g* through which the rubbery material of the liner 92*f* flows during molding for anchoring the liner 92*f* within the outermost C-channel element 92*d*'. The body of the connector device 90 is first molded of a first material, and then the liner 92*f* is molded over or onto or into the outermost C-channel element 92*d*' as a second material, thereby covering the inner surface 92*d*" of the outermost C-channel element 92*d*'. Liner 92*f* is not essential to the invention, but can be helpful, as discussed below. Liner 92*f* could instead be glued to the inner surface 92*d*".

The inner U-channel 92*c* also has a shape in cross-section that resembles a "C" or a "U." The inner U-channel 92*c* has an inside surface 92*c*' along its U-shaped cross-section. The inside surface 92*c*' defines a longitudinal groove in the inner U-channel 92*c*. The inner U-channel 92*c* and the outer C-channel 92*d* can each be described as having three closed sides and one open side. The open side of the inner U-channel 92*c* faces in a direction opposite the open side of the outer C-channel 92*d*. The longitudinal groove in the inner U-channel 92*c* is located on an opposite side of the control-rod connector 92 from the longitudinal groove on the outer C-channel 92*d*. The purpose of the structural features of the control-rod connector 92 will become apparent upon reading how the connector is used.

With reference to FIGS. 27 and 27A, the control rod 34 has its knob 34*a* at its upper end and an opposing lower end 34*b*. To use the control-rod connector 92, one inserts the lower end 34*b* of the control rod 34 through the hole 92*e*, which is defined by and located between the inner U-channel 92*c* and the outer C-channel 92*d*. The open side of each of the inner U-channel 92*c* and the outer C-channel 92*d* should face the control rod 34. A length of the control rod 34 should pass through the opening 92*e*. The length of the control rod that should pass through the hole 92*e* is determined by a combination of the length of the inner U-channel 92*c* and the desired location of the knob 34*a*. The control rod 34 will be transverse of the control-rod connector 92 as it is passed through the opening 92*e*. After a desired length of the control rod 34 is passed through the opening 92*e*, the control rod 34 or rather the control-rod connector 92 is rotated so as to cause the control rod 34 to be inserted into and through the open side of each of the inner U-channel 92*c* and the outer C-channel 92*d*. The control-rod connector 92 is rotated about a point along its length so as to align the longitudinal axis of the control-rod connector 92 with the longitudinal axis of the control rod 34. The control rod 34 seats into close proximity to the inner surface 92*c*' of the inner U-channel 92*c* and into close proximity with the inner surface 92*f* of the liner 92*f* in the outer C-channel 92*d*. The size and shape of the longitudinal groove in the inner U-channel 92*c* and the outer C-channel 92*d* is preferably chosen to accommodate the size and shape of the control rod in a reasonably close-fitting fit, a somewhat tight or snug fit for a compressive-friction fit. If the control rod 34 has a circular cross-section, then the inner surface 92*c*' of the inner U-channel 92*c* preferably likewise defines a circular cross-section on all but the open side. More importantly in this embodiment, the inner surface 92*f* of the liner 92*f* in the outer C-channel 92*d* preferably has a size and shape for receiving the control rod 34 in a tight or snug fit in which the liner 92*f* is compressed to a slight extent, thereby providing a compressive engagement between the liner 92*f*, the outer C-channel 92*d* and the control rod 34. The rubbery material of which the liner 92*f* is made provides friction between the liner 92*f* and the control rod 34, thereby providing a friction fit that engages the liner 92*f* with the control rod 34. The liner 92*f* is anchored in or adhered to the outer C-channel 92*d*. A compressive-friction engagement is provided between the outer C-channel 92*d* and the control rod 34, preferably through the liner 92E Overall, the control rod 34 is fastened to the control-rod connector 92 through a compressive-friction fit of the control rod 34 within the longitudinal groove in the inner U-channel 92*c* and the outer C-channel 92*d*. The longitudinal axis of the control rod 34 becomes substantially aligned with, preferably substantially coaxial with, the longitudinal axis of the control-rod connector 92. Ideally, the longitudinal axis of the control rod 34 becomes coaxial with the longitudinal axis of the control-rod connector 92. In an actual manufacture and use of the control-rod connector 92, the longitudinal axis of the control rod 34 may become approximately coaxial with or approximately parallel to the longitudinal axis of the control-rod connector 92.

Turning now to the pivot-rod connector 94 and with reference to FIGS. 27E and 27F, the pivot-rod connector 94 comprises a two-prong fork 94*a* extending from the central body 93 and coaxial with or essentially, approximately or substantially coaxial with the control-rod connector 92. The two-prong fork 94*a* has two tines 94*b* and 94*c*, which have inside faces 94*b*' and 94*c*' that face toward each other. The two-prong fork 94*a* is preferably made of a somewhat stiff polymeric material and is preferably made as a unitary integral portion with the central body 93 and control-rod connector 92 in the same molding using the same material as described above for the control-rod connector 92. A liner 94*d* made of a rubbery material, preferably the same material of which the liner 92*f* is made, is preferably over-molded on the tines 94*b* and 94*c* so as to cover the inside faces 94*b*' and 94*c*'. Holes 94*e* provide openings through the tines 94*b* and 94*c* through which the rubbery material can flow during the molding process for anchoring the liner 94*d* to the tines 94*b* and 94*c*. Notches 94*f* provide recesses in the faces 94*b*' and 94*c*' of the tines, which helps to prevent the liner 94*d* from slipping longitudinally along the faces of the tines 94*b* and 94*c*. Liner 94*d* is useful, but not essential. Liner 94*d* can be omitted, and the pivot rod 26 can be received in one of the sets of opposing notches 94*f*. Four sets of notches 94*f* accommodate for different desired lengths of the pivot-rod connector 94 for different manufacturers of pop-up drain assemblies. FIG. 27G shows the tines 94*b* and 94*c* and the liner 94*d* in cross-section as seen along the line 27G-27G in FIG. 27F. Liner 94*d* lines the faces 94*b*' and 94*c*' and itself has opposing faces that define a longitudinal slot 94*g* and a mouth 94*h* at an end of the two-prong fork 94*a* distal to the central body 93.

The two-prong fork 94*a* in FIGS. 27, 27A, 27E and 27F is very similar to the two-prong fork 32*b* described with reference to FIGS. 1 and 2 and is used in a similar manner. The two-prong fork 94*a* is pressed transversely onto the pivot rod 26 such that the pivot rod 26 is received in the mouth 94*h* and slid into the longitudinal slot 94*g* to a desired location for proper operation of the pivot rod. Alternatively, the pivot rod 26 is pushed into the mouth 94*h* of the two-prong fork 94*a* and further into the longitudinal slot 94*g*. The two-prong fork 94*a* is sized and designed with respect to the diameter of the pivot rod 26, which typically has a circular cross-section, so that the distance between the faces of the opposing sides of the liner 94*d* is slightly less than the diameter of the pivot rod 26. As the pivot rod 26 is pushed into the mouth 94*h* of the two-prong fork 94*a*, the tines 94*b* and 94*c* are pushed apart, which causes the tines 94*b* and 94*c* to exert a spring force on the pivot rod 26, and the liner 94*d* is compressed, which causes the liner 94*d* to exert a spring force on the pivot rod. The rubber material of which the liner 94*d* is made should be chosen so that the liner 94*d* provides friction against the pivot rod 26. Consequently, the pivot rod 26 is held in a compressive-friction engagement with the pivot-rod connector 94.

The pivot-rod connector 94 has upper and lower sets of indentations 94*i* and 94*j* as best seen in FIG. 27F. After the pivot rod is pushed into the slot 94*g* between the tines 94*b* and 94*c*, an O-ring or a clamp 94*k* can be placed in the lower set of indentations 94*j* for pulling the tines 94*b* and 94*c* closer together, thereby increasing the compression and the friction exerted on the pivot rod 26 by the two-prong fork 94*a*. FIG. 27H shows the O-ring 94*k* surrounding the tines 94*b* and 94*c*, as seen along the line 27H-27H in FIG. 27E. The O-ring 94*k* can be stored from the factory in the upper set of indentations 94*i*; removed before installation; and placed in the lower indentations 94*j* after the pivot rod is moved into the slot 94*g*. Alternatively, the O-ring 94*k* can be stored from the factory in the lower indentations 94*j*, and a second O-ring can be stored in the upper indentations 94*i*. The second O-ring can be moved over the control rod 34 in the inner U-channel 92*c* for further securing the control rod 34 in the longitudinal groove of the control-rod connector 92.

FIG. 27A shows a side elevation of the fully assembled connector device 90 with the control-rod connector 92 shown in cross-section so that it can be seen that the control rod 34 is received in the longitudinal groove defined in the inner U-channel 92*c* and the outer C-channel 92*d* with the control rod 34 passing through the opening 92*e*. Connector device 90 can be described generally as follows. A connector device 90 for connecting first and second rods 34 and 26 together, which are positioned transverse to one another, includes: (1) an elongate body, such as control-rod connector 92, having a longitudinal axis and opposing first and second ends, where the first end and some length of the elongate body comprises a C-channel structure 92*c*, where the C-channel structure has a longitudinal axis that is parallel to or coaxial with the longitudinal axis of the elongate body 92, and where the C-channel structure 92*c* is open along one side of the elongate body thereby providing a longitudinal groove; (2) a C-channel element 92*d* connected to or formed integral with the first end of the elongate body 92, where the C-channel element 92*d* has a longitudinal axis that is parallel to or coaxial with the longitudinal axis of the elongate body, where the C-channel element 92*d* is open in a direction that is generally opposite that of the C-channel structure 92*c*, thereby providing a longitudinal groove that faces in a direction opposite the longitudinal groove in the C-channel structure 92*c*; (3) an opening 92*e* defined by and between the elongate body or c-channel structure 92*c* and the C-channel element 92*d*, where the elongate body 92*c*, the C-channel element 92*d* and the opening 92*e* are sized and designed to receive the first rod 34 through the opening 92*e* and within the elongate body 92*c* and the C-channel element 92*d* in a compressive-friction engagement; and (4) a second-rod connector 94 attached to or formed integral with the second end of the elongate body 92*c* or 93, where the second-rod connector 94 is sized and designed to receive the second rod 26 in a compressive-friction fit. Preferably, the second-rod connector 94 comprises a fork 94*a* having first and second opposing prongs 94*b* and 94*c* for receiving the second rod 26 between the first and second prongs such that the longitudinal axis of the second rod 26 is transverse to the longitudinal axis of the elongate body 92. Preferably, the fork 94*a* and its first and second opposing prongs 94*b* and 94*c* have a longitudinal axis that is generally parallel to or coaxial with the longitudinal axis of the elongate body 92.

Figure 28:
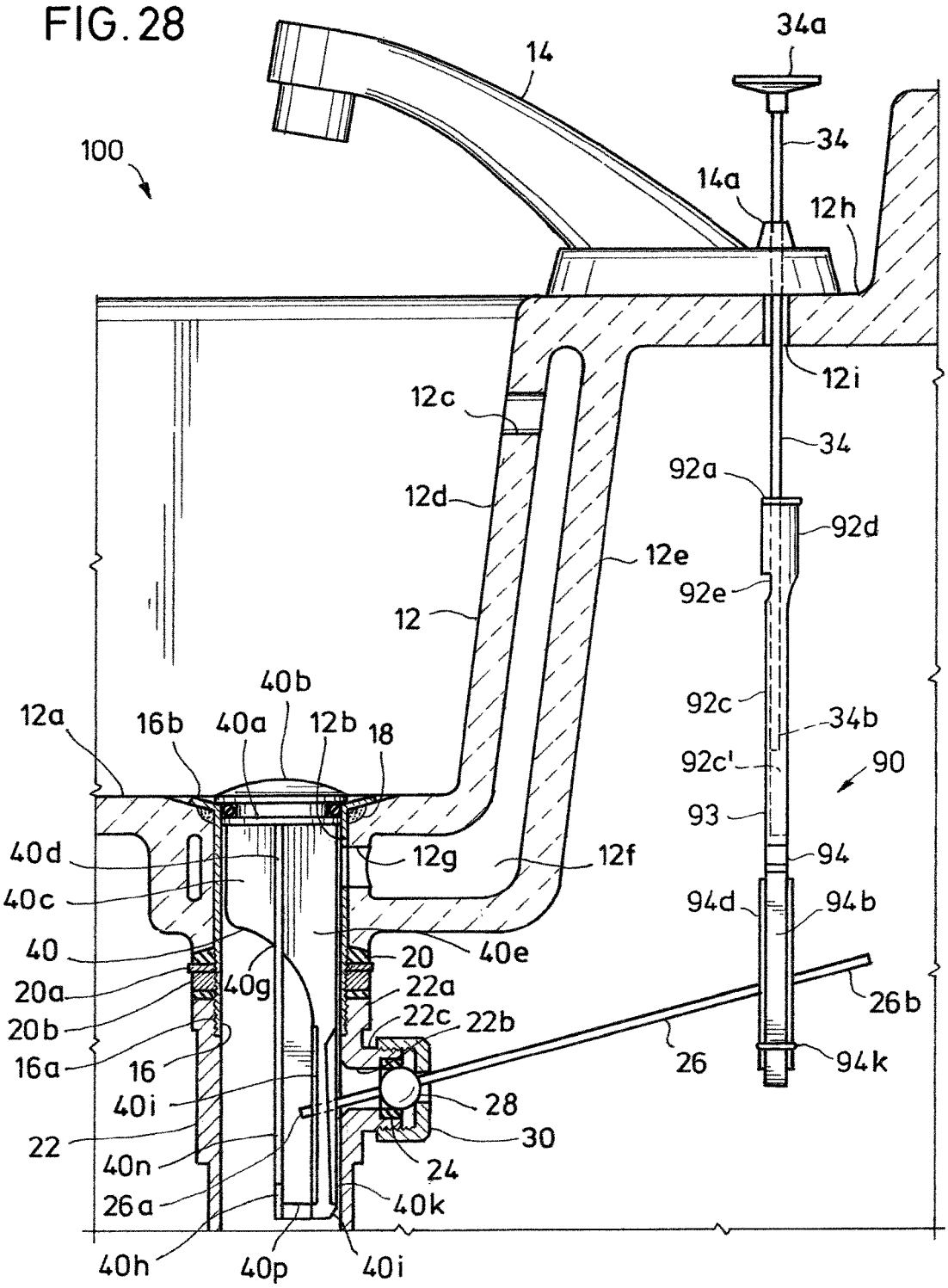
FIG. 28 is similar to FIG. 1, except showing the connector device of FIG. 27A replacing the connector device shown in FIG. 1, according to the present invention.

FIG. 28 is the same as FIG. 1, except the connector device 32 in FIG. 1, which was described with reference to FIGS. 2-4, has been replaced with the connector device 90, which was described with reference to FIGS. 27 and 27A-27H.

Figure 23B:
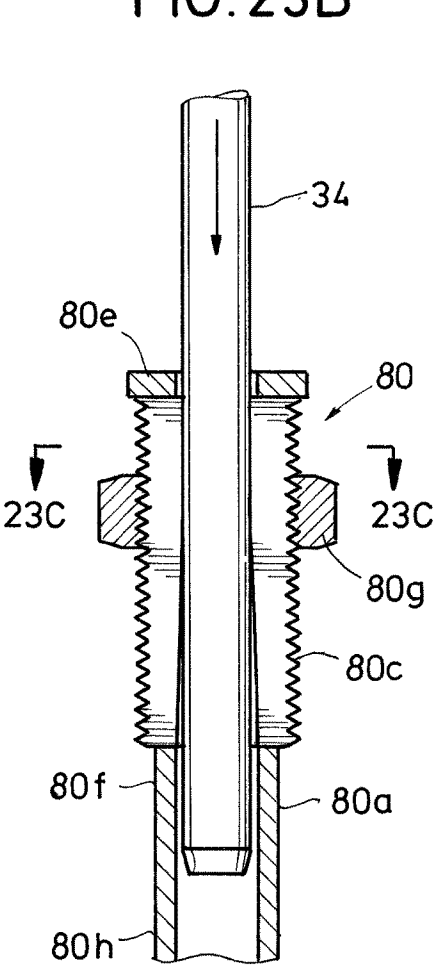
FIG. 23B is a side elevation in partial cross-section of the connector device of FIG. 23 after a connection is made with the control rod.
Figure 23A:
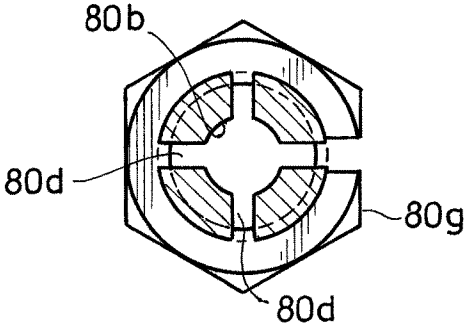
FIG. 23A is a cross-section of the connector device of FIG. 23 as seen along the line 23A-23A in FIG. 23.
Figure 23C:
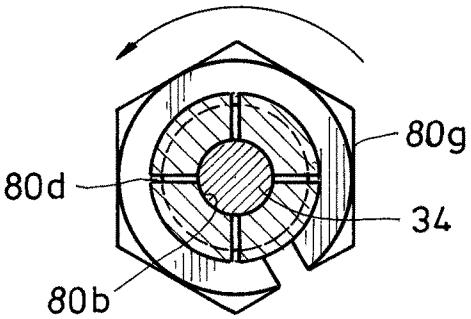
FIG. 23C is a cross-section of the connector device of FIG. 23B as seen along the line 23C-23C in FIG. 23B.
Figure 23:
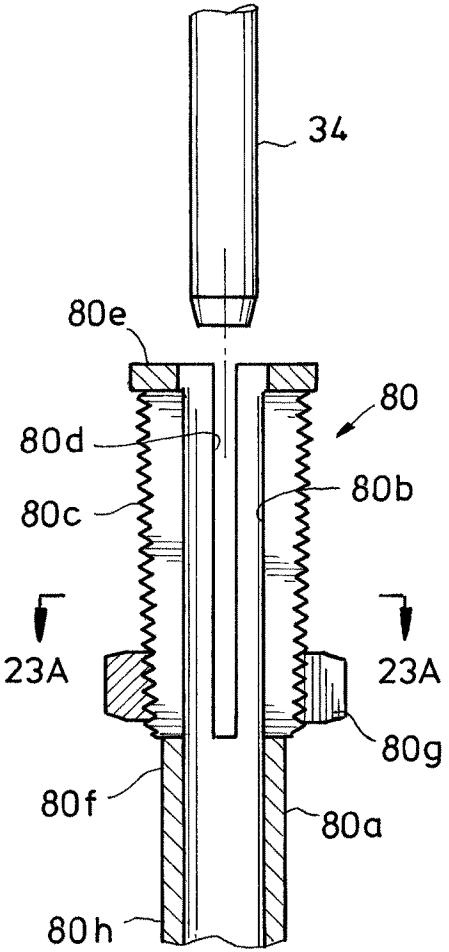
FIG. 23 is a side elevation in partial cross-section of a connector device that can be connected to a control rod, according to the present invention.

One characteristic of the connector device of the present invention is the general absence of elements typically found in connector devices in the prior art. The various embodiments of the connector device of the present invention do not have a clevis, a clevis screw, clevis strap, a flat rod or a flat strap with spaced-apart holes, an extension rod, a screw, a thumb screw, a bolt, a threaded nut, a threaded element, a pin such as a cotter pin that connects two pieces together or a spring clip or a U-shaped clip that has at least two holes through which a rod passes for engagement with the rod, at least one of which is often found in the prior art. Compression fitting 32*c* described with reference to FIG. 4 is one exception to this general rule in that threaded elements are used to compress a rubber conical washer against a control rod for providing a compressive-friction engagement. The embodiment described with reference to FIG. 23 is an exception to this general rule in that threaded elements are used to provide a compressive force on a rod. The embodiments of FIGS. 24-26 use a hinge pin, but this is not the same as using a cotter pin or some similar pin to connect two elements together. The connector device of the present invention generally relies on a user pressing the connector device into an engagement with a rod, where in doing so a spring force in the connector device applies a compressive force on the rod, or friction between the connector device and the rod increases (possibly to the point of engaging the connector device with the rod), or both, thereby engaging or fastening the connector device to the rod by exerting a compressive force on the rod or by providing sufficient friction between the connector device and the rod to hold the rod in engagement with the connector device or more typically employing a combination of the two in a compression and friction engagement between the connector device and the rod. Most of the embodiments of the invention provide a compression and/or friction engagement between the connector device and the rod, without using a screw to press against a rod or a U-shaped spring clip having a pair of holes through which the rod passes or by threading two elements together to hold a rod.

The pop-up drain assembly, the connector device and the drain stopper of the present invention provides a number of improvements over the prior art. The various embodiments of the connector device are easier to install than the prior art connector devices. The connector devices of the present invention can be used with conventional prior art pivot rods or ball rods and control rods or lift rods, which is particularly beneficial for retrofitting an existing pop-up drain assembly with a connector device of the present invention. Disassembly and re-assembly of the connector device of the present invention is easier than with the typical prior art connectors, which is useful if the inventive connector device is used in a conventional pop-up drain assembly in which the drain stopper cannot be removed without removing the pivot rod. The drain stopper of the present invention can be removed from the drain pipe without removing the pivot rod. Prior art drain stoppers were generally not removable without first removing the pivot rod, which made cleaning a clogged drain more difficult and time consuming than with the present invention. The dual-prong fork on the drain stopper of the present invention is simply pressed onto the pivot rod and pulled off when desired. Offsetting the dual-prong fork to the outermost circumference of the drain stopper allows for less protrusion of the pivot rod into the drain pipe, which makes it less likely that hair and debris will be caught on the pivot rod, thereby making it less likely that the drain pipe will become clogged or stopped up.

EMBODIMENTS OF THE INVENTION

A limited number of possible embodiments of the invention can be described as follows.

1. A pop-up drain assembly for a sink or basin having a drain opening, comprising:
   - piping for providing a fluid flow pathway from the sink or basin through the drain opening and through the piping;
   - a stopper for retaining fluid in the sink or basin, wherein the stopper is received in the piping while in operation and is moveable between an open position and a closed position; and
   - a pivot rod engaged with the stopper for moving the stopper between the open position and the closed position, wherein the pivot rod has a stopper end and an outer end;
   - a control rod for moving the pivot rod; and
   - a connector device for connecting the control rod to the pivot rod, wherein the connector device has a pivot rod end connected to the pivot rod and an opposing control rod end connected to the control rod, and wherein connector device comprises:
     - (1) a two-prong fork on the pivot rod end that engages the pivot rod in a friction fit; or
     - (2) a compression fitting on the control rod end that engages the control rod in a compression fit; or
     - (3) both a two-prong fork on the pivot rod end that engages the pivot rod in a friction fit and a compression fitting on the control rod end that engages the control rod in a compression fit.
2. The pop-up drain assembly of embodiment 1, wherein the two-prong fork comprises two parallel prongs, wherein each of the two parallel prongs has an inside face, wherein the inside faces define a gap between the two parallel prongs, and wherein a resilient material is fastened to each of the inside faces.

3. The pop-up drain assembly of embodiment 1 or 2, wherein the compression fitting comprises an inner cylinder having external threads; an outer cylinder having internal threads that matingly engage with the external threads; and a compression washer between the inner and outer cylinders.

4. The pop-up drain assembly of embodiment 1 or 2, wherein the compression fitting comprises an inner cylinder having external threads; an outer cylinder having internal threads that matingly engage with the external threads, wherein the inner cylinder has separated fingers on an outer end that are squeezed together as the outer cylinder is threaded onto the inner cylinder.

5. The pop-up drain assembly of embodiment 1, 2 or 3, wherein the stopper has an upper end and a lower end, a cap on the upper end, and a dual-prong fork on the lower end, and wherein the stopper end of the pivot rod is received between the prongs in the dual-prong fork.

6. The pop-up drain assembly of embodiment 5, wherein the dual-prong fork comprises two parallel prongs, wherein each of the two parallel prongs has an inside face, wherein the inside faces define a gap between the two parallel prongs, and wherein the pivot rod is engaged with the stopper by a friction fit.

7. The pop-up drain assembly of embodiment 6, wherein a resilient material is fastened to each of the inside faces of the prongs in the dual-prong fork.

8. The pop-up drain assembly of any one of embodiments 1-4, wherein the stopper comprises an elongate body that has at least three longitudinal fins for centering the body in the piping, wherein the fins project radially and define an outermost circumference of the body, a cap on one end of the body for providing a seal and a dual-prong fork extending longitudinally from one of the fins away from the cap end, and wherein the dual-prong fork has an outer surface approximately and substantially aligned with the outermost circumference of the body.

9. The pop-up drain assembly of any one of embodiments 1-4, wherein the piping has a pivot rod port, wherein the pivot rod is received in the pivot rod port, wherein the stopper comprises a body that has a length, a longitudinal axis, an upper end, a cap on the upper end, a lower end, and a dual-prong fork on the lower end, wherein the dual prong fork is adjacent to the pivot rod port, and wherein the pivot rod is received between the prongs in the dual-prong fork in a friction fit.

10. The pop-up drain assembly of embodiment 9, wherein the body comprises a plurality of fins that project radially from the longitudinal axis of the body and extend longitudinally, wherein the fins have longitudinal outer edges that define an outermost perimeter of the body, wherein the dual-prong fork depends from one of the fins, and wherein the dual-prong fork has a surface that lies on the outermost perimeter of the body.

11. The pop-up drain assembly of embodiment 9 or 10, wherein the dual-prong fork comprises two parallel prongs, wherein each of the two parallel prongs has an inside face, wherein the body and the dual-prong fork are made of a first polymeric material, wherein a second polymeric material is fastened to each of the inside faces, wherein the second polymeric material is less rigid and more resilient than the first polymeric material, wherein a gap is defined between the second polymeric material on one prong and the second polymeric material on the other prong, and wherein the pivot rod is received in the gap and held there by friction and by a spring force applied on the pivot rod by the prongs.

12. The pop-up drain assembly of any one of embodiments 1-4, wherein the stopper comprises a body that has a length, an upper end and an opposing lower end, wherein the body defines a circular cylindrical space that has a longitudinal axis and a diameter, wherein the body has a dual-prong fork that has an outer surface, and wherein the outer surface of the dual-prong fork has a length that extends longitudinally along the diameter of the circular cylindrical space.

13. The pop-up drain assembly of embodiment 12, wherein the piping has a pivot rod port, wherein the pivot rod is received in the pivot rod port, wherein the dual-prong fork is adjacent to the pivot rod port, and wherein the pivot rod is received between the prongs in the dual-prong fork in a friction fit.

14. The pop-up drain assembly of embodiment 13, further comprising a cap having a seal or a gasket, wherein the cap is received on the upper end of the body.

15. The pop-up drain assembly of any one of embodiments 1-4, wherein the stopper has an upper end and a lower end, a cap on the upper end, and a dual-prong fork on the lower end, wherein the dual-prong fork comprises two parallel prongs, wherein each of the two parallel prongs has an inside face and an opposing outside face, wherein the inside faces define a gap between the two parallel prongs, wherein the stopper has a support plate attached to or made integral with the outside face of one of the prongs that extends toward a central portion of the stopper, and wherein the stopper has a stop plate connected at a right angle to an edge of the support plate such that the stop plate is parallel to and spaced away from the prongs.

16. The pop-up drain assembly of embodiment 1, wherein the piping has a pivot rod port, wherein the pivot rod is received in the pivot rod port, wherein the stopper comprises a body that has a length, a longitudinal axis, an upper end, a cap on the upper end, a lower end, and a dual-prong fork on the lower end, wherein the dual prong fork is adjacent to the pivot rod port, wherein the dual-prong fork comprises two parallel prongs, wherein each of the two parallel prongs has an inside face, wherein the inside faces define a gap between the two parallel prongs, wherein the stopper has a support plate attached to or made integral with the outside face of one of the prongs that extends toward a central portion of the stopper, and wherein the stopper has a stop plate connected at a right angle to an edge of the support plate such that the stop plate is parallel to and spaced away from the prongs.

17. The pop-up drain assembly of embodiment 16, wherein the body of the stopper defines a circular cylindrical space that has a longitudinal axis and a diameter, wherein the dual-prong fork has an outer surface adjacent to the pivot rod port, and wherein the outer surface of the dual-prong fork has a length that extends longitudinally along the diameter of the circular cylindrical space.

18. The pop-up drain assembly of embodiment 1, wherein the piping has a pivot rod port, wherein the pivot rod is received in the pivot rod port, wherein the stopper comprises a body that has a length, a longitudinal axis, an upper end, a cap on the upper end, a lower end, and a dual-prong fork on the lower end, wherein the dual prong fork is adjacent to the pivot rod port, wherein the dual-prong fork comprises two parallel prongs, wherein each of the two parallel prongs has an inside face, wherein the inside faces define a gap between the two parallel prongs, wherein the pivot rod is received in the gap between the prongs on the dual-prong fork, wherein the connector device comprises both the two-prong fork on the pivot rod end and the compression fitting on the control rod end, wherein the two-prong fork has two parallel tines, wherein the pivot rod is received between the two tines, and wherein the control rod is received in the compression fitting.

19. The pop-up drain assembly of embodiment 1, wherein the piping has a pivot rod port, wherein the pivot rod is received in the pivot rod port, wherein the stopper comprises:

an elongated body having a longitudinal axis, the body comprising two or more longitudinal fins for centering the body in a drain pipe, wherein the fins project radially and define an outermost circumference of the body;

a cap on one end of the body for providing a seal;

a magnet holder extending longitudinally from one of the fins away from the cap end; and a magnet or a magnetic material received in the magnet holder, wherein the magnet holder, the magnet or the magnetic material has an outer surface approximately and substantially aligned with the outermost circumference of the body, and wherein the magnet or magnetic material is elongated and has a longitudinal axis that is radially offset from and substantially parallel to the longitudinal axis of the body.

20. A connector device for connecting a generally vertical control rod to a generally horizontal pivot rod in a pop-up drain assembly, comprising:

a body;

a two-prong fork extending from the body; and a compression fitting extending from the body.

21. The connector device of embodiment 20, wherein the body is between the two-prong fork and the compression fitting.

22. The connector device of embodiment 21, wherein the body, the two-prong fork and the compression fitting are aligned along a common longitudinal axis.

23. The connector device of embodiment 22, wherein the compression fitting comprises a first cylinder fixed to or made integral with the body, a ferrule element and a second cylinder threadedly engaged with the first cylinder, wherein the ferrule element is received between and inside of the first and second cylinders.

24. A connector device for connecting a generally vertical control rod to a generally horizontal pivot rod in a pop-up drain assembly, comprising:

a body;

a two-prong fork extending from the body sized and designed to engage the pivot rod in a transverse friction fit; and a fastener element attached to or formed integral with the body for receiving and engaging the control rod.

25. The connector device of embodiment 24, wherein the body, the two-prong fork and the fastener element are aligned along a common longitudinal axis.

26. The connector device of embodiment 24 or 25, wherein the fastener element is a compression fitting that comprises a first cylinder fixed to or made integral with the body, a ferrule element and a second cylinder threadedly engaged with the first cylinder, wherein the ferrule element is received between and inside of the first and second cylinders.

27. The connector device of embodiment 24, 25 or 26, wherein the ferrule element is a conical-shaped rubber washer that has a bore through which a control rod can be received.

28. The connector device of embodiment 24 or 25, wherein the fastener element comprises a flat bar bent into sideways U-shape with two horizontal legs and a hole in each leg for receiving a control rod, and wherein the fastener element includes a set screw in the base portion of the U-shape, wherein the screw can be tightened against a control rod.

29. The connector device of embodiment 24 or 25, wherein the two-prong fork comprises two parallel prongs, wherein each of the two parallel prongs has an inside face, wherein the body and the two-prong fork are made of a first polymeric material, wherein a second polymeric material is fastened to each of the inside faces, wherein the second polymeric material is less rigid and more resilient than the first polymeric material, wherein a gap is defined between the second polymeric material on one prong and the second polymeric material on the other prong, and wherein the pivot rod is received in the gap and held there by friction and by a spring force applied on the pivot rod by the prongs.

30. A drain stopper, comprising a body that has a length, an upper end and an opposing lower end, wherein the body defines a circular cylindrical space that has a longitudinal axis and a diameter, wherein the body has a two-prong fork that has an outer surface, and wherein the outer surface of the two-prong fork has a length that extends longitudinally along the outer surface of the circular cylindrical space.

31. The drain stopper of embodiment 30, further comprising a cap having a seal or a gasket, wherein the cap is received on the upper end of the body.

32. The drain stopper of embodiment 31, wherein the cap is connected to the body by a threaded connection, and wherein the diameter of the cap is at least 1.5 times the diameter of the body.

33. A drain stopper, comprising: a body having an upper end and a lower end, a cap on the upper end, and a two-prong fork on the lower end, wherein the two-prong fork comprises two parallel prongs, wherein each of the two parallel prongs has an inside face, wherein the inside faces define a gap between the two parallel prongs, wherein the drain stopper has a longitudinal axis, and wherein the two parallel prongs are offset radially outwardly from the longitudinal axis.

34. The drain stopper of embodiment 33, wherein the body defines a circular cylindrical space that has a diameter, wherein the two-prong fork has an outer surface, and wherein the outer surface of the two-prong fork has a length that extends longitudinally along the outer surface of the circular cylindrical space.

35. The drain stopper of embodiment 33 or 34, further comprising a stop plate extending longitudinally from the lower end of the body along the longitudinal axis.

36. The drain stopper of embodiment 35, wherein the two-prong fork has an inner surface opposing the outer surface, and wherein a space is defined between inner surface and the stop plate.

37. The drain stopper of embodiment 36, further comprising a support extending between one of the prongs and the stop plate.

38. A drain stopper having an upper end and a lower end, a cap on the upper end, and a dual-prong fork on the lower end, wherein the dual-prong fork comprises two parallel prongs, wherein each of the two parallel prongs has an inside face and an opposing outside face, wherein the inside faces define a gap between the two parallel prongs, wherein the stopper has a support plate attached to or made integral with the outside face of one of the prongs that extends toward a central portion of the stopper, and wherein the stopper has a stop plate connected at a right angle to an edge of the support plate such that the stop plate is parallel to and spaced away from the prongs.

39. The drain stopper of embodiment 38, wherein the stopper has a body that defines a circular cylindrical space that has a longitudinal axis and an outermost surface, wherein the dual-prong fork has an outer surface that has a length that extends longitudinally along the outermost surface of the circular cylindrical space.

40. A drain stopper, comprising: a body having an upper end and a lower end, a cap on the upper end, and a two-prong fork on the lower end, wherein the two-prong fork comprises two parallel prongs, wherein each of the two parallel prongs has an inside face, wherein the inside faces define a gap between the two parallel prongs, wherein the drain stopper has a longitudinal axis, wherein the two parallel prongs are offset radially outwardly from the longitudinal axis, wherein the body defines a circular cylindrical space that has an outermost surface, wherein the two-prong fork has an outer surface, wherein the outer surface of the two-prong fork has a length that extends longitudinally along the outermost surface of the circular cylindrical space, wherein the circular cylindrical space is below the cap, wherein the cap has a diameter that is greater than the diameter of the circular cylindrical space by a factor of 1.1 to 3.0, preferably by a factor of 1.5 to 2.5, and more preferably by a factor of 1.75 to 2.25.

41. A connector device for connecting a generally vertical control rod to a generally horizontal pivot rod in a pop-up drain assembly, comprising:

a body;

an attachment device for connecting the connector device to the pivot rod; and a compression fitting for receiving and holding the control rod in a compression fit.

42. The connector device of embodiment 41, wherein the wherein the compression fitting and the control rod each have a longitudinal axis, and wherein the control rod is held coaxially inside the compression fitting.

43. The connector device of embodiment 41 or 42, wherein the compression fitting comprises a first cylinder fixed to or made integral with the body, a ferrule element and a second cylinder threadedly engaged with the first cylinder, wherein the ferrule element is received between and inside of the first and second cylinders.

44. The connector device of embodiment 43, wherein the ferrule element is a conical-shaped rubber washer that has a bore through which the control rod can be received.

45. The connector device of embodiment 41, wherein the compression fitting comprises a first, second and third elements for receiving and holding the control rod, wherein the first and third elements are in a cooperative arrangement for squeezing the second element against the control rod.

46. The connector device of embodiment 45, wherein the first, second and third elements have an axial bore through which the control rod is received.

47. The connector device of any one of embodiments 41-46, wherein the attachment device comprises a flat bar having a hole through which the pivot rod can be received and a generally U-shaped clip that has two holes for receiving the pivot rod, and wherein the clip is sized and designed to straddle the flat bar.

48. The connector device of any one of embodiments 41-47, wherein the body is between the attachment device and the compression fitting.

49. The connector device of any one of embodiments 41-48, wherein the body, the attachment device and the compression fitting are aligned along a common longitudinal axis.

50. The connector device of any one of embodiments 41-46, wherein the attachment device is a two-prong fork that comprises two parallel prongs, wherein each of the two parallel prongs has an inside face, wherein the body and the two-prong fork are made of a first polymeric material, wherein a second polymeric material is fastened to each of the inside faces, wherein the second polymeric material is less rigid and more resilient than the first polymeric material, wherein a gap is defined between the second polymeric material on one prong and the second polymeric material on the other prong, and wherein the pivot rod is received in the gap and held there by friction and by a spring force applied on the pivot rod by the prongs.

51. A pop-up drain assembly for a sink or basin having a drain opening, comprising:

piping for providing a fluid flow pathway from the sink or basin through the drain opening and through the piping;

a stopper for retaining fluid in the sink or basin, wherein the stopper is received in the piping while in operation and is moveable between an open position and a closed position;

a pivot rod engaged with the stopper for moving the stopper between the open position and the closed position, wherein the pivot rod has a stopper end and an outer end; and a control rod engaged with the pivot rod for moving the pivot rod and thereby moving the stopper, wherein the piping has a pivot rod port, wherein the pivot rod is received in the pivot rod port, wherein the stopper comprises a body that has a length, a longitudinal axis, an upper end, a cap on the upper end, a lower end, and a dual-prong fork on the lower end, wherein the dual prong fork is adjacent to the pivot rod port, and wherein the pivot rod is received between the prongs in the dual-prong fork in a friction fit.

52. The pop-up drain assembly of embodiment 51, wherein the body comprises a plurality of fins that project radially from the longitudinal axis of the body and extend longitudinally, wherein the fins have longitudinal outer edges that define an outermost perimeter of the body, wherein the dual-prong fork depends from one of the fins, and wherein the dual-prong fork has a surface that lies on the outermost perimeter of the body.

53. The pop-up drain assembly of embodiment 51 or 52, wherein the dual-prong fork comprises two parallel prongs, wherein each of the two parallel prongs has an inside face, wherein the body and the dual-prong fork are made of a first polymeric material, wherein a second polymeric material is fastened to each of the inside faces, wherein the second polymeric material is less rigid and more resilient than the first polymeric material, wherein a gap is defined between the second polymeric material on one prong and the second polymeric material on the other prong, and wherein the pivot rod is received in the gap and held there by friction and by a spring force applied on the pivot rod by the prongs.

54. The pop-up drain assembly of any one of embodiments 51-53, wherein the dual-prong fork comprises two parallel prongs, wherein each of the two parallel prongs has an inside face and an opposing outside face, wherein the inside faces define a gap between the two parallel prongs, wherein the stopper has a support plate attached to or made integral with the outside face of one of the prongs that extends toward a central portion of the stopper, and wherein the stopper has a stop plate connected at a right angle to an edge of the support plate such that the stop plate is parallel to and spaced away from the prongs.

55. The pop-up drain assembly of embodiment 54, wherein the body of the stopper defines a circular cylindrical space that has a longitudinal axis and an outermost surface, wherein the dual-prong fork has an outer surface adjacent to the pivot rod port, and wherein the outer surface of the dual-prong fork has a length that extends longitudinally along the outermost surface of the circular cylindrical space.

56. The pop-up drain assembly of embodiment 55, wherein the piping has an inside wall that defines a second circular cylindrical space that has a diameter that is only slightly larger than the diameter of the circular cylindrical space defined by the body of the stopper so that the stopper fits snugly inside the piping but moves easily up and down within the piping.

57. The pop-up drain assembly of embodiment 55, wherein the diameter of the second circular cylindrical space is 1, 2, 3, 4 or 5 or 1 to 5 mm greater than the diameter of the circular cylindrical space defined by the body of the stopper, wherein the cap has a diameter that is 1, 2, 3, 4 or 5 or 1 to 5 cm greater than the diameter of the second circular cylindrical space, and wherein the cap has a diameter that is 1, 2, 3, 4 or 5 or 1 to 5 cm greater than the diameter of the circular cylindrical space defined by the body of the stopper.

58. The pop-up drain assembly of any one of embodiment 51 to 57, further comprising:

a connector device for connecting the control rod to the pivot rod, wherein the connector device has a pivot rod end connected to the pivot rod and an opposing control rod end connected to the control rod, and wherein connector rod comprises:

(1) a two-prong fork on the pivot rod end that engages the pivot rod in a friction fit; or (2) a compression fitting on the control rod end that engages the control rod in a compression fit; or (3) both a two-prong fork on the pivot rod end that engages the pivot rod in a friction fit and a compression fitting on the control rod end that engages the control rod in a compression fit.

59. The pop-up drain assembly of any one of embodiment 51 to 57, further comprising:

a connector device for connecting the control rod to the pivot rod, wherein the connector device has a pivot-rod connector connected to the pivot rod and a control-rod connector connected to the control rod, and wherein one or both of the pivot-rod connector and the control-rod connector comprises a compressive-friction connector selected from the group consisting of (1) a two-prong fork sized and designed to hold a rod between the prongs;

(2) a tubular body having a bore, a C-shaped resilient disk received in the bore, and preferably a washer-shaped wall in the bore transverse to the longitudinal axis of the tubular body, the C-shaped resilient disk being sized and designed to hold a rod;

(3) a bar having one or more holes and a grommet received in each hole, the holes and grommets being sized and designed to hold a rod;

(4) an elongate hollow tube made of a stiff and resilient material having a longitudinal slot along its length and an inside diameter, the tube being sized and designed to matingly receive a rod in a friction fit, preferably further including a clamp around the tube for squeezing the tube against the rod;

(5) a hollow tube having an open end and an opposing closed end and an adhesive received in the tube, the tube and the adhesive being selected to releaseably hold a rod inside the tube;

(6) a hollow tube having an open end, an inner circumference, one or more grooves in the inner circumference and at least one snap ring received in one of the grooves, the tube and snap ring being sized and designed to hold a rod inside the tube;

(7) a hollow tube having one or more longitudinal slots, external threads on the tube and a nut having internal threads screwed onto the tube, the nut being preferably split, the tube, the slots and the nut being sized and designed to hold a rod inside the tube;

(8) a hollow tube having a tubular wall, an opening in the wall and a lever-type eccentric-cam clamp attached to the tube at the opening, the tube and clamp being sized and designed to hold a rod in the tube;

(9) a hollow tube having a longitudinal slot, bulges protruding from the tube, the bulges having an angled surface, a block having a lever, the block having angled surfaces pivotably fixed to the bulges adjacent, the tube, bulges and block being sized and designed such that rotation of the lever reduces the inside diameter of the tube for holding a rod in the tube; and

(10) a device in which a resilient material is pressed against a rod for engaging the device with the rod.

60. A connector device for connecting a generally vertical control rod to a generally horizontal pivot rod in a pop-up drain assembly, comprising:

a body;

a pivot-rod connector connected to the pivot rod; and a control-rod connector connected to the control rod, wherein one or both of the pivot-rod connector and the control-rod connector comprises a compressive-friction connector selected from the group consisting of:

(1) a two-prong fork sized and designed to hold a rod between the prongs;

(2) a tubular body having a bore, a C-shaped resilient disk received in the bore, and preferably a washer-shaped wall in the bore transverse to the longitudinal axis of the tubular body, the C-shaped resilient disk being sized and designed to hold a rod;

(3) a bar having one or more holes and a grommet received in each hole, the holes and grommets being sized and designed to hold a rod;

(4) an elongate hollow tube made of a stiff and resilient material having a longitudinal slot along its length and an inside diameter, the tube being sized and designed to matingly receive a rod in a friction fit, preferably further including a clamp around the tube for squeezing the tube against the rod;

(5) a hollow tube having an open end and an opposing closed end and an adhesive received in the tube, the tube and the adhesive being selected to releaseably hold a rod inside the tube;

(6) a hollow tube having an open end, an inner circumference, one or more grooves in the inner circumference and at least one snap ring received in one of the grooves, the tube and snap ring being sized and designed to hold a rod inside the tube;

(7) a hollow tube having one or more longitudinal slots, external threads on the tube and a nut having internal threads screwed onto the tube, the nut being preferably split, the tube, the slots and the nut being sized and designed to hold a rod inside the tube;

(8) a hollow tube having a tubular wall, an opening in the wall and a lever-type eccentric-cam clamp attached to the tube at the opening, the tube and clamp being sized and designed to hold a rod in the tube;

(9) a hollow tube having a longitudinal slot, bulges protruding from the tube, the bulges having an angled surface, a block having a lever, the block having angled surfaces pivotably fixed to the bulges adjacent, the tube, bulges and block being sized and designed such that rotation of the lever reduces the inside diameter of the tube for holding a rod in the tube; and

(10) a device in which a resilient material is pressed against a rod for engaging the device with the rod.

61. A connector device for connecting a generally vertical control rod to a generally horizontal pivot rod in a pop-up drain assembly, comprising:

a pivot-rod connector comprising a two-prong fork sized and designed to hold the pivot rod between the prongs; and a control-rod connector fixed directly or indirectly to the pivot-rod connector and comprising a tubular body having a bore and a C-shaped resilient disk received in the bore, wherein the C-shaped resilient disk is sized and designed to hold a rod.

62. The connector device of embodiment 61, further comprising a washer-shaped disk fixed in the bore transverse to the longitudinal axis of the tubular body and having an opening through which the control rod can pass, wherein the tubular body has a longitudinal slot through which the control rod can pass, wherein the washer-shaped disk provides fulcrum as the control rod is rotated from an angled position to a coaxial position with respect to the tubular body.

63. The connector device of embodiment 61 or 62, wherein the pivot-rod connector and the control-rod connector are coaxial.

64. A retrofit kit for a pop-up drain assembly for a sink or basin having a drain opening; piping for providing a fluid flow pathway from the sink or basin through the drain opening and through the piping; a stopper for retaining fluid in the sink or basin, wherein the stopper is received in the piping while in operation and is moveable between an open position and a closed position; a pivot rod engaged with the stopper for moving the stopper between the open position and the closed position, wherein the pivot rod has a stopper end and an outer end; and a control rod engaged with the pivot rod for moving the pivot rod and thereby moving the stopper, wherein the piping has a pivot rod port, wherein the pivot rod is received in the pivot rod port, the retrofit kit comprising a connector device for connecting the control rod to the pivot rod, the connector device comprising:

a pivot-rod connector comprising a two-prong fork sized and designed to hold the pivot rod between the prongs; and a control-rod connector fixed directly or indirectly to the pivot-rod connector and comprising a tubular body having a bore and a C-shaped resilient disk received in the bore, wherein the C-shaped resilient disk is sized and designed to hold a rod.

65. A connector device for connecting a generally vertical rod to a generally horizontal rod, comprising:

a vertical-rod connector comprising a tubular body having a bore and a C-shaped resilient disk received in the bore, wherein the C-shaped resilient disk is sized and designed to hold the vertical rod; and a horizontal-rod connector comprising a two-prong fork sized and designed to hold the horizontal rod between the prongs, wherein the horizontal-rod connector is fixed directly or indirectly to the vertical-rod connector.

66. The connector device of embodiment 65, wherein each of the vertical-rod connector and the horizontal rod connector have longitudinal axes that are approximately coaxial or approximately parallel to one another.

67. A connector device for connecting first and second rods together that are positioned transverse to one another, comprising:

an elongate body having a longitudinal axis and opposing first and second ends, wherein the first end and some length of the elongate body comprises a C-channel structure, wherein the C-channel structure has a longitudinal axis that is parallel to or coaxial with the longitudinal axis of the elongate body, and wherein the C-channel structure is open along one side of the elongate body;

a C-channel element connected to or formed integral with the first end, wherein the C-channel element has a longitudinal axis that is parallel to or coaxial with the longitudinal axis of the elongate body, wherein the C-channel element is open in a direction that is generally opposite that of the C-channel structure;

an opening defined by and between the elongate body and the C-channel element for receiving the first rod therethrough in a position transverse to the longitudinal axis of the elongate body after which the first rod is received where the C-channel structure and the C-channel element are open by moving the rod into a position in which the longitudinal axis of the first rod is approximately parallel to or coaxial with the longitudinal axis of the elongate body; and a fork having first and second opposing prongs connected to or formed integral with the second end of the elongate body for receiving the second rod between the first and second prongs such that the longitudinal axis of the second rod is transverse to the longitudinal axis of the elongate body, and wherein the fork and its first and second opposing prongs have a longitudinal axis that is generally parallel to or coaxial with the longitudinal axis of the elongate body.

68. The connector device of embodiment 67, further comprising means for securing the first rod to the elongate body and the second rod to the fork.

69. A connector device for connecting a generally vertical rod to a generally horizontal rod, comprising:

an elongate body having a longitudinal axis and opposing first and second ends, wherein the body has a cross-section for a portion of its length that is a C-channel shape with an open side and an opposing closed side;

a C-channel element fixed to or formed integral with the first end of the body, wherein the C-channel element has a longitudinal axis that is coaxial with or approximately parallel to the longitudinal axis of the body, wherein the C-channel element has a cross-section for all or a portion of its length that is a C-channel shape with an open side and an opposing closed side, wherein the open side of the C-channel shape in the C-channel element faces in a direction that is approximately 180 degrees opposite the direction that the open side of the C-channel shape of the body faces, wherein a hole is defined between the C-channel element and the first end of the body, wherein the body, the C-channel element and the hole are sized and designed to receive the generally vertical rod through the hole and in the open side of the C-channel shape in the body and in the open side of the C-channel shape of the C-channel element in a tight or snug compressive-friction engagement; and a two-prong fork fixed to or formed integral with the second end of the body for receiving the generally horizontal rod between the prongs, wherein the two-prong fork is sized and designed to receive the generally horizontal rod in a tight or snug compressive-friction fit.

70. A connector device for connecting a generally vertical control rod to a generally horizontal pivot rod in a pop-up drain assembly, comprising:

a shaft having first and second opposing ends, a length, a first side along its length and a groove along the first side, wherein the groove has a longitudinal axis;

a C-channel element having first and second opposing ends, a length, a second side along its length and a trough along the second side, wherein the trough has a longitudinal axis, wherein the second end of the C-channel element abuts and is attached to or formed integral with the first end of the shaft, wherein the longitudinal axis of the trough is approximately coaxial with the longitudinal axis of the groove, wherein the second side of the C-channel element faces in a direction opposite the direction that the first side of the shaft faces, wherein a hole that is large enough for the control rod to pass through is defined between the C-channel element and the shaft, and wherein shaft and the C-channel element are sized and designed so that a length of the control rod can pass through the hole and lie at least partially inside the groove and at least partially inside the trough in a compressive-friction engagement; and a pivot rod connector attached to the second end of the shaft that is sized and designed to hold the pivot rod.

71. The connector device of embodiment 70, wherein the C-channel element comprises a rubbery polymeric material that defines the trough.

72. The connector device of embodiment 71, wherein the shaft and the C-channel element comprise a plastic material.

73. The connector device of embodiment 70, wherein the shaft and its groove, the C-channel element and its trough and the hole are sized and designed so that the control rod can be passed through the hole while the control rod is transverse to the shaft and then be rotated to press a first length of the control rod into the groove on the shaft and a second length of the control rod into the trough of the C-channel element, thereby positioning the control rod into an engagement with the shaft and the C-channel element such that the longitudinal axis of the control rod is approximately coaxial with or approximately parallel to the longitudinal axes of the groove in the shaft and the trough in the C-channel element.

74. The connector device of embodiment 70, wherein the pivot rod connector comprises a two-prong fork.

75. The connector device of embodiment 74, wherein the two-prong fork has a longitudinal axis that is approximately coaxial with or approximately parallel to the longitudinal axis of the shaft.

76. The connector device of embodiment 75, wherein the two-prong fork has two tines that are adjacent to one another, wherein a space is defined between the tines in which the pivot rod is received, and wherein the tines comprise a rubbery polymeric material.

77. The connector device of embodiment 76, wherein the tines comprise a plastic material in addition to the rubbery polymeric material, and wherein the rubbery polymeric material defines the space between the tines.

78. The connector device of embodiment 70, wherein the pivot rod connector comprises a fork having a body and two tines extending from the body, wherein the tines are adjacent to one another, wherein a gap is defined by and between the tines for receiving the pivot rod in a compressive-friction fit, wherein the gap has a length and a longitudinal axis, and wherein the longitudinal axis of the gap is approximately coaxial with or approximately parallel to the longitudinal axis of the shaft.

79. The connector device of embodiment 78, wherein the tines comprise a plastic material and a rubbery polymeric material, and wherein the rubbery polymeric material defines the gap between the tines.

80. The connector device of embodiment 78, further comprising a band or a clamp surrounding the shaft or the C-channel element for holding the control rod in the compressive-friction engagement with the shaft and the C-channel element.

81. The connector device of any one of embodiments 60 to 80, wherein the connector device does not have a clevis, a clevis screw, a clevis strap, a flat rod or a flat strap with spaced-apart holes, an extension rod, a screw, a thumb screw, a bolt, a threaded nut, a threaded element, a pin such as a cotter pin that connects two pieces together or a spring clip or a U-shaped clip that has a pair of holes for receiving a rod through the pair of holes.

82. The connector device of any one of embodiments 60 to 80, wherein the connector device does not have a screw adapted to press against a rod.

83. The connector device of any one of embodiments 60 to 80, wherein the connector device does not have a spring clip or a U-shaped clip that has a pair of holes for receiving a rod through the pair of holes.

84. The connector device of any one of embodiments 60 to 80, wherein the connector device does not have a magnet, and wherein the connector device does not use electricity or electrical signals.

85. The connector device of any one of embodiments 60 to 80, wherein the connector device does not have a connector bar that has a hole through which a rod passes and remains transverse to the connector device such as connector bar 20 in U.S. Pat. No. 6,061,847 or connecting bar 2 in U.S. patent application Ser. No. 12/201,864 and Pub. No. 2010/0050337 A1.

86. The connector device of any one of embodiments 60 to 85, wherein the rods that the connector device connect together are straight, elongate, cylindrical rods that have a circular cross-section, wherein such rods are exemplified by the pivot rod 26 and the control rod 34 in FIG. 1 of this document, and wherein such rods are exemplified by the rods labeled as 64 and 110 in U.S. Pat. No. 6,484,330 issued to Gray et al.

87. The connector device of any one of embodiments 60 to 85, wherein the rods that the connector device connect together are straight, elongate, cylindrical rods that have a circular cross-section, wherein such rods are not modified in a manner exemplified by the rod labeled 1, which has a specific engagement part 12 for engaging a connecting bar 2, in U.S. patent application Ser. No. 12/201,864 and Pub. No. 2010/0050337 A1, and wherein the rod is not modified in a manner exemplified by the rod labeled 10, which has a J-shaped bottom 11, in U.S. Pat. No. 6,061,847.

88. A method for connecting a first rod to a second rod, wherein the first and second rods are transverse to one another, the method comprising the steps of:

using a connector device to connect to each of the first and second rods, thereby connecting the first and second rods together through the connector device, wherein the connector device comprises:

a first-rod connector having a means for engaging and holding the first rod by pressing a first element against the first rod, wherein the means for engaging and holding the first rod does not include a threaded element; and a second-rod connector having a means for engaging and holding the second rod by pressing a second element against the second rod;

pressing the first-rod connector into a first engagement with the first rod, wherein the first engagement comprises the first element being in physical contact with the first rod; and pressing the second-rod connector into a second engagement with the second rod, wherein the second engagement comprises the second element being in physical contact with the second rod, and wherein the second element comprises a polymeric material, a rubber or a rubbery material, wherein the polymeric material, the rubber or the rubbery material is in physical contact with the second rod.

89. The method of embodiment 88, wherein the first rod has a straight, elongate, smooth and cylindrical shape where the first element is in physical contact with the first rod, and wherein the second rod has a straight, elongate, smooth and cylindrical shape where the second element is in physical contact with the second rod.

90. The method of embodiment 89, wherein the first element comprises a first material, wherein the first material comprises a polymeric material, a rubber or a rubbery material, wherein the first material is in physical contact with the first rod.

91. The method of embodiment 90, wherein the second-rod connector comprises a two-prong fork.

92. The method of embodiment 91, wherein the first-rod connector comprises a shaft having distal and proximal end portions, wherein the distal end portion has a longitudinal trough, wherein the proximal end portion has a longitudinal groove, wherein the longitudinal trough and the longitudinal groove have concave surfaces that face in opposite directions, wherein an opening is defined by and between distal and proximal end portions, and wherein the first-rod connector is sized and designed to receive the first rod through the opening, in the longitudinal trough and in the longitudinal groove.

93. The method of embodiment 92, further comprising a liner adjacent to the concave surface of the longitudinal trough in the distal end portion, wherein the liner comprises the first material.

94. A connector device for connecting first and second rods together, wherein the first and second rods are transverse to one another, the connector device comprising:

a body;

a first-rod connector attached to or formed integral with the body; and a second-rod connector attached to or formed integral with the body, wherein each of the first-rod connector and the second-rod connector comprises a compressive and/or friction engagement means for engaging the first and second rods, respectively, and wherein the compressive and/or friction engagement means is selected from the group consisting of:

(1) a fork having two prongs adjacent to one another, wherein the fork is sized and designed to hold the first or the second rod between the prongs, (2) a compression fitting having a ferrule element, (3) a tubular body having a bore, a C-shaped resilient disk received in the bore, and a washer-shaped wall in the bore transverse to the longitudinal axis of the tubular body, wherein the C-shaped resilient disk is sized and designed to hold the first or the second rod, (4) a bar having one or more holes and a grommet received in each hole, the holes and grommets being sized and designed to hold the first or the second rod, (5) an elongate hollow tube made of a stiff and resilient material having a longitudinal slot along its length and an inside diameter, the tube being sized and designed to matingly receive the first or the second rod in a friction fit, and a clamp around the tube, (6) a hollow tube having an open end and an opposing closed end and an adhesive received in the tube, the tube and the adhesive being selected to releaseably hold the first or the second rod inside the tube, (7) a hollow tube having an open end, an inner circumference, one or more grooves in the inner circumference and at least one snap ring received in one of the grooves, the tube and snap ring being sized and designed to hold the first or the second rod inside the tube, (8) a hollow tube having one or more longitudinal slots, external threads on the tube and a nut having internal threads screwed onto the tube, wherein the tube, the slots and the nut are sized and designed to hold the first or the second rod inside the tube, (9) a hollow tube having a tubular wall, an opening in the wall and a lever-type eccentric-cam clamp attached to the tube at the opening, the tube and clamp being sized and designed to hold the first or the second rod in the tube,

(10) a hollow tube having a longitudinal slot, bulges protruding from the tube, the bulges having an angled surface, a block having a lever, the block having angled surfaces pivotably fixed to the bulges, wherein the tube, the bulges and the block are sized and designed such that rotation of the lever reduces the inside diameter of the tube for holding the first or the second rod in the tube,

(11) a shaft having distal and proximal end portions, wherein the distal end portion has a longitudinal trough, wherein the proximal end portion has a longitudinal groove, wherein the longitudinal trough and the longitudinal groove have concave surfaces that face in opposite directions, wherein an opening is defined by and between distal and proximal end portions, and wherein the shaft is sized and designed to receive the first or the second rod through the opening, in the longitudinal trough and in the longitudinal groove, and

(12) a fastener in which a resilient material is pressed against the first or the second rod for engaging the fastener with the first or the second rod.

95. The connector device of embodiment 94, wherein the first and second rods are each straight, elongate, smooth and cylindrical in shape where engaged by the first-rod connector and the second-rod connector, respectively.

96. The connector device of embodiment 94 or 95, wherein the compressive and/or friction engagement means does not include a screw adapted to press against the first or the second rod, and wherein the compressive and/or friction engagement means does not include a spring clip that has a pair of holes for receiving the first or second rod through the pair of holes.

97. The connector device of embodiment 94, 95 or 96, wherein the compressive and/or friction engagement means for the first-rod connector is the fork or the bar.

98. The connector device of embodiment 97, wherein the compressive and/or friction engagement means for the second-rod connector is the shaft.

99. A pop-up drain assembly for a sink or basin having a drain opening, comprising:

piping for providing a fluid flow pathway from the sink or basin through the drain opening and through the piping;

a stopper for retaining fluid in the sink or basin, wherein the stopper is received in the piping while in operation and is moveable between an open position and a closed position; and a pivot rod engaged with the stopper for moving the stopper between the open position and the closed position, wherein the pivot rod has a stopper end and an outer end;

a control rod for moving the pivot rod; and a connector device according to any one of embodiments 92 to 98 for connecting the control rod and the pivot together.

100. The pop-up drain assembly of embodiment 99, wherein the drain stopper comprises: a body and an elongated magnet, wherein the body has a length, a longitudinal axis, an upper end and an opposing lower end, wherein the body defines a circular cylindrical space that has an outermost cylindrical surface of the drain stopper, wherein the body has a magnet holder that has an outer surface that lies on the outermost cylindrical surface, wherein the magnet holder has a length that extends longitudinally along the outermost cylindrical surface, wherein the elongated magnet is received in the magnet holder, and wherein the magnet has a longitudinal axis that is radially offset from and generally parallel to the longitudinal axis of the body.

Having described the invention above, various modifications of the techniques, procedures, materials, and equipment will be apparent to those skilled in the art. It is intended that all such variations within the scope and spirit of the invention be included within the scope of the appended claims.

What is claimed is:

1. A pop-up drain assembly for a sink or basin having a drain opening, comprising:

piping for providing a fluid flow pathway from the sink or basin through the drain opening and through the piping;

a stopper for retaining fluid in the sink or basin, wherein the stopper is received in the piping while in operation and is moveable between an open position and a closed position; and a pivot rod engaged with the stopper for moving the stopper between the open position and the closed position, wherein the pivot rod has a stopper end and an outer end;

a control rod for moving the pivot rod; and a connector device for connecting the control rod and the pivot together, the connector device comprising:

a body;

a control-rod connector attached to or formed integral with the body; and a pivot-rod connector attached to or formed integral with the body, wherein each of the control-rod connector and the pivot-rod connector comprises a compressive and/or friction engagement means for engaging the control rod and pivot rod, respectively, and wherein the compressive and/or friction engagement means is selected from the group consisting of (1) a fork having two prongs adjacent to one another, wherein the fork is sized and designed to hold the control rod or the pivot rod between the prongs, (2) a compression fitting having a ferrule element, (3) a first tubular body having a bore, a C-shaped resilient disk received in the bore, and a washer-shaped wall in the bore transverse to the longitudinal axis of the first tubular body, wherein the C-shaped resilient disk is sized and designed to hold the control rod or the pivot rod, (4) a bar having one or more holes, the holes being sized and designed to hold the control rod or the pivot rod, (5) a first tube made of a stiff and resilient material having a longitudinal slot along its length and an inside diameter, the first tube being sized and designed to matingly receive the control rod or the pivot rod inside the first tube, and a clamp around the first tube, (6) a second tube having an open end and an opposing closed end and an adhesive received in the second tube, the second tube and the adhesive being selected to releaseably hold the control rod or the pivot rod inside the second tube, (7) a third tube having an open end, an inner circumference, one or more grooves in the inner circumference and at least one snap ring received in one of the grooves, the third tube and snap ring being sized and designed to hold the control rod or the pivot rod inside the third tube, (8) a fourth tube having one or more longitudinal slots, external threads on the fourth tube and a nut having internal threads screwed onto the fourth tube, wherein the fourth tube, the slots and the nut are sized and designed to hold the control rod or the pivot rod inside the fourth tube, (9) a fifth tube having a tubular wall, an opening in the wall and a lever-type eccentric-cam clamp attached to the fifth tube at the opening, the fifth tube and eccentric-cam clamp being sized and designed to hold the control rod or the pivot rod in the fifth tube,

(10) a sixth tube having a longitudinal slot, bulges protruding from the sixth tube, the bulges having an angled surface, a block having a lever, the block having angled surfaces pivotably fixed to the bulges, wherein the sixth tube, the bulges and the block are sized and designed such that rotation of the lever reduces the inside diameter of the sixth tube for holding the control rod or the pivot rod in the sixth tube,

(11) a shaft having distal and proximal end portions, wherein the distal end portion has a longitudinal trough, wherein the proximal end portion has a longitudinal groove, wherein the longitudinal trough and the longitudinal groove have concave surfaces that face in opposite directions, wherein an opening is defined by and between distal and proximal end portions, and wherein the shaft is sized and designed to receive the control rod or the pivot rod through the opening, in the longitudinal trough and in the longitudinal groove, and

(12) a fastener in which a resilient material is pressed against the control rod or the pivot rod for engaging the fastener with the control rod or the pivot rod.

2. The pop-up drain assembly of claim 1, wherein the control rod and pivot rod are each straight, elongate, smooth and cylindrical in shape with a circular cross-section where engaged by the control-rod connector and the pivot-rod connector, respectively.

3. The pop-up drain assembly of claim 1, wherein the compressive and/or friction engagement means does not include a screw adapted to press against the control rod or the pivot rod, and wherein the compressive and/or friction engagement means does not include a spring clip that has a pair of holes for receiving the control rod or pivot rod through the pair of holes.

4. The pop-up drain assembly of claim 1, wherein the compressive and/or friction engagement means for the pivot-rod connector is the fork, and wherein the compressive and/or friction engagement means for the control-rod connector is the shaft.

5. The pop-up drain assembly of claim 1, wherein the compressive and/or friction engagement means for the control-rod connector is the shaft.

6. The pop-up drain assembly of claim 5, wherein the compressive and/or friction engagement means for the pivot-rod connector is the bar.

7. The pop-up drain assembly of claim 1, wherein the compressive and/or friction engagement means for the control-rod connector and the pivot-rod connector is selected from the group consisting of the shaft, the fork and the bar, and wherein the compressive and/or friction engagement means does not include a screw adapted to press against the control rod or the pivot rod.

8. The pop-up drain assembly of claim 1, wherein the piping has a pivot rod port, wherein the pivot rod is received in the pivot rod port, wherein the stopper comprises a body that has a length, a longitudinal axis, an upper end, a cap on the upper end, a lower end, and a dual-prong fork on the lower end, wherein the dual-prong fork is adjacent to the pivot rod port, and wherein the pivot rod is received between the prongs in the dual-prong fork.

9. The pop-up drain assembly of claim 8, wherein the compressive and/or friction engagement means for the pivot-rod connector is the fork.

10. The pop-up drain assembly of claim 8, wherein the compressive and/or friction engagement means for the control-rod connector is the shaft.

11. The pop-up drain assembly of claim 8, wherein the compressive and/or friction engagement means for the control-rod connector and the pivot-rod connector is selected from the group consisting of the shaft, the fork and the bar.

12. The pop-up drain assembly of claim 8, wherein the body of the stopper comprises a plurality of fins that project radially from the longitudinal axis of the body and extend longitudinally, wherein the fins have longitudinal outer edges that define an outermost perimeter of the body, wherein the dual-prong fork depends from one of the fins, and wherein the dual-prong fork has a surface that lies on the outermost perimeter of the body.

13. The pop-up drain assembly of claim 1, wherein the piping has a pivot rod port, wherein the pivot rod is received in the pivot rod port, wherein the stopper comprises:

a stopper shaft having a length, a longitudinal axis through the length of the stopper shaft, an upper end and an opposing lower end;

a cap received on the upper end for providing a seal to retain fluid in the sink or basin;

at least two radial flanges, wherein the radial flanges extend along the length of the stopper shaft, wherein the radial flanges either intersect to define the stopper shaft or are attached to the stopper shaft or are formed integral with the stopper shaft, and wherein the radial flanges project radially with respect to the longitudinal axis of the stopper shaft for centering the drain stopper in the piping;

a pivot rod holder that depends downwardly from the lower end of the stopper shaft or that depends downwardly from the radial flanges, wherein the pivot rod holder comprises a pair of opposing prongs, wherein each of the prongs has an inside edge, wherein a gap is defined between the inside edges of the opposing prongs, and wherein the gap has a longitudinal axis that is coaxial with the longitudinal axis of the stopper shaft; and a resilient material bonded to or formed integral with at least one of the inside edges, wherein the pivot rod is received in the gap and held between the prongs.

14. The pop-up drain assembly of claim 1, wherein the piping has a pivot rod port, wherein the pivot rod is received in the pivot rod port, wherein the stopper comprises:

an elongated body having a longitudinal axis, the body comprising two or more longitudinal fins for centering the body in a drain pipe, wherein the fins project radially and define an outermost circumference of the body;

a cap on one end of the body for providing a seal;

a magnet holder extending longitudinally from one of the fins away from the cap end; and a magnet or a magnetic material received in the magnet holder, wherein the magnet holder, the magnet or the magnetic material has an outer surface approximately and substantially aligned with the outermost circumference of the body, and wherein the magnet or magnetic material is elongated and has a longitudinal axis that is radially offset from and substantially parallel to the longitudinal axis of the body.

15. A connector device for connecting first and second rods together, wherein the first and second rods are transverse to one another, the connector device comprising:

a body;

a first-rod connector attached to or formed integral with the body; and a second-rod connector attached to or formed integral with the body, wherein each of the first-rod connector and the second-rod connector comprises a compressive and/or friction engagement means for engaging the first and second rods, respectively, and wherein the compressive and/or friction engagement means is selected from the group consisting of:

(1) a fork having two prongs adjacent to one another, wherein the fork is sized and designed to hold the first or the second rod between the prongs, (2) a compression fitting having a ferrule element, (3) a first tubular body having a bore, a C-shaped resilient disk received in the bore, and a washer-shaped wall in the bore transverse to the longitudinal axis of the first tubular body, wherein the C-shaped resilient disk is sized and designed to hold the first or the second rod, (4) a bar having one or more holes and a grommet received in each hole, the holes and grommets being sized and designed to hold the first or the second rod, (5) a first tube made of a stiff and resilient material having a longitudinal slot along its length and an inside diameter, the first tube being sized and designed to matingly receive the first or the second rod inside the first tube, and a clamp around the first tube, (6) a second tube having an open end and an opposing closed end and an adhesive received in the second tube, the second tube and the adhesive being selected to releaseably hold the first or the second rod inside the second tube, (7) a third tube having an open end, an inner circumference, one or more grooves in the inner circumference and at least one snap ring received in one of the grooves, the third tube and snap ring being sized and designed to hold the first or the second rod inside the third tube, (8) a fourth tube having one or more longitudinal slots, external threads on the fourth tube and a nut having internal threads screwed onto the fourth tube, wherein the fourth tube, the slots and the nut are sized and designed to hold the first or the second rod inside the fourth tube, (9) a fifth tube having a tubular wall, an opening in the wall and a lever-type eccentric-cam clamp attached to the fifth tube at the opening, the fifth tube and eccentric-cam clamp being sized and designed to hold the first or the second rod in the fifth tube,

(10) a sixth tube having a longitudinal slot, bulges protruding from the sixth tube, the bulges having an angled surface, a block having a lever, the block having angled surfaces pivotably fixed to the bulges, wherein the sixth tube, the bulges and the block are sized and designed such that rotation of the lever reduces the inside diameter of the sixth tube for holding the first or the second rod in the sixth tube,

(11) a shaft having distal and proximal end portions, wherein the distal end portion has a longitudinal trough, wherein the proximal end portion has a longitudinal groove, wherein the longitudinal trough and the longitudinal groove have concave surfaces that face in opposite directions, wherein an opening is defined by and between distal and proximal end portions, and wherein the shaft is sized and designed to receive the first or the second rod through the opening, in the longitudinal trough and in the longitudinal groove, and

(12) a fastener in which a resilient material is pressed against the first or the second rod for engaging the fastener with the first or the second rod.

16. A connector device for connecting first and second rods together that are positioned transverse to one another, comprising:

an elongate body having a longitudinal axis and opposing first and second ends, wherein the first end and some length of the elongate body comprises a C-channel structure, wherein the C-channel structure has a longitudinal axis that is parallel to or coaxial with the longitudinal axis of the elongate body, and wherein the C-channel structure is open along one side of the elongate body;

a C-channel element connected to or formed integral with the first end of the elongate body, wherein the C-channel element has a longitudinal axis that is parallel to or coaxial with the longitudinal axis of the elongate body, wherein the C-channel element is open in a direction that is generally opposite that of the C-channel structure;

an opening defined by and between the elongate body and the C-channel element, wherein the elongate body, the C-channel element and the opening are sized and designed to receive the first rod through the opening and within the elongate body and the C-channel element in a compressive-friction engagement; and a second-rod connector attached to or formed integral with the second end of the elongate body, wherein the second-rod connector is sized and designed to receive the second rod in a compressive-friction fit.

17. The connector device of claim 16, wherein the second-rod connector comprises a fork having first and second opposing prongs for receiving the second rod between the first and second prongs such that the longitudinal axis of the second rod is transverse to the longitudinal axis of the elongate body.

18. The connector device of claim 17, wherein the fork and its first and second opposing prongs have a longitudinal axis that is generally parallel to or coaxial with the longitudinal axis of the elongate body.

19. The connector device of claim 17, wherein each of the C-channel structure and the C-channel element have a U-shaped cross-section and a groove defined by the U-shaped cross-section, and wherein each of the C-channel structure and the C-channel element are sized and designed to receive the first rod within the groove.

20. The connector device of claim 19, wherein the C-channel element has an inner surface that defines the groove, further comprising a liner adjacent to the inner surface, wherein the liner is made of a material that is more resilient than the material of which the remainder of the C-channel element is made.

21. A connector device for connecting a generally vertical rod to a generally horizontal rod, comprising:

an elongate body having a longitudinal axis and opposing first and second ends, wherein the body has a cross-section for a portion of its length that is a C-channel shape with an open side and an opposing closed side;

a C-channel element fixed to or formed integral with the first end of the body, wherein the C-channel element has a longitudinal axis that is coaxial with or approximately parallel to the longitudinal axis of the body, wherein the C-channel element has a cross-section for all or a portion of its length that is a C-channel shape with an open side and an opposing closed side, wherein the open side of the C-channel shape in the C-channel element faces in a direction that is approximately 180 degrees opposite the direction that the open side of the C-channel shape of the body faces, wherein a hole is defined between the C-channel element and the first end of the body, wherein the body, the C-channel element and the hole are sized and designed to receive the generally vertical rod through the hole and in the open side of the C-channel shape in the body and in the open side of the C-channel shape of the C-channel element in a tight or snug compressive-friction engagement; and a second-rod connector attached to or formed integral with the second end of the elongate body, wherein the second-rod connector is sized and designed to receive the second rod in a compressive-friction fit.

22. The connector device of claim 21, wherein the second-rod connector comprises a fork having two prongs, wherein the prongs define a slot between the prongs for receiving the generally horizontal rod within the slot and between the prongs, wherein the two-prong fork is sized and designed to receive and hold the generally horizontal rod in a compressive-friction fit.

23. A connector device for connecting a generally vertical control rod to a generally horizontal pivot rod in a pop-up drain assembly, comprising:

a shaft having first and second opposing ends, a length, a first side along its length and a groove along the first side, wherein the groove has a longitudinal axis;

a C-channel element having first and second opposing ends, a length, a second side along its length and a trough along the second side, wherein the trough has a longitudinal axis, wherein the second end of the C-channel element abuts and is attached to or formed integral with the first end of the shaft, wherein the longitudinal axis of the trough is approximately coaxial with the longitudinal axis of the groove, wherein the second side of the C-channel element faces in a direction opposite the direction that the first side of the shaft faces, wherein a hole that is large enough for the control rod to pass through is defined between the C-channel element and the shaft, and wherein shaft and the C-channel element are sized and designed so that a length of the control rod can pass through the hole and lie at least partially inside the groove and at least partially inside the trough in a compressive-friction engagement; and a pivot rod connector attached to the second end of the shaft that is sized and designed to hold the pivot rod.

24. The connector device of claim 23, wherein the C-channel element comprises a rubbery polymeric material that defines the trough.

25. The connector device of claim 24, wherein the shaft and the C-channel element comprise a plastic material, wherein the rubbery polymeric material is more resilient than the plastic material.

26. The connector device of claim 23, wherein the shaft and its groove, the C-channel element and its trough and the hole are sized and designed so that the control rod can be passed through the hole while the control rod is transverse to the shaft and then be rotated to press a first length of the control rod into the groove on the shaft and a second length of the control rod into the trough of the C-channel element, thereby positioning the control rod into an engagement with the shaft and the C-channel element such that the longitudinal axis of the control rod is approximately coaxial with or approximately parallel to the longitudinal axes of the groove in the shaft and the trough in the C-channel element.

27. The connector device of claim 23, wherein the pivot rod connector comprises a two-prong fork.

28. The connector device of claim 27, wherein the two-prong fork has a longitudinal axis that is approximately coaxial with or approximately parallel to the longitudinal axis of the shaft.

29. The connector device of claim 28, wherein the two-prong fork has two tines that are adjacent to one another, wherein a space is defined between the tines in which the pivot rod is received, and wherein the tines comprise a rubbery polymeric material.

30. The connector device of claim 29, wherein the tines comprise a plastic material in addition to the rubbery polymeric material, wherein the rubbery polymeric material defines the space between the tines, and wherein the rubbery polymeric material is more resilient than the plastic material.

31. The connector device of claim 23, wherein the pivot rod connector comprises a fork having a body and two tines extending from the body, wherein the tines are adjacent to one another, wherein a gap is defined by and between the tines for receiving the pivot rod in a compressive-friction fit, wherein the gap has a length and a longitudinal axis, and wherein the longitudinal axis of the gap is approximately coaxial with or approximately parallel to the longitudinal axis of the shaft.

32. The connector device of claim 31, wherein the tines comprise a plastic material and a rubbery polymeric material, wherein the rubbery polymeric material defines the gap between the tines, and wherein the rubbery polymeric material is more resilient than the plastic material.

33. The connector device of claim 32, further comprising a band or a clamp surrounding the shaft or the C-channel element for holding the control rod in the compressive-friction engagement with the shaft and the C-channel element.

34. The connector device of claim 33, further comprising a ring surrounding the tines for squeezing the tines against the pivot rod.

35. A connector device for forming an indirect connection between first and second rods, wherein the first and second rods are transverse to one another, the connector device comprising:

a first-rod connector comprising a two-prong fork having two tines, wherein the tines are essentially parallel to one another and spaced apart, wherein each tine has an inside face, wherein the inside face of each tine faces the inside face of the other tine, wherein a slot is defined by and between the inside faces of the tines, wherein the first-rod connector has a longitudinal axis that passes through the slot, and wherein the two-prong fork, the tines and the slot are sized and designed to receive the first rod within the slot with the tines exerting a compressive force on the first rod; and a second-rod connector capable of engaging the second rod in a compressive or friction fit, wherein the second-rod connector has a longitudinal axis that is approximately coaxial with or approximately parallel to the longitudinal axis of the first-rod connector.

36. The connector device of claim 35, wherein the second-rod connector comprises:

an elongate body having opposing first and second ends, wherein the elongate body comprises a longitudinal groove extending along the body;

an end piece connected to or formed integral with the first end of the elongate body, wherein the end piece has a longitudinal trough extending along the end piece, and wherein the groove and the trough have open sides that face away from each other; and an opening defined by and between the elongate body and the end piece, wherein the elongate body, the end piece and the opening are sized and designed to receive the second rod through the opening and within the groove in the elongate body and within the trough in the first-end piece in a compressive and/or friction engagement.

37. The connector device of claim 36, wherein the second-rod connector has a longitudinal axis that passes through the trough, through the opening and through the groove, and wherein the longitudinal axis of the second-rod connector is approximately co-axial with or approximately parallel to the longitudinal axis of the first-rod connector.

38. A method for connecting a first rod to a second rod, wherein the first and second rods are transverse to one another, the method comprising the steps of:

using a connector device to connect to each of the first and second rods, thereby connecting the first and second rods together through the connector device, wherein the connector device comprises:

a first-rod connector having a means for engaging and holding the first rod by pressing a first element against the first rod, wherein the means for engaging and holding the first rod does not include a threaded element; and a second-rod connector having a means for engaging and holding the second rod by pressing a second element against the second rod;

pressing the first-rod connector into a first engagement with the first rod, wherein the first engagement comprises the first element being in physical contact with the first rod; and pressing the second-rod connector into a second engagement with the second rod, wherein the second engagement comprises the second element being in physical contact with the second rod, and wherein the second element comprises a polymeric material, a rubber or a rubbery material, wherein the polymeric material, the rubber or the rubbery material is in physical contact with the second rod.

39. The method of embodiment 38, wherein the first rod has a straight, elongate, smooth and cylindrical shape where the first element is in physical contact with the first rod, and wherein the second rod has a straight, elongate, smooth and cylindrical shape where the second element is in physical contact with the second rod.

40. The method of embodiment 39, wherein the first element comprises a first material, wherein the first material comprises a polymeric material, a rubber or a rubbery material, wherein the first material is in physical contact with the first rod.

41. The method of embodiment 40, wherein the second-rod connector comprises a two-prong fork.

42. The method of embodiment 41, wherein the first-rod connector comprises a shaft having distal and proximal end portions, wherein the distal end portion has a longitudinal trough, wherein the proximal end portion has a longitudinal groove, wherein the longitudinal trough and the longitudinal groove have concave surfaces that face in opposite directions, wherein an opening is defined by and between distal and proximal end portions, and wherein the first-rod connector is sized and designed to receive the first rod through the opening, in the longitudinal trough and in the longitudinal groove.

43. The method of embodiment 42, further comprising a liner adjacent to the concave surface of the longitudinal trough in the distal end portion, wherein the liner comprises the first material.

44. A drain stopper, comprising: a body having a length, an upper end and an opposing lower end, wherein the body defines a circular cylindrical space that has a longitudinal axis and an outer surface; a cap having a seal or a gasket, wherein the cap is received on the upper end of the body; and a two-prong fork attached directly or indirectly to the body, wherein the two-prong fork has an outer surface, wherein the outer surface of the two-prong fork has a length that extends longitudinally along the outer surface of the circular cylindrical space, and wherein the two-prong fork has a longitudinal axis that is offset radially from the longitudinal axis of the circular cylindrical space.

45. The drain stopper of embodiment 44, wherein the body includes a plurality of fins that project radially to the outer surface of the circular cylindrical space and extend longitudinally, and wherein the cap has a maximum diameter that is more than 1.5 times greater than the diameter of the outermost circumference and less than 4.5 times greater than the diameter of the outermost circumference.

46. The drain stopper of embodiment 45, further comprising a stop plate extending longitudinally from the lower end of the body along the longitudinal axis.

47. The drain stopper of embodiment 46, wherein the two-prong fork has an inner surface opposing the outer surface, and wherein a space is defined between inner surface and the stop plate.

48. The drain stopper of embodiment 47, further comprising a support extending between one of the prongs and the stop plate.

49. A drain stopper having an upper end and a lower end, a cap on the upper end, and a dual-prong fork on the lower end, wherein the dual-prong fork comprises two parallel prongs, wherein each of the two parallel prongs has an inside face and an opposing outside face, wherein the inside faces define a gap between the two parallel prongs, wherein the stopper has a support plate attached to or made integral with the outside face of one of the prongs that extends toward a central portion of the stopper, wherein the stopper has a stop plate connected at a right angle to an edge of the support plate such that the stop plate is parallel to and spaced away from the prongs, wherein the stopper has a body that defines a circular cylindrical space that has a longitudinal axis and a perimeter, wherein the dual-prong fork has an outer surface that has a length that extends longitudinally along the perimeter of the circular cylindrical space.

* * * * *